US012426669B2

(12) United States Patent
Lupinek et al.

(10) Patent No.: US 12,426,669 B2
(45) Date of Patent: Sep. 30, 2025

(54) ARTICLE OF FOOTWEAR HAVING A SOLE STRUCTURE WITH A PLATE FOR STABILITY

(71) Applicant: NIKE, Inc., Beaverton, OR (US)

(72) Inventors: Jaroslav J. Lupinek, Portland, OR (US); Kelly A. O'Connor, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/430,007

(22) Filed: Feb. 1, 2024

(65) Prior Publication Data

US 2025/0151842 A1 May 15, 2025

Related U.S. Application Data

(60) Provisional application No. 63/597,496, filed on Nov. 9, 2023.

(51) Int. Cl.
*A43B 13/12* (2006.01)
*A43B 13/18* (2006.01)
*A43B 13/37* (2006.01)

(52) U.S. Cl.
CPC ..... *A43B 13/127* (2013.01); *A43B 13/187* (2013.01); *A43B 13/37* (2013.01)

(58) Field of Classification Search
CPC ..... A43B 13/127; A43B 13/128; A43B 13/37
See application file for complete search history.

(56) References Cited

U.S. PATENT DOCUMENTS

| | | | | |
|---|---|---|---|---|
| 4,551,930 | A * | 11/1985 | Graham | A43B 5/06 36/114 |
| 4,858,338 | A * | 8/1989 | Schmid | A43B 13/187 36/102 |
| 11,478,039 | B2 * | 10/2022 | Paulson | A43B 13/026 |
| 12,016,422 | B2 * | 6/2024 | Girard | A43B 13/37 |
| 12,089,690 | B2 * | 9/2024 | Hishikawa | A43B 13/181 |
| 2010/0236096 | A1 | 9/2010 | Pauk et al. | |
| 2017/0095033 | A1 * | 4/2017 | Farina | A43B 13/186 |
| 2018/0132564 | A1 * | 5/2018 | Bruce | A43B 13/189 |
| 2018/0153254 | A1 * | 6/2018 | Fusco | A43B 13/187 |
| 2019/0365030 | A1 * | 12/2019 | Chambers | A43B 13/14 |
| 2021/0037911 | A1 * | 2/2021 | Paulson | A43B 13/127 |
| 2021/0227928 | A1 | 7/2021 | Chambers et al. | |
| 2021/0392992 | A1 * | 12/2021 | Duffy | A43B 13/12 |
| 2022/0151337 | A1 * | 5/2022 | Fujita | A43B 13/187 |
| 2022/0211142 | A1 * | 7/2022 | Paulson | A43B 13/127 |
| 2023/0124653 | A1 | 4/2023 | Farina et al. | |
| 2023/0137398 | A1 | 5/2023 | Caldwell et al. | |

* cited by examiner

*Primary Examiner* — Bao-Thieu L Nguyen
(74) *Attorney, Agent, or Firm* — Quinn IP Law

(57) ABSTRACT

An article of footwear includes a sole structure that has a plate, a first foam layer, and a second foam layer. The first foam layer overlies the plate and has a distal side interfacing with a proximal side of the plate. The second foam layer underlies the plate and has a proximal side interfacing with a distal side of the plate. A compressive stiffness of the first foam layer is greater than a compressive stiffness of the second foam layer. A compressive stiffness of the plate is greater than the compressive stiffness of the first foam layer.

18 Claims, 31 Drawing Sheets

ARTICLE OF FOOTWEAR HAVING A SOLE STRUCTURE WITH A PLATE FOR STABILITY

CROSS-REFERENCE TO RELATED APPLICATION

This application claims the benefit of priority to U.S. Provisional Application No. 63/597,496, filed Nov. 9, 2023 which is incorporated by reference in its entirety.

TECHNICAL FIELD

The present disclosure generally relates to an article of footwear and, more specifically, to a sole structure for an article of footwear including a plate.

BACKGROUND

Some people may especially benefit from footwear that provides stability and support. For example, pregnancy may cause swelling of the feet and increased loading due to weight gain. At the same time, bodily changes including a gradual shift in the center of gravity and a loosening of the ligaments may challenge balance and coordination, causing a sense of instability.

BRIEF DESCRIPTION OF THE DRAWINGS

The drawings described herein are for illustrative purposes only, are schematic in nature, and are intended to be exemplary rather than to limit the scope of the disclosure.

FIG. 9 is a cross-sectional view of the plate of FIG. 8 taken at lines 9-9 in

FIG. 8.

DESCRIPTION

Figures 1, 2:
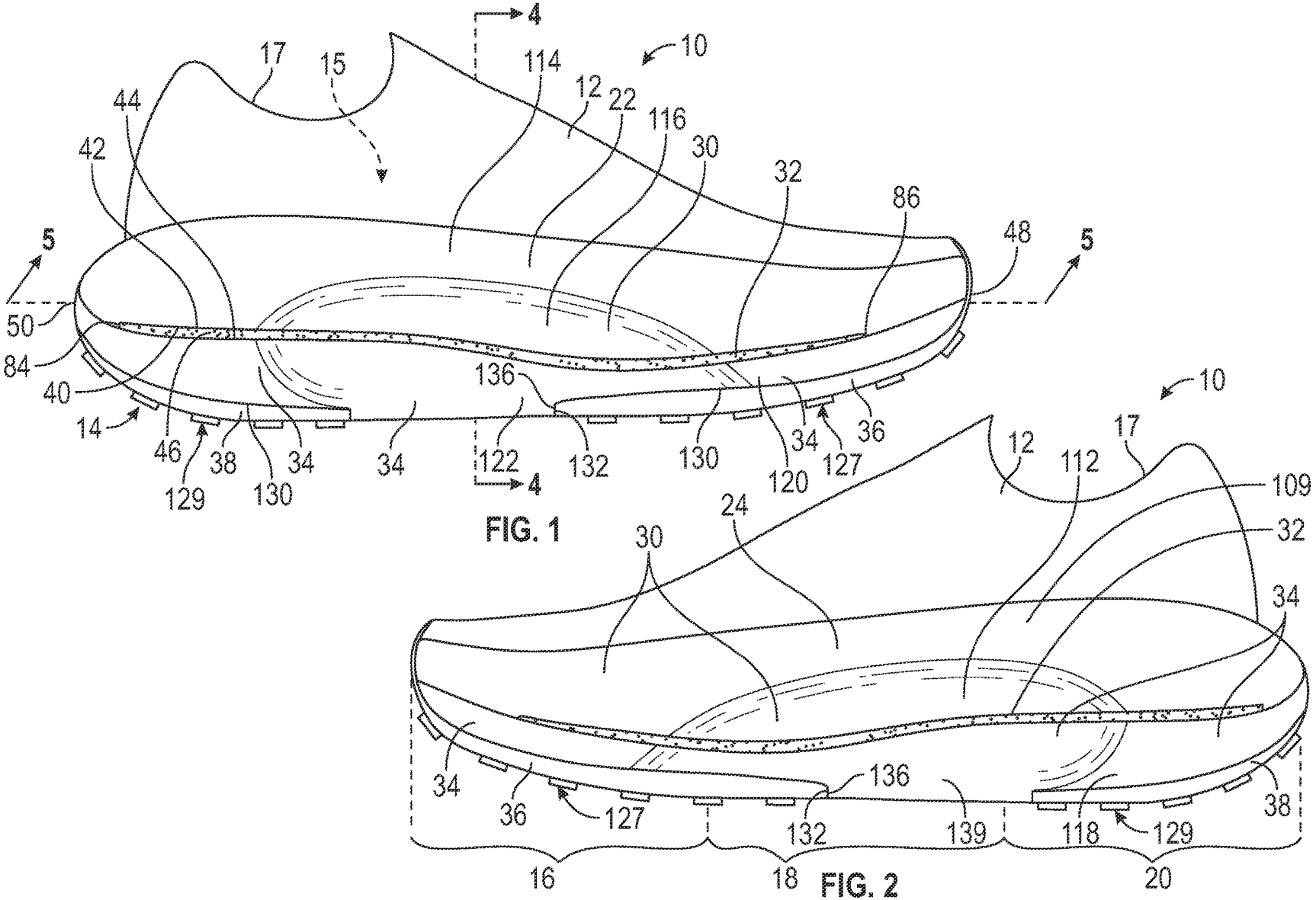
FIG. 1 is a lateral side view of an article of footwear.
FIG. 2 is a medial side view of the article of footwear of FIG. 1.

In an example, an article of footwear disclosed herein includes a sole structure that has a plate, a first foam layer, and a second foam layer. The first foam layer overlies the plate and has a distal side interfacing with a proximal side of the plate. The second foam layer underlies the plate and has a proximal side interfacing with a distal side of the plate. In some implementations, a compressive stiffness of the first foam layer may be greater than a compressive stiffness of the second foam layer. A compressive stiffness of the plate may be greater than the compressive stiffness of the first foam layer.

Stated differently, in such an embodiment, the plate is the stiffest component, while the overlying foam layer closest to the foot of the wearer is stiffer than the underlying foam layer that is further from the foot and closer to the ground. The relatively stiff first foam layer maximizes the ability of the plate to spread pressure over the entire width of the foot. The relatively less stiff second foam layer dampens impact loads and vibrations below the plate to maintain the even spread of pressure at the foot. Because the overlying, first foam layer may be stiffer than the underlying, second foam layer, it avoids localized compression to act in concert with the plate to distribute loading, while still providing sufficient comfort. The muscles in the feet may need to work less when interfacing with a relatively stiff foam layer, reducing foot fatigue. The underlying, softer second foam layer compresses more readily to provide impact protection. The plate ensures responsiveness, decreasing the work required of the foot and ankle for forward propulsion when walking.

The plate may have a greater compressive stiffness than each of the first foam layer and the second foam layer and may be thinner than each of the first foam layer and the second foam layer where the first foam layer and the second foam layer interface with the plate. The relative stiffness of the plate enables it to enhance stability without unduly increasing the overall thickness (e.g., stack height) of the sole structure. A relatively low stack height further enhances stability by maintaining a low ratio of height to width, reducing the propensity of sideways tip.

Also disclosed herein is an article of footwear that includes a sole structure that has a plate, a first foam layer, and a second foam layer. The plate extends in a forefoot region, a midfoot region, and a heel region of the sole structure. The first foam layer overlies the plate and has a distal side interfacing with a proximal side of the plate in the forefoot region, the midfoot region, and the heel region. The second foam layer underlies the plate and has a proximal side interfacing with a distal side of the plate in the forefoot region, the midfoot region, and the heel region. A medial edge of the plate and a lateral edge of the plate extend transversely outward of the distal side of the first foam layer in each of the forefoot region, the midfoot region, and the heel region. The medial edge of the plate and the lateral edge of the plate also extend transversely outward of the proximal side of the second foam layer in each of the forefoot region, the midfoot region, and the heel region. In such a configuration, the plate, which may be relatively stiffer than the foam layers, enables load distribution over the full width of the underlying foam layer, providing greater stability than would a narrower plate.

In an aspect, each of the plate, the first foam layer, and the second foam layer may extend in the forefoot region, the midfoot region, and the heel region. A medial edge of the plate and a lateral edge of the plate may extend transversely outward of the distal side of the first foam layer in each of the forefoot region, the midfoot region, and the heel region as well as transversely outward of the proximal side of the second foam layer in each of the forefoot region, the midfoot region, and the heel region. The plate may be wider than each of the first and second foam layers where it interfaces with the first and second foam layers over the majority of its length in each of the forefoot region, the midfoot region, and the heel region.

The plate may include features that increase bending stiffness of the plate without unduly increasing the stack height of the sole structure and that ensure the relative positions of the foam layers with respect to the plate. In one or more embodiments, the proximal side of the plate may have a medial rail extending along the medial edge of the plate and a lateral rail extending along the lateral edge of the plate. The first foam layer may be nested between the proximal-side medial rail and the proximal-side lateral rail. Similarly, the distal side of the plate may have a medial rail extending along the medial edge of the plate and a lateral rail extending along the lateral edge of the plate, and the second foam layer may be nested between the distal-side medial rail and the distal-side lateral rail. The rails serve as locating features for proper assembly of the sole structure and ensure that the plate extends outward of the first and the second foam layers to optimize dispersion of loading forces. The first and second foam layers do not interface with one another along the length of the plate, although they may interface with one another forward and/or rearward of the plate as discussed herein. The full surface areas of the distal side of the first foam layer and the proximal side of the second foam layer between the forward edge of the plate and the rearward edge of the plate may interface with the plate so that loading and impact forces transmitted through the sole structure areas are dispersed by the plate.

The medial and lateral rails may be thicker than the portion of the plate extending between the rails. The thicker rails may increase the bending stiffness of the plate and limit twisting of the plate, further increasing stability. The width of the rails may be greater in the midfoot region than in the forefoot region, tapering in width in a forward direction. This may enable the forefoot region of the plate to have a lower bending stiffness than the midfoot region of the plate so that dorsiflexion is not unduly limited by the rails.

In some implementations, the distal side of the first foam layer and the proximal side of the second foam layer interface with one another in the forefoot region forward of a front edge of the plate. Moreover, the distal side of the first foam layer may have a downwardly-extending front ledge and a front edge of the plate may fit against the downwardly-extending front ledge. Similarly, the distal side of the first foam layer and the proximal side of the second foam layer may interface with one another in the heel region rearward of a rear edge of the plate. The distal side of the first foam layer may have a downwardly-extending rear ledge and the rear edge of the plate may fit against the downwardly-extending rear ledge. The interfitting front ledge and front edge and/or rear ledge and rear edge serves as locating features to ensure efficient and accurate assembly.

The article of footwear may include still other locating features. For example, the distal side of the plate may have a protrusion that extends in the midfoot region transversely inward of the medial edge of the plate and transversely inward of the lateral edge of the plate. The proximal side of the second foam layer may have a recess, and the protrusion may interfit with the recess. The relatively centrally-located protrusion thus helps fit the plate to the underlying second foam layer. In an implementation, the recess may be a through hole that extends from the proximal side of the second foam layer to the distal side of the second foam layer. In such an implementation, the distal side of the plate at the protrusion may be exposed at the through hole (e.g., when viewed from the distal side of the second foam layer).

Furthermore, the second foam layer may have features that assist with proper location of outsole components during assembly. For example, the article of footwear may include a front outsole component secured to the distal side of the second foam layer in the forefoot region. The distal side of the second foam layer may have a forward-facing lip extending from a medial side of the second foam layer to a lateral side of the second foam layer and forward of a front of the through hole. A rear edge of the front outsole component may interface with the forward-facing lip. Similarly, in the same or different embodiment, the article of footwear may include a rear outsole component secured to the distal side of the second foam layer in the heel region. The distal side of the second foam layer may have a rearward-facing lip extending from a medial side of the second foam layer to a lateral side of the second foam layer and rearward of a rear of the through hole. A front edge of the rear outsole component may interface with the rearward-facing lip. The forward-facing lip and the rearward-facing lip thus provide locating features at which the front and rear outsole components can be accurately placed at the distal side of the second foam layer.

The first foam layer may also enhance stability as a medial side wall of the first foam layer may extend partially upward along a medial side of the footwear upper that is secured to and overlies the first foam layer, and a lateral side wall of the first foam layer may extend partially upward along a lateral side of the footwear upper. The first foam layer thus extends partway upward along the footwear upper to cup the wearer's foot between the medial and lateral side walls.

In an example, an article of footwear disclosed herein includes a sole structure that has a forefoot region, a midfoot region, and a heel region and includes a plate, a first foam layer, and a second foam layer. The plate is disposed in the midfoot region and has a front edge and a rear edge. The front edge has a medial segment that includes a medial extremity of the front edge, a lateral segment that includes a lateral extremity of the front edge, and a middle segment extending from the medial segment to the lateral segment. The medial segment and the lateral segment extend further forward than the middle segment. The first foam layer overlies the plate and has a distal side interfacing with a proximal side of the plate. The second foam layer underlies the plate and has a proximal side interfacing with a distal side of the plate. The first foam layer and the second foam layer extend forward of the front edge of the plate and extend rearward of the rear edge of the plate.

By providing the plate with a front edge having the medial and lateral segments extending further forward than the middle segment, at least the middle segment of the plate may be absent from most or all of the forefoot region of the sole structure to attain flexibility in the forefoot region, for example, while still allowing the medial and lateral segments to extend far enough forward from the midfoot region of the sole structure to attain stability goals.

For example, a compressive stiffness of the first foam layer may be greater than a compressive stiffness of the second foam layer, and a compressive stiffness of the plate may be greater than the compressive stiffness of the first foam layer. The relatively stiff plate thus lends stability but decreases flexibility of the sole structure. However, due to the medial and lateral segments of the front edge extending further forward than the middle segment of the front edge, at least in some implementations, the plate does not extend continuously along a cross-section of the sole structure taken in a transverse direction of the sole structure in the forefoot region. Flexibility of the forefoot region, such as during dorsiflexion, is therefore not compromised by the presence of the plate, and stability at the medial and lateral sides of the sole structure is enhanced by the further forward medial and lateral segments of the front edge.

In one or more implementations, a forwardmost extent of the middle segment may be disposed in the midfoot region of the sole structure, for example, such that the entire forefoot region, or at least that portion of the forefoot region transversely inward of the medial and lateral segments of the front edge, is free from the plate.

In an aspect, a forwardmost extent of the medial segment may be the medial extremity of the front edge. Similarly, a forwardmost extent of the lateral segment may be the lateral extremity of the front edge. In some implementations, the front edge may recede rearward between the medial extremity of the front edge and a forwardmost extent of the middle segment. Similarly, the front edge may recede rearward between the lateral extremity of the front edge and a forwardmost extent of the middle segment.

In implementations in which the front edge recedes rearward between the medial extremity of the front edge and a forwardmost extent of the middle segment and the front edge recedes rearward between the lateral extremity of the front edge and the forwardmost extent of the middle segment such that the front edge defines a first indentation between the medial extremity of the front edge and the forwardmost extent of the middle segment and a second indentation between the lateral extremity of the front edge and the forwardmost extent of the middle segment, the front edge may jut forward to the forwardmost extent of the middle segment between the first indentation and the second indentation. Such a nonlinear front edge provides support under loading along the medial and lateral edges, helping to distribute such loads over a greater expanse of the plate and the second foam layer thereunder while not unduly limiting flexibility of the forefoot region of the sole structure during dorsiflexion and side-to-side movement.

Similarly, the rear edge of the plate may be nonlinear. For example, the rear edge may have a medial segment that includes a medial extremity of the rear edge, a lateral segment that includes a lateral extremity of the rear edge, and a middle segment extending from the medial segment of the rear edge to the lateral segment of the rear edge. The rear edge may extend forward between the medial extremity of the rear edge and a rearmost extent of the middle segment of the rear edge. In some implementations, the rear edge extends forward between the lateral extremity of the rear edge and a rearmost extent of the middle segment of the rear edge.

In an implementation in which the rear edge has a medial segment that includes a medial extremity of the rear edge, a lateral segment that includes a lateral extremity of the rear edge, and a middle segment extending from the medial segment of the rear edge to the lateral segment of the rear edge, the rear edge may extend forward between the medial extremity of the rear edge and a rearmost extent of the middle segment of the rear edge and between the lateral extremity of the rear edge and the rearmost extent of the middle segment of the rear edge such that the rear edge defines a first indentation between the medial extremity of the rear edge and the rearmost extent of the middle segment of the rear edge and a second indentation between the lateral extremity of the rear edge and the rearmost extent of the middle segment of the rear edge, and the rear edge juts rearward to the rearmost extent of the middle segment of the rear edge between the first indentation of the rear edge and the second indentation of the rear edge.

In an aspect, the plate may be wider in a transverse direction of the sole structure than the first foam layer and the second foam layer where the first foam layer and the second foam layer interface with the plate, and the plate may extend continuously from the front edge to the rear edge and from a medial edge of the plate to a lateral edge of the plate such that the distal side of the first foam layer interfaces with the proximal side of the second foam layer only forward of the front edge of the plate and only rearward of the rear edge of the plate. For example, in such a configuration, the plate enables load distribution over the full width of the underlying second foam layer, providing greater stability than would a narrower plate.

In an implementation of a relatively wide plate, a medial edge of the plate and a lateral edge of the plate extend transversely outward of the distal side of the first foam layer in at least the midfoot region, and the medial edge of the plate and the lateral edge of the plate extend transversely outward of the proximal side of the second foam layer in at least the midfoot region.

The full surface areas of the distal side of the first foam layer and the proximal side of the second foam layer between the forward edge of the plate and the rearward edge of the plate may interface with the plate so that loading and impact forces transmitted through the sole structure areas are dispersed by the plate.

In one or more implementations, the proximal side of the plate may be nonplanar and may include a trough extending longitudinally along a longitudinal midline of the plate. The nonplanar proximal side with the longitudinally-extending trough may affect the bending stiffness of the plate. For example, the trough may function as a slight corrugation of the plate, such as a longitudinal rib, further increasing its bending stiffness in the longitudinal direction relative to a flat plate.

In an example of an article of footwear disclosed herein, the article of footwear includes a sole structure having a forefoot region, a midfoot region, and a heel region. The sole structure includes a plate extending in the midfoot region and having a front medial arm, a front lateral arm, a nonlinear front edge, and a rear edge. The front medial arm extends from the midfoot region into the forefoot region and defines a medial edge of the plate. The front lateral arm extends from the midfoot region into the forefoot region and defines a lateral edge of the plate. The nonlinear front edge extends between the front medial arm and the front lateral arm and extends further rearward than both a foremost extremity of the front medial arm and a foremost extremity of the front lateral arm. The sole structure further includes a first foam layer and a second foam layer. The first foam layer overlies the plate and has a distal side interfacing with a proximal side of the plate from the nonlinear front edge to the rear edge. The second foam layer underlies the plate and has a proximal side interfacing with a distal side of the plate from the nonlinear front edge to the rear edge. The first foam layer and the second foam layer extend further forward than the front edge of the plate and extend further rearward than the rear edge of the plate.

In an aspect, the nonlinear front edge has a medial segment that defines an inner extent of the front medial arm, a lateral segment that defines an inner extent of the front lateral arm, and a middle segment extending from the medial segment to the lateral segment. The nonlinear front edge juts forward at the middle segment to a forwardmost extent of the middle segment that is rearward of the foremost extremity of the front medial arm and is rearward of the foremost extremity of the front lateral arm.

In one or more implementations, the plate may also have a rear medial arm extending rearward in the heel region and further defining the medial edge of the plate, and a rear lateral arm extending rearward in the heel region and further defining the lateral edge of the plate. The rear edge may extend nonlinearly from the rear medial arm to the rear lateral arm.

In an aspect, the rear edge may have a medial segment that defines an inner extent of the rear medial arm, a lateral segment that defines an inner extent of the rear lateral arm, and a middle segment extending from the medial segment of the rear edge to the lateral segment of the rear edge. The rear edge may jut rearward at the middle segment of the rear edge to a rearmost extent of the middle segment of the rear edge that is not rearward of a rearmost extremity of the rear medial arm and/or is not rearward of a rearmost extremity of the rear lateral arm.

The above features and advantages and other features and advantages of the present teachings are readily apparent from the following detailed description of the modes for carrying out the present teachings when taken in connection with the accompanying drawings.

FIG. 1 is a lateral side view of an article of footwear 10 including an upper 12 and a sole structure 14. FIG. 2 is a medial side view of the article of footwear 10. As described herein, the sole structure 14 includes features that enhance stability of the article of footwear 10 while also providing cushioning and comfort. Although not limited to such use, the features of the sole structure 14 described herein make the article of footwear 10 especially useful for wear during pregnancy.

As shown, the upper 12 is secured to the sole structure 14 to define a foot-receiving cavity 15 in which a foot may be received through an ankle opening 17 (see FIG. 1) of the upper 12 and supported on the sole structure 14. The upper 12 is shown as a slip-on upper. However, the upper 12 is merely exemplary, and other configurations of uppers may be used within the scope of the disclosure, such as uppers with laces or other fastening systems, uppers configured as a sock or a bootie, uppers with a "high top" configuration that have an ankle portion extending higher on the leg of the wearer, etc.

Figure 4:
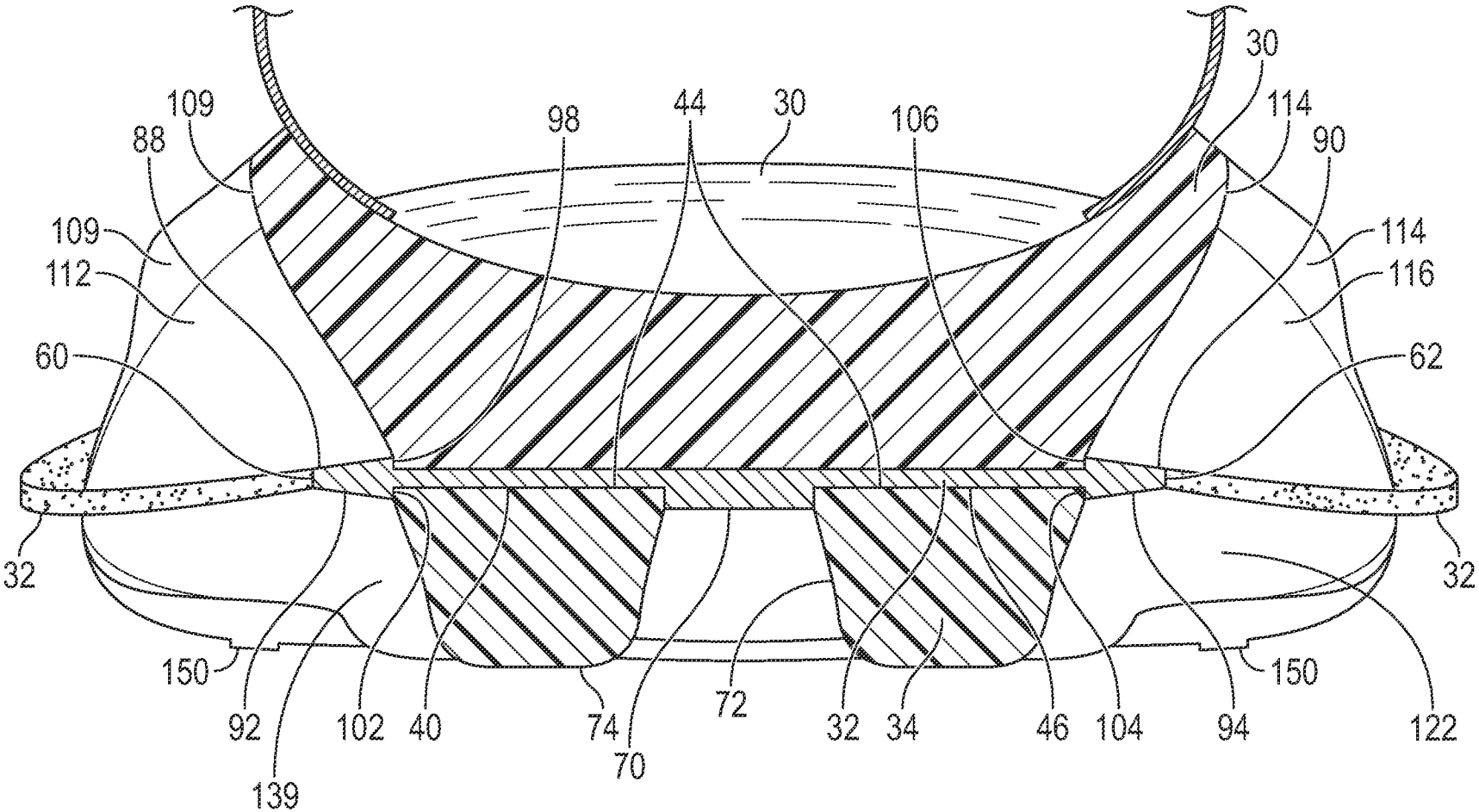
FIG. 4 is a cross-sectional view of the article of footwear of FIG. 1 taken at lines 4-4 in FIG. 1.

The upper 12 may be a variety of materials, such as leather, textiles, polymers, cotton, foam, composites, etc., or combinations of these. For example, the upper 12 may be a polymeric material capable of providing elasticity, and may be of a braided construction, a knitted (e.g., warp-knitted) construction, or a woven construction. A lower extent of the upper 12 is secured to a periphery of the sole structure 14 as shown in FIG. 4.

The article of footwear 10 as well as the upper 12 and the sole structure 14 may be divided into a forefoot region 16, a midfoot region 18, and a heel region 20. The forefoot region 16 generally includes portions of the article of footwear 10 corresponding with the toes and the metatarsophalangeal joints (which may be referred to as MPT or MPJ joints) connecting the metatarsal bones of the foot and the proximal phalanges of the toes. The midfoot region 18 generally includes portions of the article of footwear 10 corresponding with the arch area and instep of the foot, and the heel region 20 corresponds with rear portions of the foot, including the calcaneus bone. The forefoot region 16, the midfoot region 18, and the heel region 20 are not intended to demarcate precise areas of the article of footwear 10 but are instead intended to represent general areas of the article of footwear 10 to aid in the following discussion.

The article of footwear 10 has a lateral side 22 and a medial side 24, indicated in FIGS. 1 and 2, respectively. The lateral side 22 and the medial side 24 extend through each of the forefoot region 16, the midfoot region 18, and the heel region 20, and correspond with opposite sides of the article of footwear 10, each falling on an opposite side of a longitudinal midline (LM) of the article of footwear 10, indicated in FIG. 3. The lateral side 22 is thus considered to be opposite from the medial side 24. The article of footwear 10 as shown is configured for a right foot. An article of footwear configured for a left foot may be a mirror image of the article of footwear 10.

In order from the top (i.e., the proximal side) of the sole structure 14 to the bottom (i.e., the distal side), the sole structure 14 includes a first foam layer 30, a plate 32, a second foam layer 34, a front outsole component 36, and a rear outsole component 38, each of which are discussed further herein. The components of the sole structure 14 function as a system having various beneficial properties discussed herein.

Each of the plate 32, the first foam layer 30, and the second foam layer 34 extend in the forefoot region 16, the midfoot region 18, and the heel region 20. The first foam layer 30 overlies the plate 32 and has a distal side 40 interfacing with a proximal side 42 of the plate 32 in the forefoot region 16, the midfoot region 18, and the heel region 20. The second foam layer 34 underlies the plate 32 and has a proximal side 44 interfacing with a distal side 46 of the plate 32 in the forefoot region 16, the midfoot region 18, and the heel region 20. The plate 32 is secured to the first foam layer 30 and to the second foam layer 34 such as by thermal bonding and/or with adhesive, or otherwise.

Although the plate 32 extends in the forefoot 16, midfoot 18, and heel regions 20, it does not extend to the foremost extent 48 of the sole structure 14 nor does it extend to the rearmost extent 50 of the sole structure 14. The first foam layer 30 and the second foam layer 34 extend further forward and further rearward than the plate 32. The distal side 40 of the first foam layer 30 and the proximal side 44 of the second foam layer 34 interface with one another in the forefoot region 16 forward of a front edge 86 of the plate 32. Similarly, the distal side 40 of the first foam layer 30 and the proximal side 44 of the second foam layer 34 interface with one another in the heel region 20 rearward of a rear edge 84 of the plate 32. This is indicated in FIGS. 1 and 2 and may be best seen in FIG. 5. The first foam layer 30 is secured to the second foam layer 34 forward and rearward of the plate 32 such as by thermal bonding and/or with adhesive, or otherwise.

Figure 3:
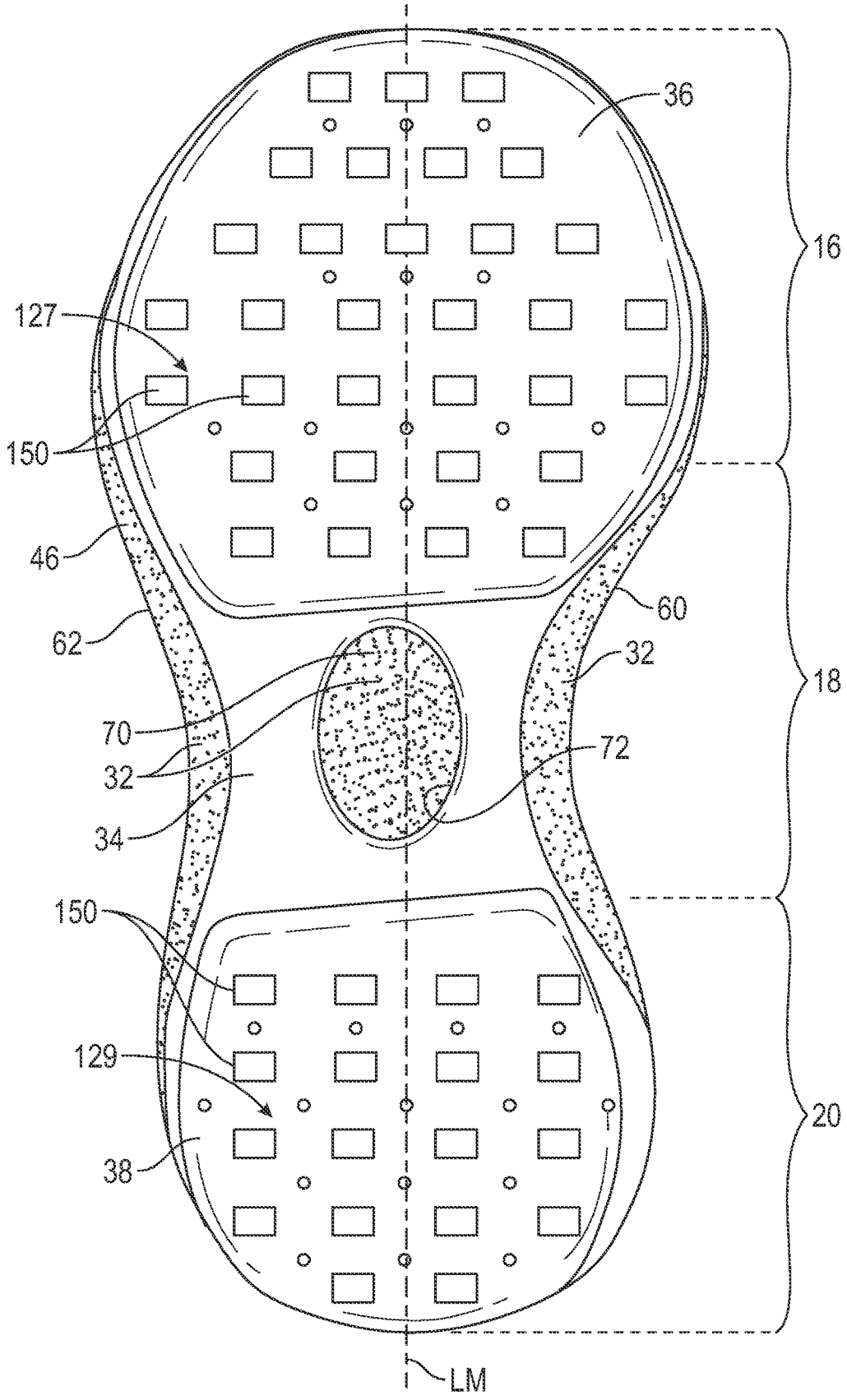
FIG. 3 is a bottom view of the article of footwear of FIG. 1.
Figure 10:
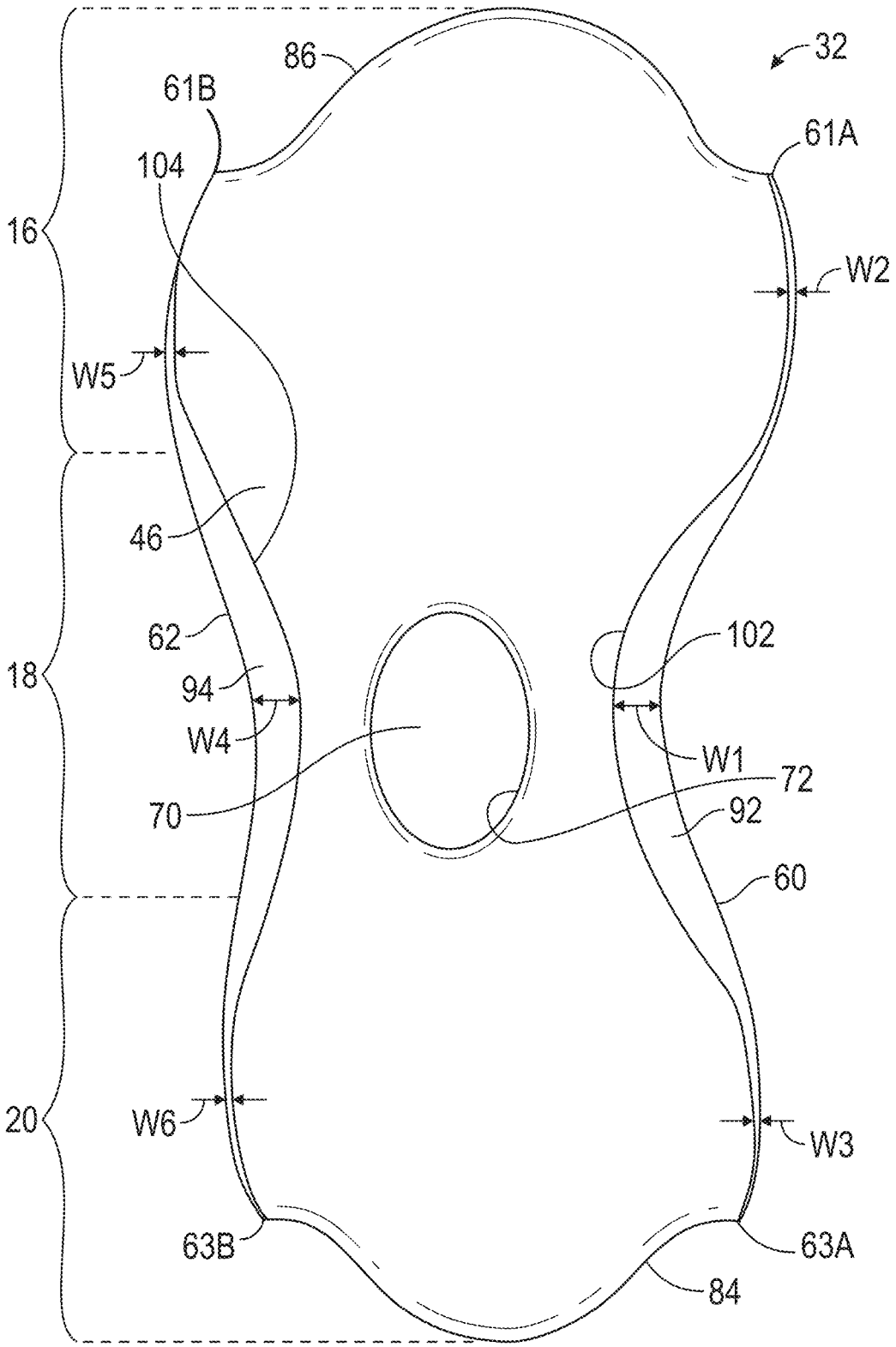
FIG. 10 is a bottom view of the plate of FIG. 8.

Referring to FIGS. 3 and 4, a medial edge 60 of the plate 32 and a lateral edge 62 of the plate 32 extend transversely outward of the distal side 40 of the first foam layer 30 in each of the forefoot region 16, the midfoot region 18, and the heel region 20, as well as transversely outward of the proximal side 44 of the second foam layer 34 in each of the forefoot region 16, the midfoot region 18, and the heel region 20. In fact, the plate 32 is wider than each of the first and second foam layers 30, 34 where it interfaces with the first and second foam layers 30, 34 over the majority of its length in each of the forefoot region 16, the midfoot region 18, and the heel region 20. As best shown in FIG. 10, the front edge 86 intersects the medial edge 60 at a medial pointed corner 61A and the front edge 86 intersects the lateral edge 62 at a lateral pointed corner 61B. Similarly, the rear edge 84 intersects the medial edge 60 at another medial pointed corner 63A and the rear edge 84 intersects the lateral edge 62 at another lateral pointed corner 63B.

The first and second foam layers 30, 34 may be at least partially a polyurethane foam, or a polyurethane ethylene-vinyl acetate (EVA) foam and may include heat-expanded and molded EVA foam pellets. The first and second foam layers 30, 34 may generally include phylon (ethylene vinyl acetate or "EVA") and/or polyurethane ("PU") base resins. For example, in one embodiment, the first and second foam layers 30, 34 may be a compression molded phylon. If EVA is used, it may have a vinyl acetate (VA) level between approximately 9% and approximately 40%. Suitable EVA resins include Elvax®, provided by E. I. du Pont de Nemours and Company, and Engage™, provided by the Dow Chemical Company, for example. In certain embodiments, the EVA may be formed of a combination of high melt index and low melt index material. For example, the EVA may have a melt index of from about 1 to about 50. The EVA resin may be compounded to include various components including a blowing agent and a curing/crosslinking agent. The blowing agent may have a percent weight between approximately 10% and approximately 20%. The blowing agent may be thermally decomposable and is selected from ordinary organic and inorganic chemical blowing agents. The nature of the blowing agent is not particularly limited as long as it decomposes under the temperature conditions used in incorporating the foam into the virgin resin. Suitable blowing agents include azodicarboamide, for example. In certain embodiments, a peroxide-based curing agent, such as dicumyl peroxide may be used. The amount of curing agent may be between approximately 0.6% and approximately 1.5%. The EVA may also include homogenizing agents, process aids, and waxes. For example, a mixture of light aliphatic hydrocarbons such as Struktol® 60NS, available from Schill+Seilacher "Struktol" GmbH, may be included to permit other materials or scrap EVA to be more easily incorporated into the resin. The EVA may also include other constituents such as a release agent (e.g., stearic acid), activators (e.g., zinc oxide), fillers (e.g., magnesium carbonate), pigments, and clays. In embodiments that incorporate multiple materials, each material may be formed from a material that is compatible and readily bonds with the other material. For example, the materials may each be formed from an EVA resin with suitable blowing agents, crosslinking agents, and other ancillary components, pigments, fillers, and the like. Other suitable materials will become readily apparent to those skilled in the art, given the benefit of this disclosure.

The plate 32 may be but is not limited to a thermoplastic polyurethane. In an example, the plate 32 may be a polyether block amide PEBAX®, available from Arkema, Inc. in King of Prussia, Pennsylvania USA. The plate 32 may have a greater compressive stiffness as well as a greater bending stiffness than each of the first foam layer 30 and the second foam layer 34 and may be thinner than each of the first foam layer 30 and the second foam layer 34 where the first foam layer and the second foam layer interface with the plate 32, as is evident in FIGS. 1, 2, 4, and 5. The relative stiffness of the plate 32 enables it to enhance stability without unduly increasing the overall thickness (e.g., stack height) of the sole structure 14. A relatively low stack height further enhances stability by maintaining a low ratio of height to width, reducing the propensity of sideways tip.

In such a configuration, the plate 32, which may be relatively stiffer (in compression and/or bending) than the foam layers 30, 34, enables load distribution over the full width of the underlying second foam layer 34, providing greater stability than would a narrower plate 32. The plate 32 thus distributes weight over full width of the underlying second foam layer 34 to increase stability.

In some implementations, a compressive stiffness of the first foam layer 30 may be greater than a compressive stiffness of the second foam layer 34.

Additionally, or alternatively, a bending stiffness of the first foam layer 30 may be greater than a bending stiffness of the second foam layer 34. A compressive stiffness of the plate 32 may be greater than the compressive stiffness of the first foam layer 30 and greater than a compressive stiffness of the second foam layer 34. Additionally, or alternatively, a bending stiffness of the plate 32 may be greater than a bending stiffness of the first foam layer 30 and greater than a bending stiffness of the second foam layer 34.

Stated differently, the plate 32 is the stiffest component both in compression and in bending, while the overlying first foam layer 30 closest to the foot of the wearer is stiffer than the underlying second foam layer 34 that is further from the foot and closer to the ground during wear when a wearer is standing. The first foam layer 30 is relatively stiff in comparison to the second foam layer 34 to maximize the ability of the plate 32 to spread pressure over the entire width of the foot. The relatively less stiff second foam layer 34 dampens impact loads and vibrations below the plate 32 to maintain the even spread of pressure at the foot.

In one non-limiting example, the plate 32 may be at least 50 percent stiffer than the first foam layer 30, and the first foam layer 30 may be at least 20 percent stiffer than the second foam layer 34.

Because the overlying, first foam layer 30 is stiffer than the underlying, second foam layer 34, it avoids localized compression to act in concert with the plate 32 to distribute loading, while still providing sufficient comfort. The muscles in the feet may need to work less when interfacing with a relatively stiff foam layer, reducing foot fatigue. The underlying second foam layer 34 compresses more readily to provide impact protection. The plate 32 ensures responsiveness, decreasing the work required of the foot and ankle for forward propulsion when walking.

FIG. 3 also shows that the distal side 46 of the plate 32 has a protrusion 70 that extends in the midfoot region 18 transversely inward of the medial edge 60 of the plate 32 and transversely inward of the lateral edge 62 of the plate 32. The proximal side 44 of the second foam layer 34 has a recess 72, and the protrusion 70 interfits with the recess 72. The relatively centrally-located protrusion 70 thus helps fit the plate 32 to the underlying second foam layer 34. In an implementation, the recess 72 is a through hole that extends from the proximal side 44 of the second foam layer 34 to the distal side 74 of the second foam layer 34 and may be referred to herein as a through hole 72. In such an implementation, the distal side 46 of the plate 32 at the protrusion 70 may be exposed at the through hole (e.g., when viewed from the distal side 74 of the second foam layer 34).

Although the protrusion 70 and the through hole 72 are shown as relatively oval, they may have other shapes such as circular, square, rectangular, or other polygonal shapes. In an embodiment, a protrusion and a through hole that interfits with the protrusion may have rounded front and rear ends like the protrusion 70 and the through hole 72 and may be narrowed in a midportion between the front and rear ends. For example, the protrusion and the through hole may each resemble an elongated oval that is narrowed in a transverse direction of the sole structure 14 at its midsection. In such an embodiment, a periphery of the protrusion and a perimeter of the through hole may resemble an elongated eight-shape.

Figure 6:
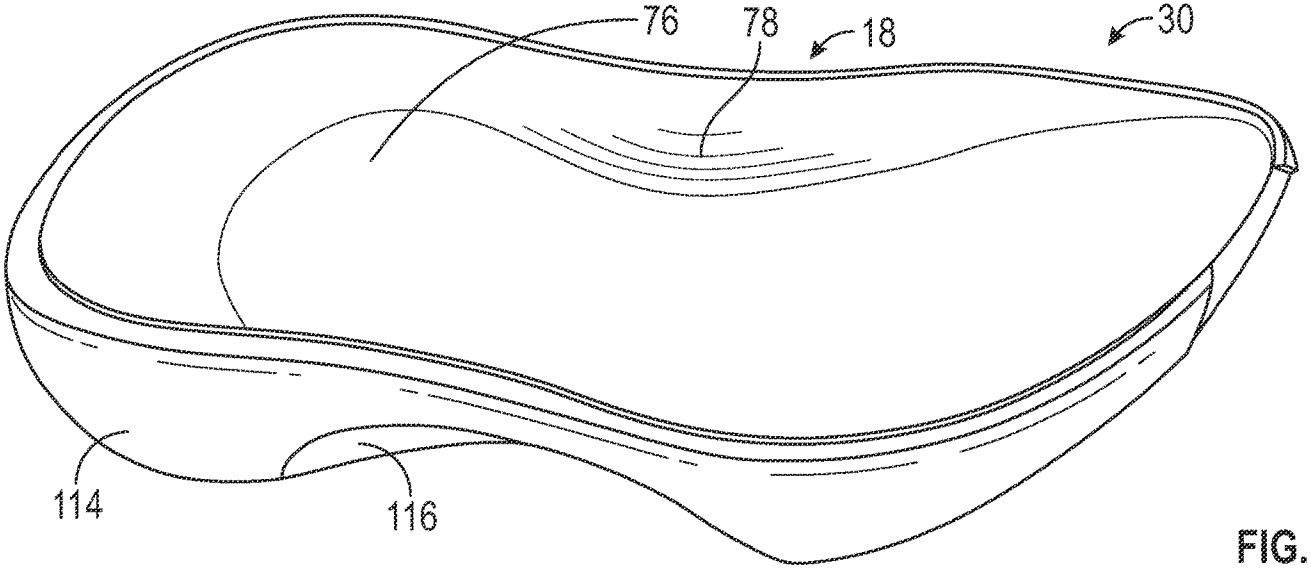
FIG. 6 is a perspective view of a first foam layer of the article of footwear of FIG. 1.

FIG. 6 shows that the first foam layer 30 has a proximal side 76 that is generally concave at and configured to cup the lower side of the foot, providing support to the arch at an inner medial side wall 78 in the midfoot region 18. The first foam layer 30 may also enhance stability as a medial side wall 109 of the first foam layer 30 extends partially upward along the medial side 24 of the footwear upper 12 that is secured to the first foam layer 30. A lateral side wall 114 of the first foam layer 30 extends partially upward along the lateral side 22 of the footwear upper 12. The first foam layer 30 thus extends partway upward along the footwear upper 12 to cup the wearer's foot between the medial and lateral side walls 109, 114.

Figure 5:
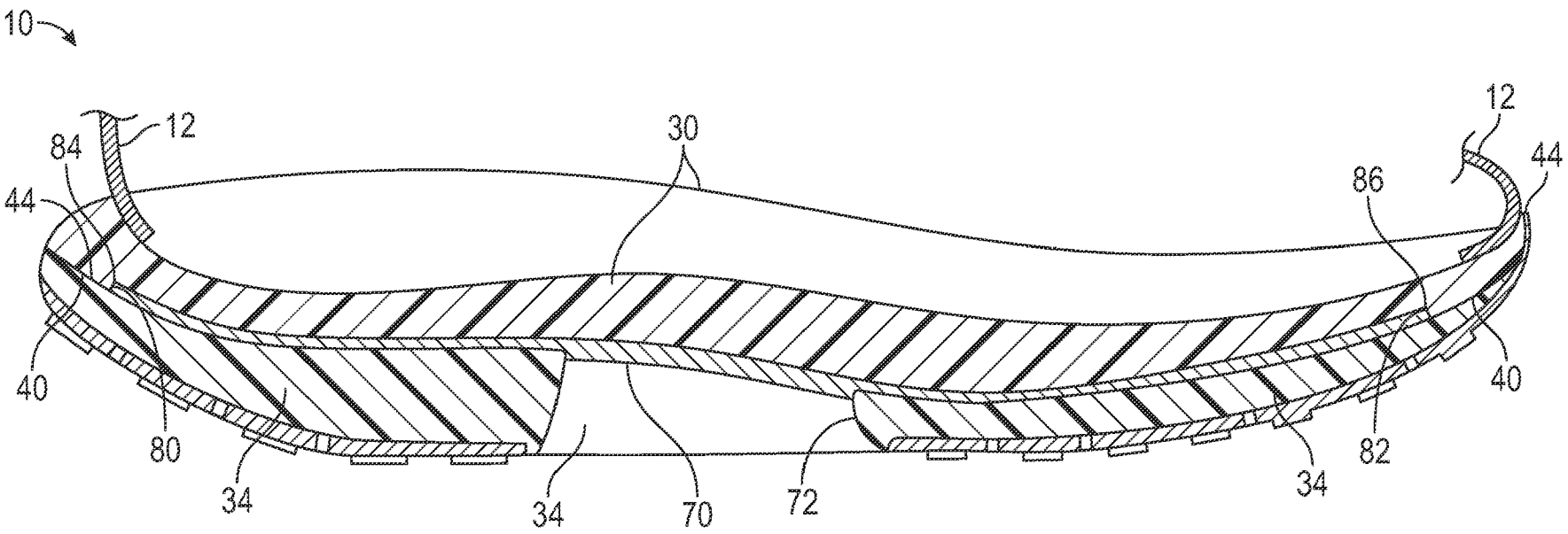
FIG. 5 is a cross-sectional view of the article of footwear of FIG. 1 taken at lines 5-5 in FIG. 1.
Figure 7:
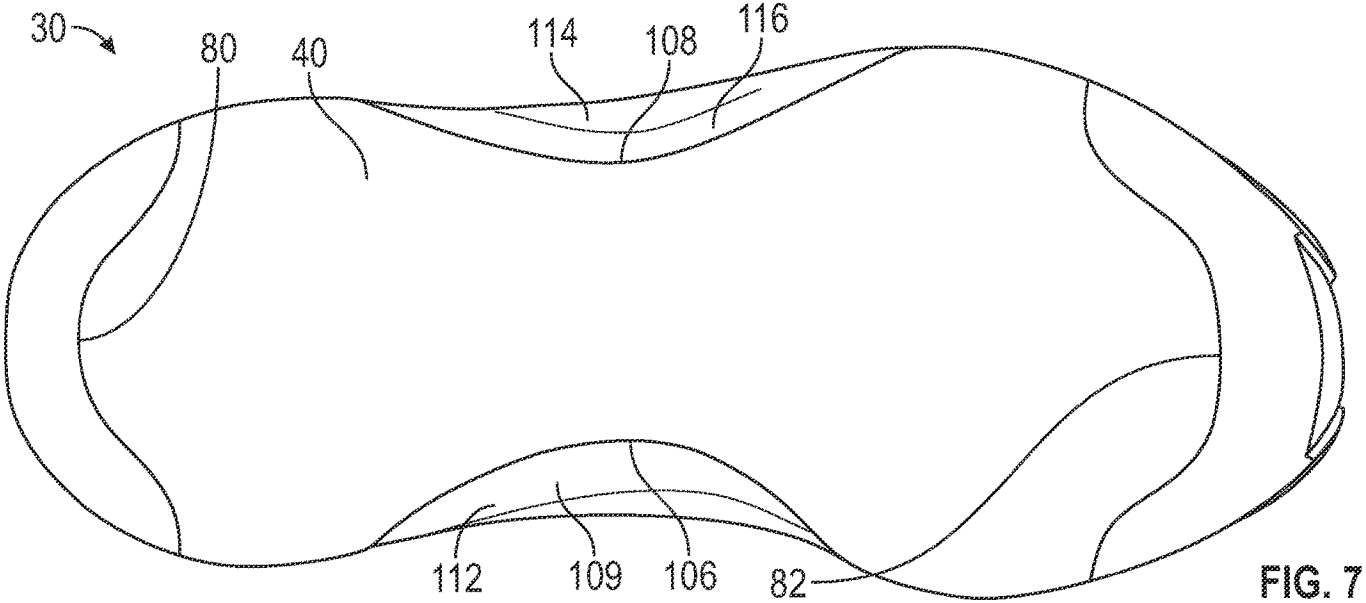
FIG. 7 is a bottom view of the first foam layer of FIG. 6.
Figure 8:
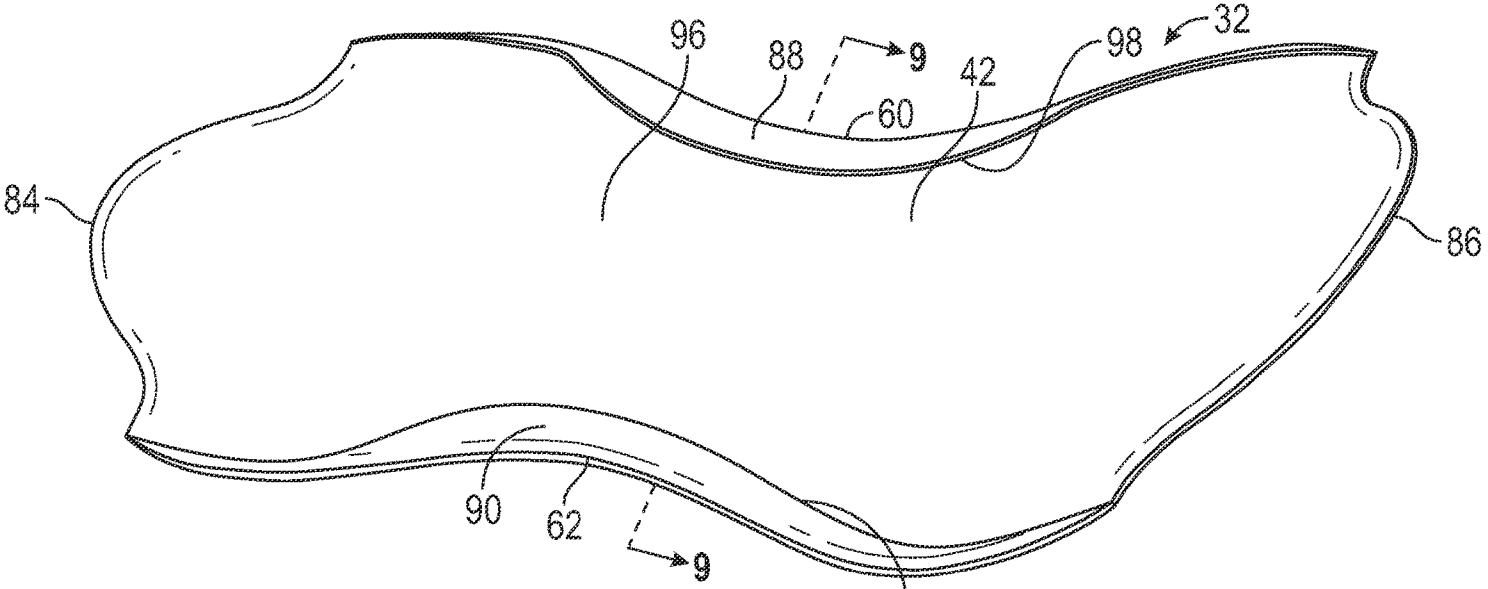
FIG. 8 is a perspective view of a plate of the article of footwear of FIG. 1.

The first foam layer 30 and the plate 32 also have interfitting features in the fore-aft direction. With reference to FIG. 7, the distal side 40 of the first foam layer 30 is shown as having a downwardly-extending rear ledge 80 and a downwardly-extending front ledge 82. As shown in FIG. 5, a rear edge 84 of the plate 32 fits against the downwardly-extending rear ledge 80, and a front edge 86 of the plate 32 fits against the downwardly-extending front ledge 82. As best shown in FIG. 8, the front edge 86 of the plate 32 is contoured to match the contour of the front ledge 82 shown in FIG. 7, and the rear edge 84 of the plate 32 is contoured to match the contour of the rear ledge 80 in FIG. 7. The interfitting front ledge 82 and front edge 86 and the interfitting rear ledge 80 and rear edge 84 serve as locating features to ensure efficient and accurate assembly of the first foam layer 30 and the plate 32.

Figure 9:
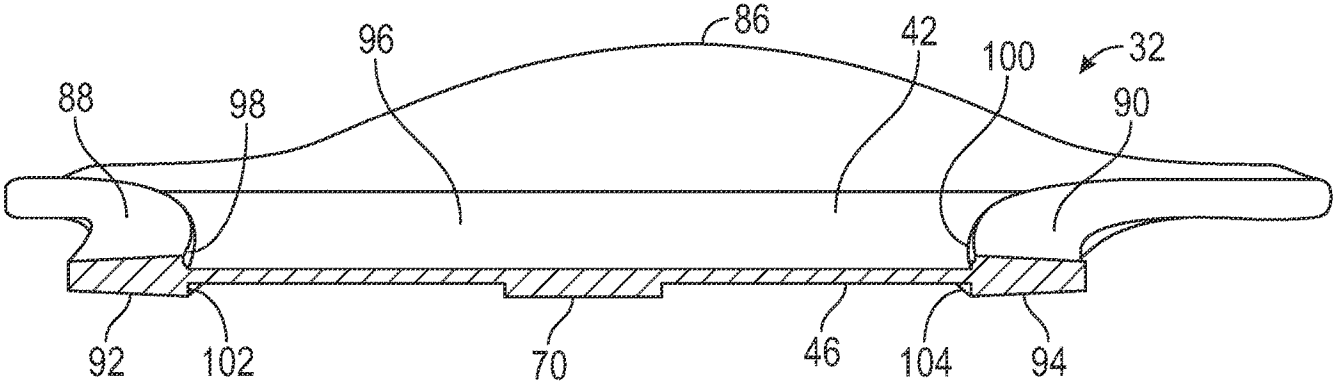

With continued reference to FIG. 8, the proximal side 42 of the plate 32 has a medial rail 88 extending along the medial edge 60 of the plate 32 and a lateral rail 90 extending along the lateral edge 62 of the plate 32. The medial rail 88 may be referred to as a proximal medial rail 88 and the lateral rail 90 may be referred to as a proximal lateral rail 90. Similarly, as shown in FIGS. 9 and 10, the distal side 46 of the plate 32 has a medial rail 92 extending along the medial edge 60 of the plate 32 and a lateral rail 94 extending along the lateral edge 62 of the plate 32. The medial rail 92 may be referred to as a distal medial rail 92 and the lateral rail 94 may be referred to as a distal lateral rail 94. The central portion 96 of the plate 32 spans between and is integral with the medial rail 88 and the lateral rail 90 as well as between the medial rail 92 and the lateral rail 94.

The width of the rails 88, 90, 92, and 94 is greater in the midfoot region 18 than in the forefoot region 16, tapering in width in a forward direction, as shown in FIGS. 8 and 10. FIG. 10 shows the medial rail 92 has a width W1 at a location in the midfoot region 18, tapers to a width W2 at a location in the forefoot region 16, and tapers to a width W3 at a location in the heel region 20. Similarly, the lateral rail 94 has a width W4 at a location in the midfoot region 18, tapers to a width W5 at a location in the forefoot region 16, and tapers to a width W6 at a location in the heel region 20. This may enable the forefoot region 16 of the plate to have a lower bending stiffness than the midfoot region 18 so that dorsiflexion is not unduly limited by the rails.

As best shown in FIG. 9, the proximal medial rail 88 directly overlies and is integral with the distal medial rail 92. The proximal lateral rail 90 directly overlies and is integral with the distal lateral rail 94. The thickness of the central portion 96 of the plate 32 is less than the thickness of the plate 32 anywhere along the medial rails 88, 92 or the lateral rails 90, 94 except that thickness of the plate 32 at the protrusion 70 may be less than, greater than, or equal to the thickness of the plate 32 at the medial rails 88, 92 or at the lateral rails 90, 94. The thicker rails 88, 92 and 90, 94 may increase the bending stiffness of the plate 32 and limit twisting of the plate 32, further increasing stability.

Figure 11:
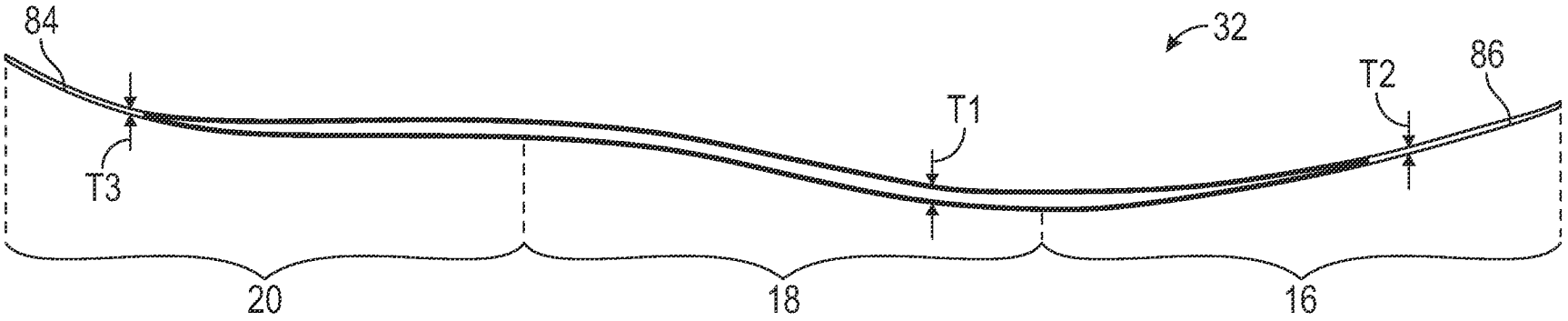
FIG. 11 is a lateral side view of the plate of FIG. 8.
Figure 12:
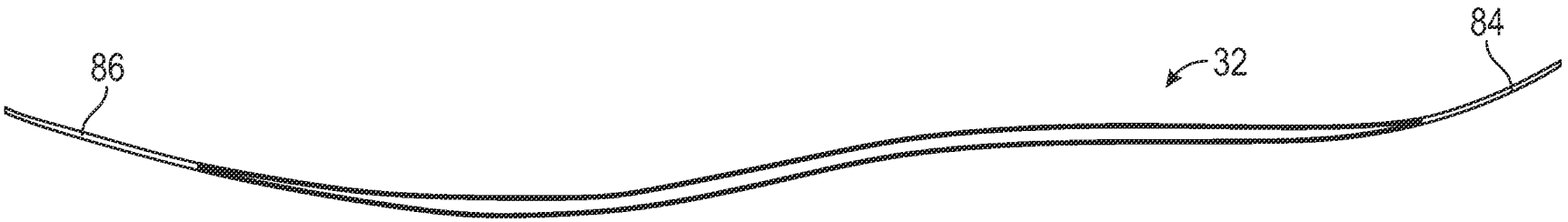
FIG. 12 is a medial side view of the plate of FIG. 8.
Figure 13:
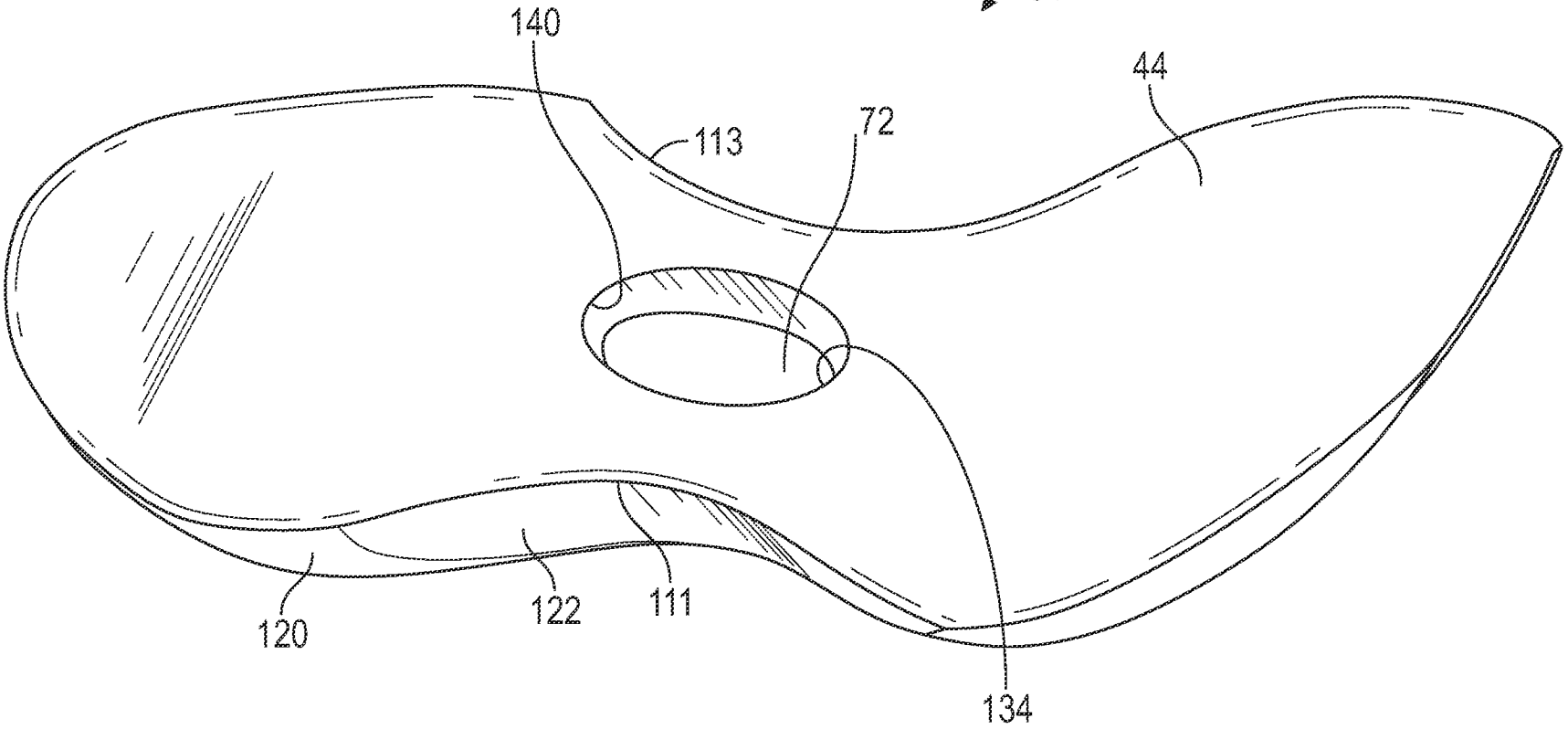
FIG. 13 is a perspective view of a second foam layer of the article of footwear of FIG. 1.

FIGS. 11 and 12 show that the rails taper in thickness in a forward direction and in a rearward direction from the midfoot region 18 so that they are thickest in the midfoot region 18. FIG. 11 shows the plate has a thickness T1 at a location in the midfoot region 18, tapers to a lesser thickness T2 in the forefoot region 16, and tapers to a lesser thickness T23 in the heel region 20. The plate 32 is also shown in FIGS. 11 and 12 to have a concavity on the proximal side in the forefoot region creating a spoon shape.

Because the rails 88, 92, 90, and 94 are thicker than the central portion 96 at least where the central portion 96 borders the rails, the plate 32 has a medial lip 98 running along an inner edge of the medial rail 88 and a lateral lip 100 running along an inner edge of the lateral rail 90 on the proximal side 42, and a medial lip 102 running along an inner edge of the medial rail 92 and a lateral lip 104 running along an inner edge of the lateral rail 94 on the distal side 46.

Referring again to FIG. 7, the distal side 40 of the first foam layer 30 has a medial edge 106 and a lateral edge 108. The medial side wall 109 of the first foam layer 30 has a medial side recess 112 extending downward and inward in the midfoot region 18 so that the medial edge 106 curves inward in the midfoot region 18. The lateral side wall 114 of the first foam layer 30 has a lateral side recess 116 extending downward and inward in the midfoot region 18 so that the lateral edge 108 curves inward in the midfoot region 18. The recesses 112, 116 are shown in FIG. 7 and as well as FIGS. 1, 2, and 4. Similarly, the medial side wall 118 of the second foam layer 34 has a medial side recess 139 extending inward in the midfoot region 18. The lateral side wall 120 of the second foam layer 34 has a lateral side recess 122 extending inward in the midfoot region 18.

The first foam layer 30 nests between the lips 98, 100 of the medial rail 88 and the lateral rail 90. The second foam layer 34 nests between the lips 102, 104 of the medial rail 92 and the lateral rail 94. More specifically, the lip 98 of the rail 88 follows the contour of the medial edge 106 of the first foam layer 30 at the distal side 40 and the lip 100 of the rail 90 follows the contour of the lateral edge 108 of the first foam layer 30 at the distal side 40. Similarly, the lip 102 of the rail 92 follows the contour of the medial edge 113 of the second foam layer 34 at the proximal side 44 and the lip 104 of the rail 94 follows the contour of the lateral edge 111 of the second foam layer 34 at the proximal side 44.

The rails 88, 92, and 90, 94 thus serve as locating features for proper assembly of the sole structure 14 and ensure that the plate 32 extends outward of the first and the second foam layers 30, 34 to optimize dispersion of loading forces. Because the plate 32 extends further outward in the transverse direction than both the distal side 40 of the first foam layer 30 and the proximal side 44 of the second foam layer 34 along the entire length of the plate 32 where it interfaces with the distal side 40 and the proximal side 44, the first and second foam layers 30, 34 do not interface with one another along the length of the plate 32, although they interface with one another forward and/or rearward of the plate as discussed herein. The full surface area of the distal side 40 of the first foam layer 30 and the proximal side 44 of the second foam layer 34 between the front edge 86 of the plate 32 and the rear edge 84 of the plate 32 interfaces with the plate 32 so that loading and impact forces transmitted through the sole structure 14 to either of these surfaces areas are dispersed by the plate 32.

Figure 14:
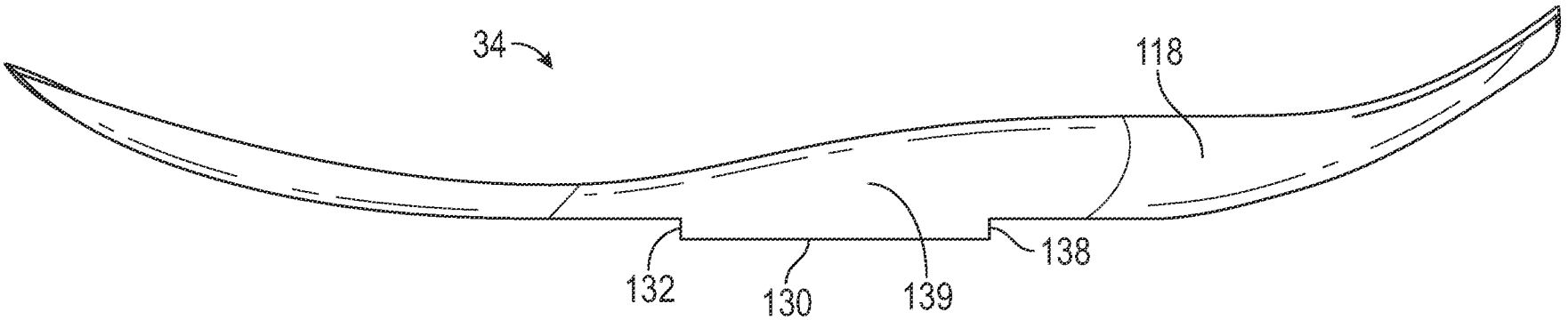
FIG. 14 is a medial side view of the second foam layer of FIG. 13.
Figure 15:
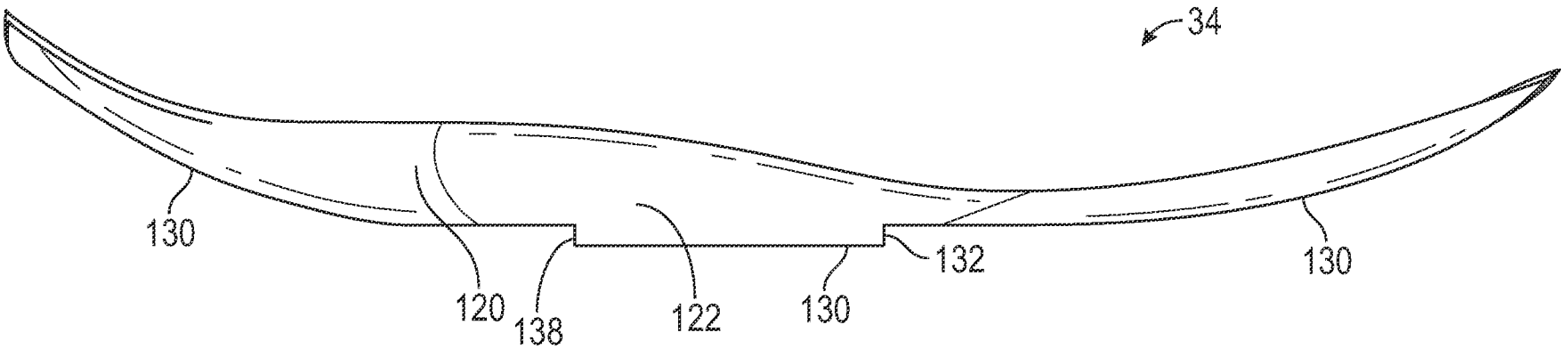
FIG. 15 is a lateral side view of the second foam layer of FIG. 13.
Figure 16:
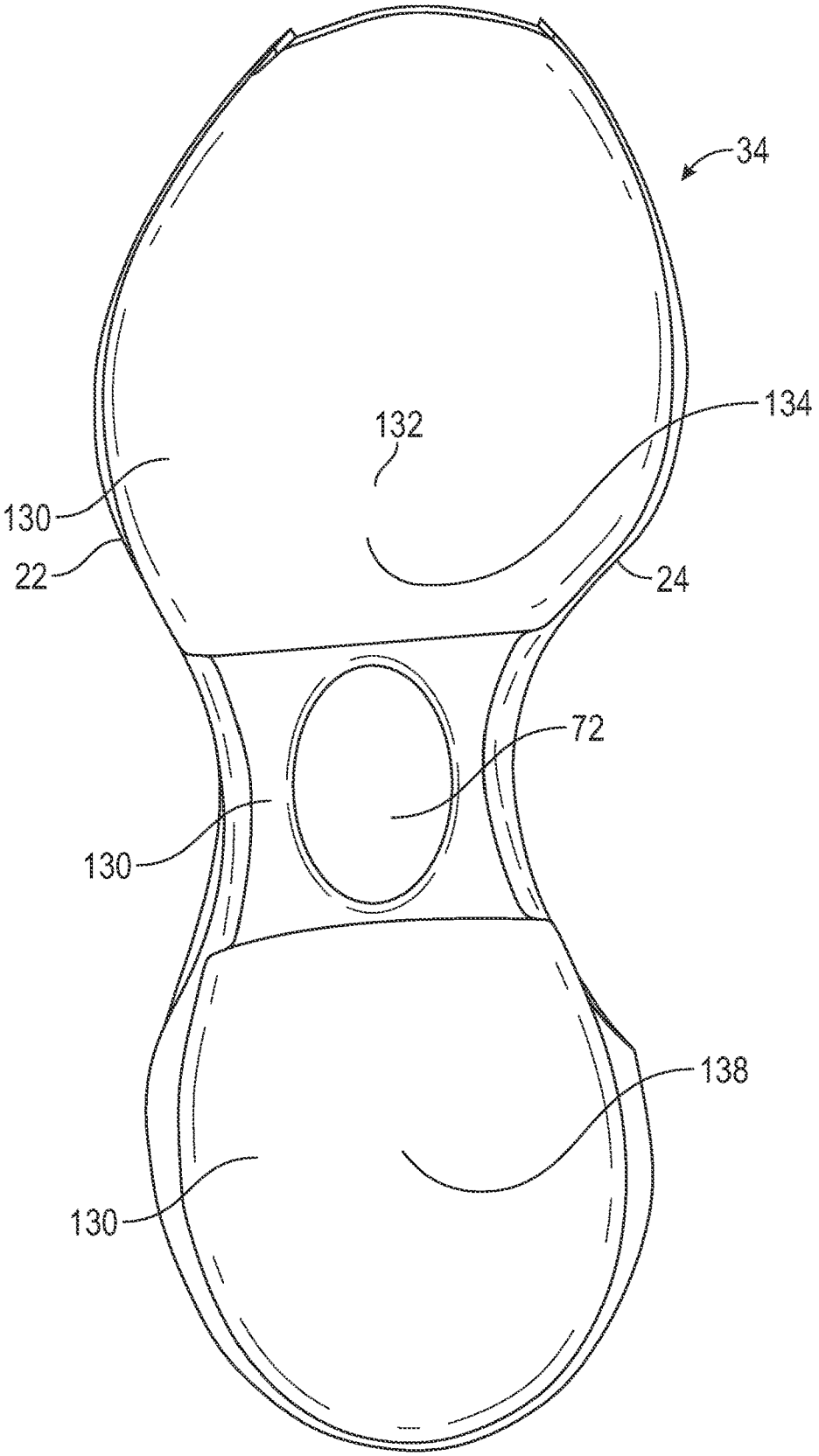
FIG. 16 is a bottom view of the second foam layer of FIG. 13.

Furthermore, in addition to the through hole 72 that helps to locate the plate 32, the second foam layer 34 has features that assist with proper location of front and rear outsole components 36, 38 during assembly. For example, the distal side 130 of the second foam layer 34 has a forward-facing lip 132 extending from the medial side 24 of the second foam layer 34 to the lateral side 22 of the second foam layer 34 and forward of a front 134 of the through hole 72, as shown in FIGS. 14-16. A rear edge 136 of the front outsole component 36 interfaces with the forward-facing lip 132. The rear edge 136 is straight or has a contour that follows the forward-facing lip 132 so that the rear edge 136 may abut the forward-facing lip 132 when the front outsole component 36 is secured to the distal side 130 by adhesive or otherwise. The lips 132 and 138 are generally straight in a transverse direction adjacent to the recess 72 in the embodiment shown. In an alternative embodiment, the lips could track the shape of the front and the rear of the recess 72.

Similarly, the distal side 130 of the second foam layer 34 has a rearward-facing lip 138 extending from the medial side 24 of the second foam layer 34 to the lateral side 22 of the second foam layer 34 and rearward of a rear 140 of the through hole 72. A front edge 142 of the rear outsole component 38 interfaces with the rearward-facing lip 138. For example, the front edge 142 is straight or has a contour that follows the rearward-facing lip 138 so that the front edge 142 may abut the rearward-facing lip 138 when the rear outsole component 38 is secured to the distal side 130 by adhesive or otherwise. The forward-facing lip 132 and the rearward-facing lip 138 thus provide locating features at which the front and rear outsole components 36, 38 can be accurately placed at the distal side 130 of the second foam layer 34.

As shown in FIG. 1, the front outsole component 36 is secured to the distal side 130 of the second foam layer 34 in the forefoot region 16 to establish a portion of a ground-engaging surface 127 of the sole structure 14. The rear outsole component 38 is secured to the distal side 130 of the second foam layer 34 in the heel region 20 to establish another portion of a ground-engaging surface 129 of the sole structure 14. The front and rear outsole components 36, 38 are separate components in that they are discreet and non-integral with one another. The front and rear outsole components 36, 38 may be formed from materials that may generally include natural or synthetic rubber or other suitably durable materials. The material or materials for the front and rear outsole components 36, 38 may be selected to provide a desirable combination of durability and flexibility. Synthetic rubbers that may be used include polybutadiene rubber, ethylene propylene rubber (EPR), styrene isoprene styrene (SIS) copolymer rubber, and styrene butadiene rubber.

Figure 18:
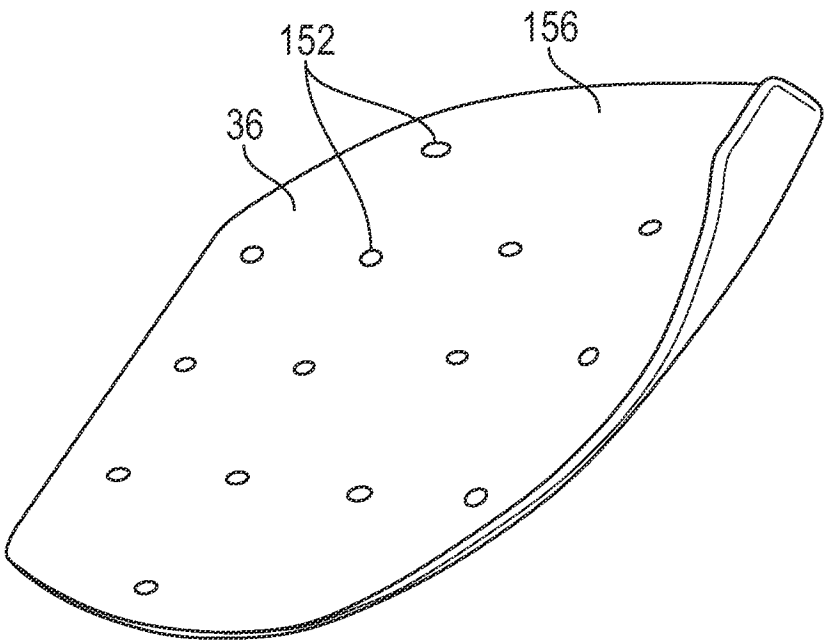
FIG. 18 is a perspective view of a front outsole component of the article of footwear of FIG. 1.
Figure 17:
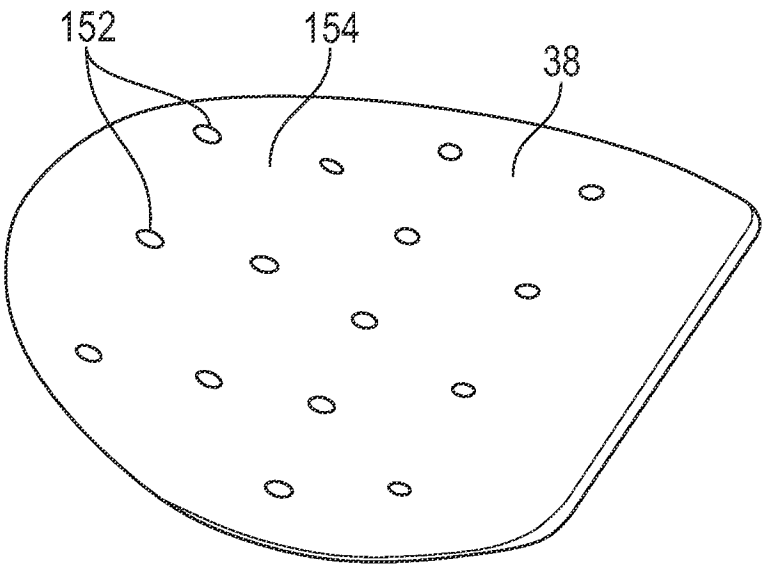
FIG. 17 is a perspective view of a rear outsole component of the article of footwear of FIG. 1.

It is apparent in FIG. 3 that the front and rear outsole components 36, 38 may each have a plurality of lugs 150 or other tread elements to increase traction. Only some of the lugs 150 are labelled in FIG. 3. Although the lugs 150 are shown as generally rectangular or square, lugs of other shapes may be used. As indicated in FIGS. 3, 17, and 18, each of the outsole components 36, 38 has a plurality of apertures 152 extending through the outsole components 36, 38. Only some of the apertures 152 are labelled in FIGS. 3, 17, and 18. For example, apertures 152 extend through the rear outsole component 38 from the ground-engaging surface 129 shown in FIG. 3 to a proximal side 154 of the rear outsole component 38 as shown in FIG. 17. Apertures 152 extend through the front outsole component 36 from the ground-engaging surface 127 shown in FIG. 3 to a proximal side 156 of the front outsole component 36 as shown in FIG. 18.

Figures 19, 20:
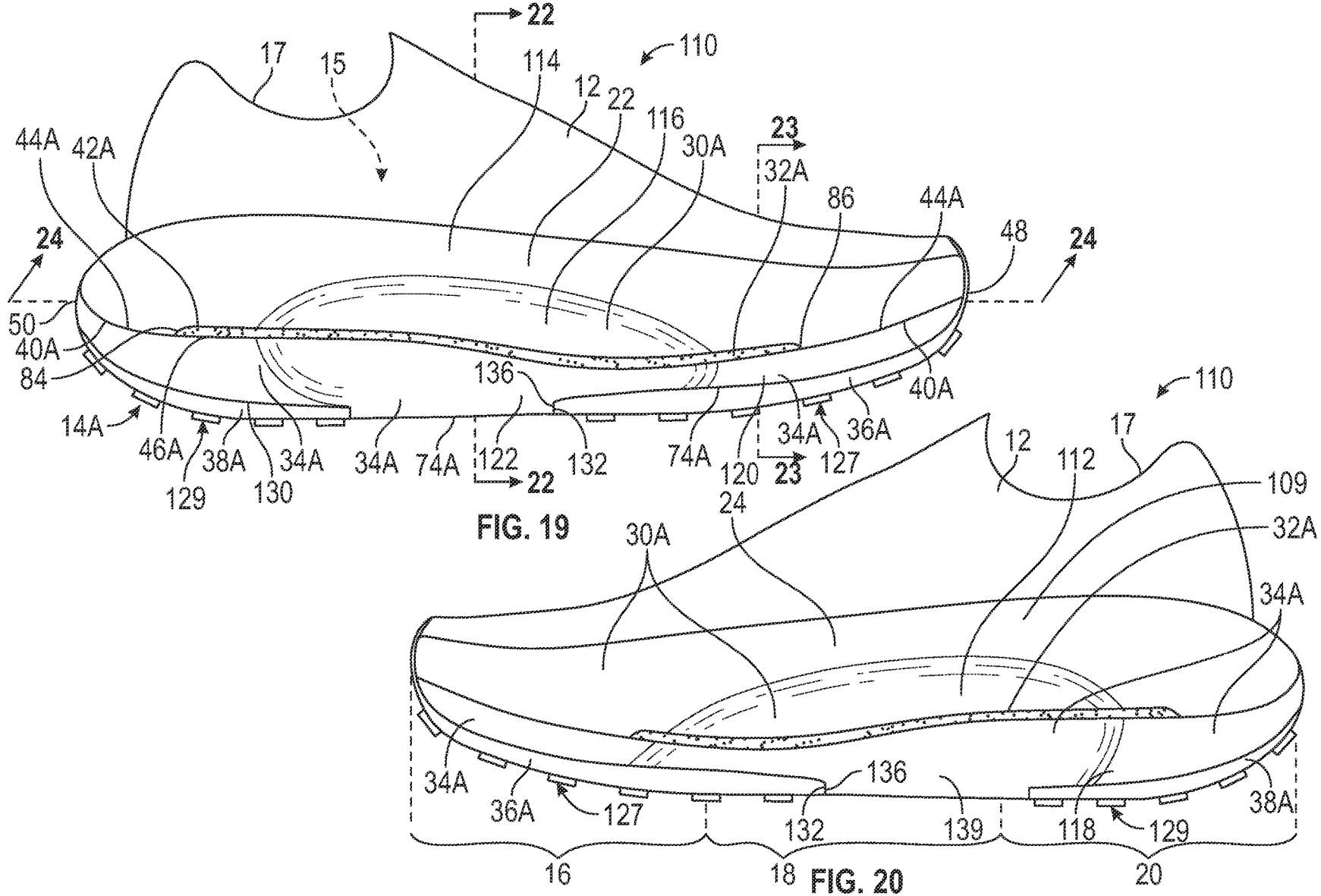
FIG. 19 is a lateral side view of an alternative article of footwear.
FIG. 20 is a medial side view of the article of footwear of FIG. 19.

FIG. 19 is a lateral side view of an article of footwear 110 including an upper 12 and a sole structure 14A. FIG. 20 is a medial side view of the article of footwear 110. As described herein, the sole structure 14A includes features that enhance stability of the article of footwear 110 while also providing cushioning and comfort. Although not limited to such use, the features of the sole structure 14A described herein make the article of footwear 110 especially useful for wear during pregnancy. Components that are alike those of the article of footwear 10 are indicated with like reference numbers and are as described with respect to the article of footwear 10.

Figure 22:
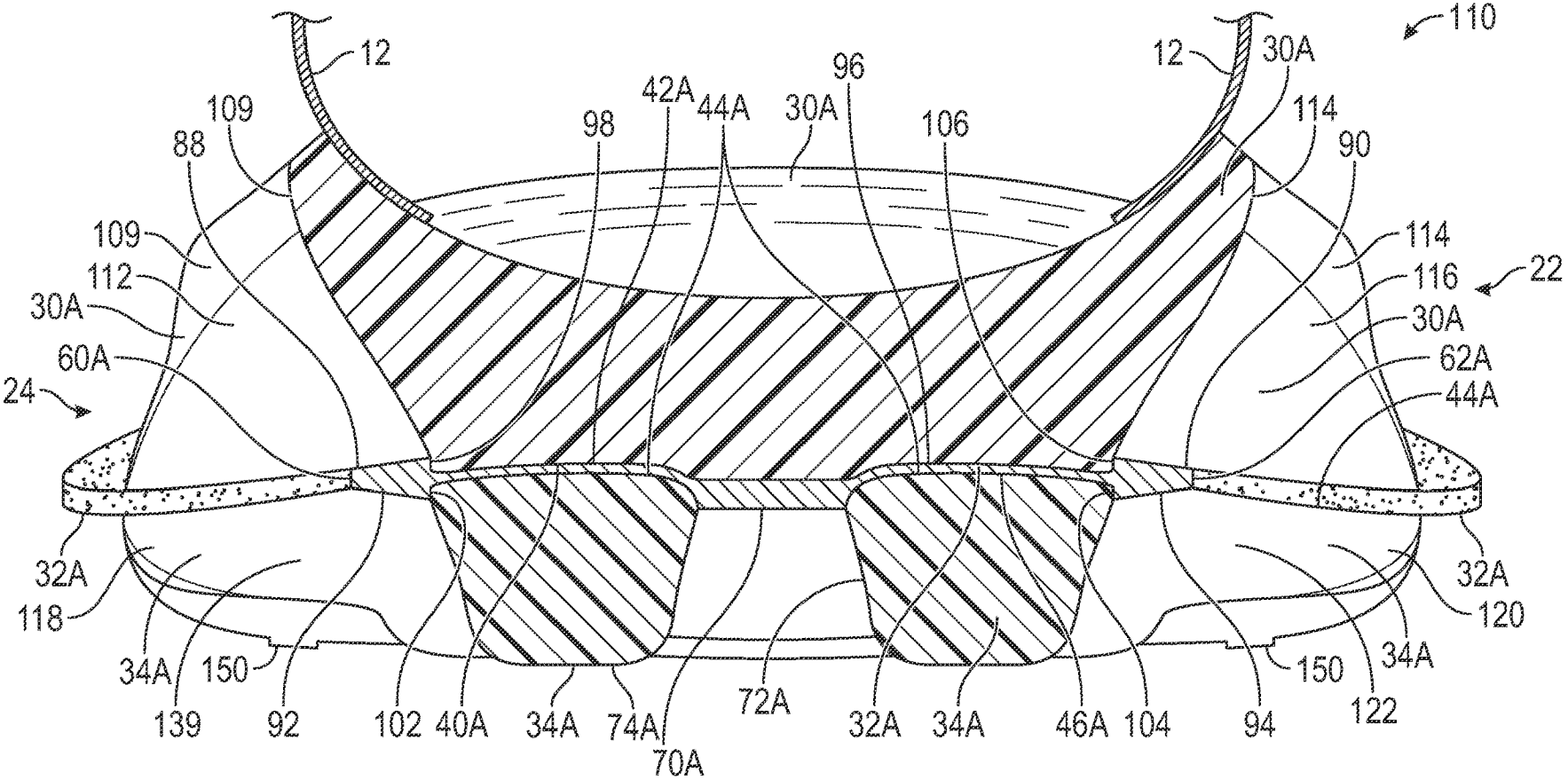
FIG. 22 is a cross-sectional view of the article of footwear of FIG. 19 taken at lines 22-22 in FIG. 19.

As shown, the upper 12 is as described with respect to FIG. 7, and is secured to the sole structure 14A to define a foot-receiving cavity 15 in which a foot may be received through an ankle opening 17 of the upper 12 and supported on the sole structure 14A. A lower extent of the upper 12 is secured to the sole structure near a periphery of the sole structure 14A as shown in FIG. 22.

In order from the top (i.e., the proximal side) of the sole structure 14AA includes a first foam layer 30A, a plate 32A, a second foam layer 34A, and, at the bottom, both a front outsole component 136A and a rear outsole component 138A, each of which are discussed further herein. The components of the sole structure 14A function as a system having various beneficial properties discussed herein.

The first foam layer 30A and the second foam layer 34A extend in the forefoot region 16, the midfoot region 18, and the heel region 20, generally both extending to a foremost extent 48 of the sole structure 14A and to a rearmost extent 50 of the sole structure 14A. The plate 32A extends mainly in the midfoot region 18. While portions of the plate 32A also extend in the forefoot region 16 and in the heel region 20 as discussed herein, the geometry of the plate 32A, including a nonlinear front edge 186 of the plate 32A, is configured to maintain flexibility in the forefoot region 16.

The first foam layer 30A overlies the plate 32A and has a distal side 40A interfacing with a proximal side 42A of the plate 32A in the forefoot region 16, the midfoot region 18, and the heel region 20. The second foam layer 34A underlies the plate 32A and has a proximal side 44A interfacing with a distal side 46A of the plate 32A in the forefoot region 16, the midfoot region 18, and the heel region 20. The plate 32A is secured to the first foam layer 30A and to the second foam layer 34A such as by thermal bonding and/or with adhesive, or otherwise.

Although the plate 32A extends in the forefoot region 16, the midfoot region 18, and the heel region 20, it does not extend to the foremost extent 48 of the sole structure 14 nor does it extend to the rearmost extent 50 of the sole structure 14. The first foam layer 30A and the second foam layer 34A extend further forward and further rearward than the plate 32A. Stated differently, the first foam layer 30A and the second foam layer 34A extend forward of the front edge 186 of the plate 32A and rearward of a rear edge 184 of the plate 32A. The distal side 40A of the first foam layer 30A and the proximal side 44A of the second foam layer 34A interface with one another in the forefoot region 16 forward of the front edge 186 of the plate 32A. Similarly, the distal side 40A of the first foam layer 30A and the proximal side 44A of the second foam layer 34A interface with one another in the heel region 20 rearward of the rear edge 184 of the plate 32A. This is indicated in FIGS. 19 and 20 and may be best seen in FIG. 24. The first foam layer 30A is secured to the second foam layer 34A forward and rearward of the plate 32A such as by thermal bonding and/or with adhesive, or otherwise.

Figure 21:
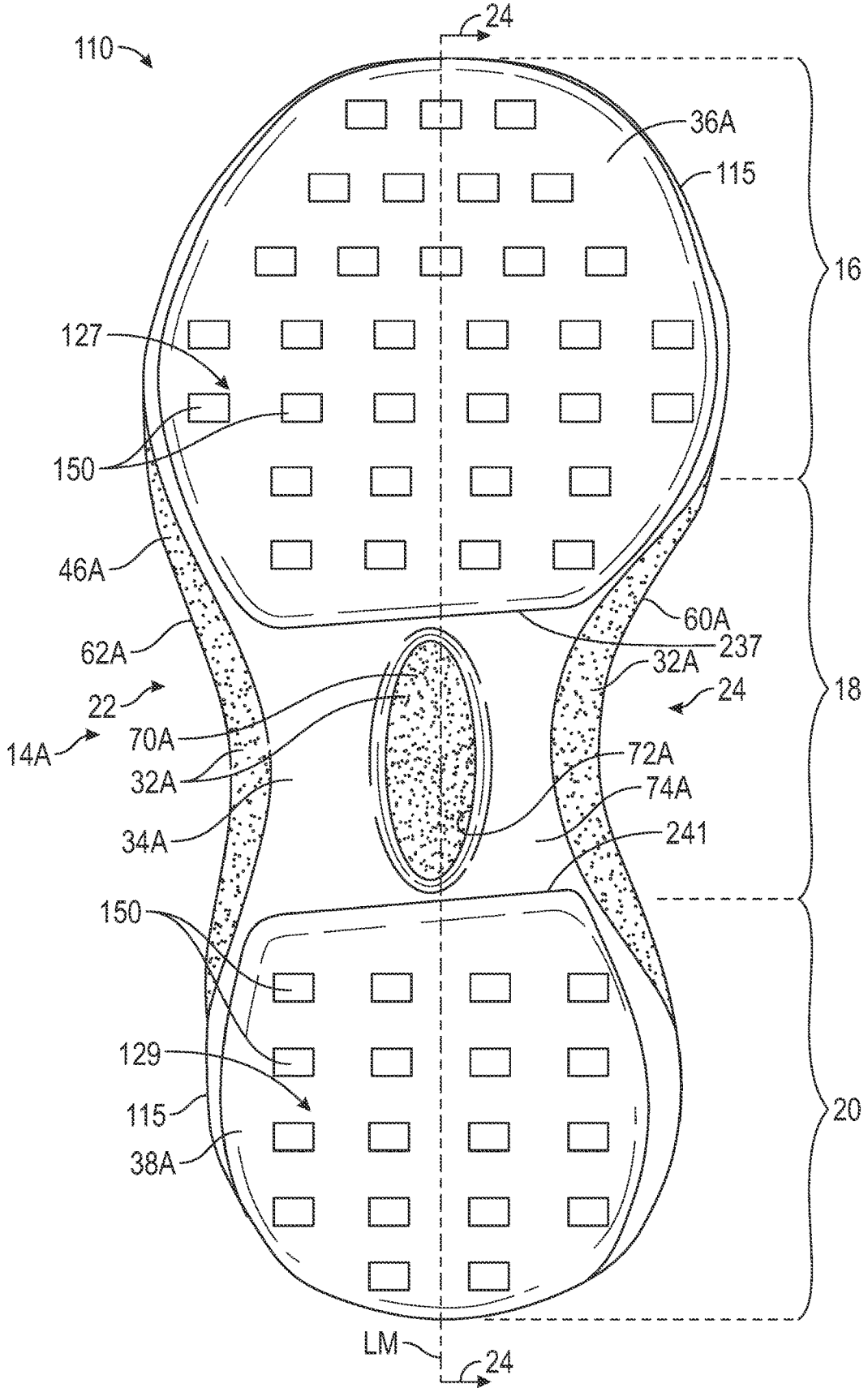
FIG. 21 is a bottom view of the article of footwear of FIG. 19.

Referring to FIGS. 21 and 22, a medial edge 60A of the plate 32A and a lateral edge 62A of the plate 32A extend transversely outward of the distal side 40A of the first foam layer 30A in each of the forefoot region 16, the midfoot region 18, and the heel region 20, as well as transversely outward of the proximal side 44A of the second foam layer 34A in each of the forefoot region 16, the midfoot region 18, and the heel region 20. In fact, the plate 32A is wider than each of the first and second foam layers 30A, 34A where it interfaces with the first and second foam layers 30A, 34A over the majority of its length in each of the forefoot region 16, the midfoot region 18, and the heel region 20. Stated differently, the plate 32A is wider in a transverse direction of the sole structure 14A than the first foam layer 30A and the second foam layer 34A where the first foam layer 30A and the second foam layer 34A interface with the plate 32A. As is apparent in FIGS. 22 and 23, the medial edge 60A of the plate 32A and the lateral edge 62A of the plate 32A extend transversely outward of the distal side 40A of the first foam layer 30A in at least the midfoot region 18, and the medial edge 60A of the plate 32A and the lateral edge 62A of the plate 32A extend transversely outward of the proximal side 44A of the second foam layer 34A in at least the midfoot region 18.

Figure 27:
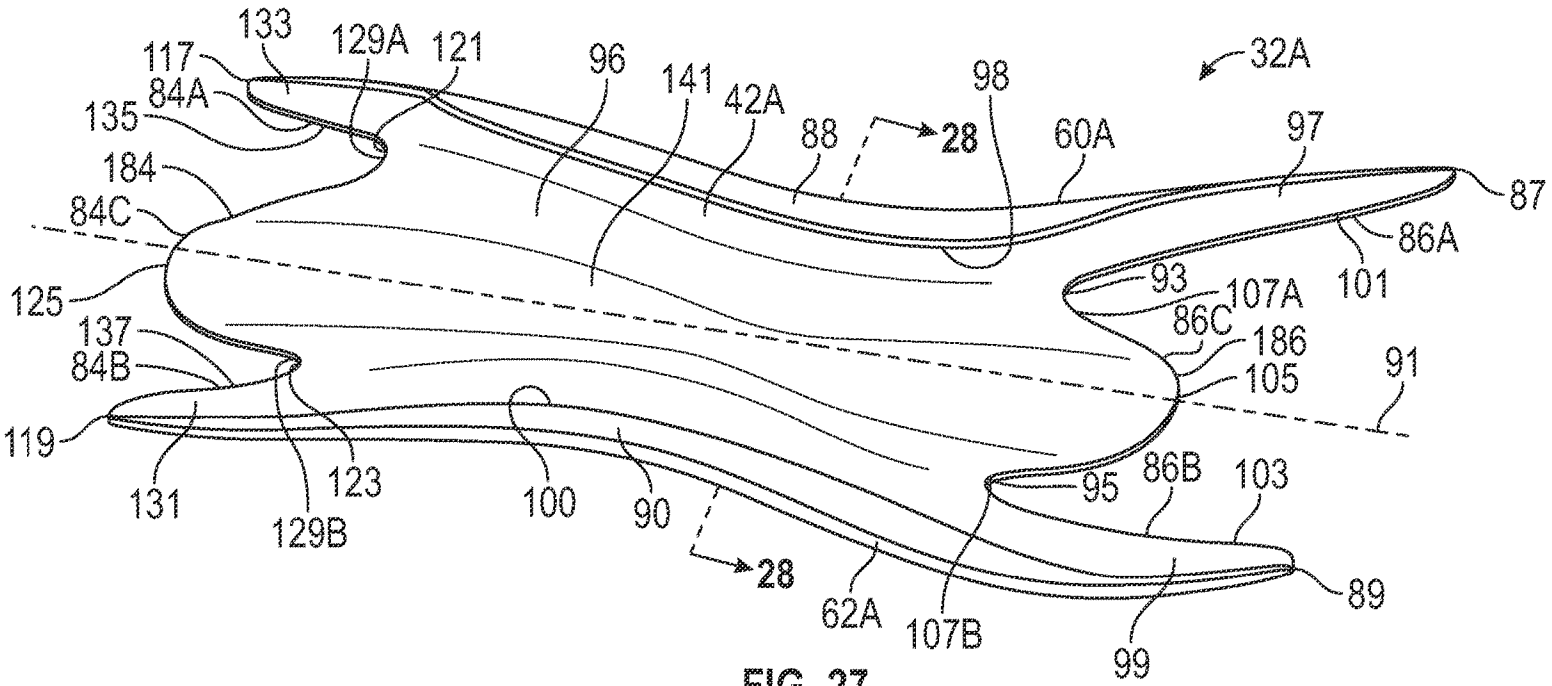
FIG. 27 is a perspective view of a plate of the article of footwear of FIG. 19.
Figure 29:
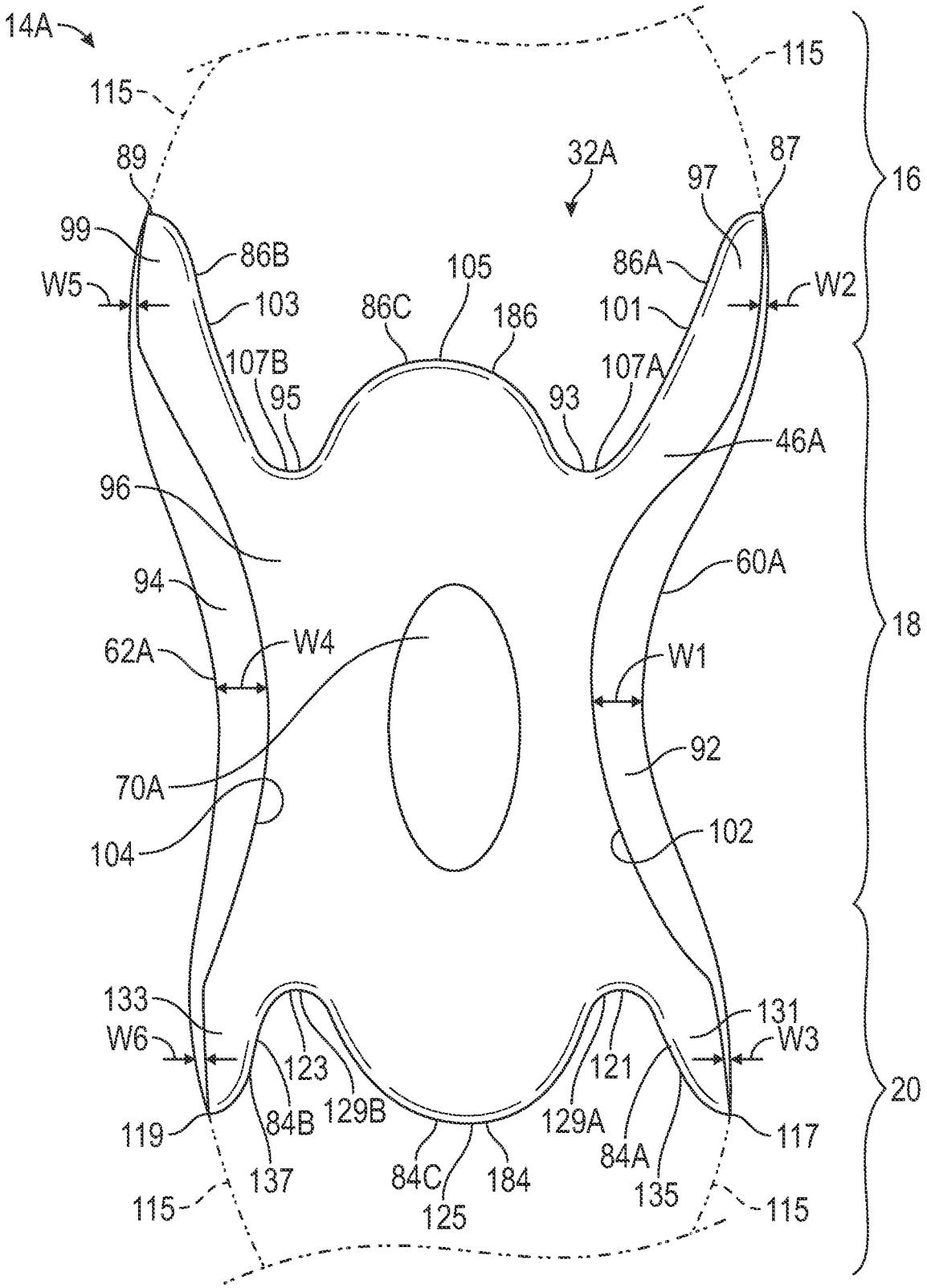
FIG. 29 is a bottom view of the plate of FIG. 27.

As shown in FIGS. 27 and 29, the plate 32A extends continuously from the front edge 186 to the rear edge 184 and from the medial edge 60A of the plate 32A to the lateral edge 62A of the plate 32A such that the distal side 40A of the first foam layer 30A interfaces with the proximal side 44A of the second foam layer 34A only forward of the front edge 186 of the plate 32A and only rearward of the rear edge 184 of the plate 32A. In such a configuration, the plate 32A enables load distribution over the full width of the underlying second foam layer 34, providing greater stability than would a narrower plate.

The first and second foam layers 30A, 34A may be any of the materials discussed herein with respect to the foam layers 30 and 34. The plate 32A may be any of the materials discussed herein with respect to the plate 32. The plate 32A may have a greater compressive stiffness as well as a greater bending stiffness than each of the first foam layer 30A and the second foam layer 34A and may be thinner than each of the first foam layer 30A and the second foam layer 34A where the first foam layer 30A and the second foam layer 34A interface with the plate 32A, as is evident in FIGS. 19, 20, 22, and 24. The relative stiffness of the plate 32A enables it to enhance stability of the sole structure 14 without unduly increasing the overall thickness (e.g., stack height) of the sole structure 14A. A relatively low stack height further enhances stability by maintaining a low ratio of height to width, reducing the propensity for sideways tip.

In such a configuration of the sole structure 14A as shown, the plate 32A, which may be relatively stiffer (in compression and/or bending) than the foam layers 30A, 34A, enables load distribution over the full width of the underlying second foam layer 34A, providing greater stability than would a narrower plate 32A. The plate 32A thus distributes weight over the full width of the underlying second foam layer 34A to increase stability.

In some implementations, a compressive stiffness of the first foam layer 30A may be greater than a compressive stiffness of the second foam layer 34A. Additionally, or alternatively, a bending stiffness of the first foam layer 30A may be greater than a bending stiffness of the second foam layer 34A. A compressive stiffness of the plate 32A may be greater than the compressive stiffness of the first foam layer 30A and greater than a compressive stiffness of the second foam layer 34A. Additionally, or alternatively, a bending stiffness of the plate 32A may be greater than a bending stiffness of the first foam layer 30A and greater than a bending stiffness of the second foam layer 34A.

Stated differently, the plate 32A is stiffer than both the first foam layer 30 and the second foam layer 34A both in compression and in bending, while the overlying first foam layer 30A closest to the foot of the wearer is stiffer than the underlying second foam layer 34A that is further from the foot and closer to the ground during wear when a wearer is standing. The first foam layer 30A is relatively stiff in comparison to the second foam layer 34A to maximize the ability of the plate 32A to spread pressure over the entire width of the foot in comparison to a less stiff first foam layer 30A which could cause load concentrations due to compressing more easily closer to the foot. The relatively less stiff second foam layer 34A dampens impact loads and vibrations below the plate 32A to maintain the even spread of pressure at the foot.

In one non-limiting example, the plate 32A may be at least 50 percent stiffer than the first foam layer 30A, and the first foam layer 30A may be at least 20 percent stiffer than the second foam layer 34A.

Because the overlying first foam layer 30A is stiffer than the underlying second foam layer 34A, the first foam layer 30A avoids localized compression to act in concert with the plate 32A to distribute loading, while still providing sufficient comfort. The muscles in the feet may need to work less when interfacing with a relatively stiff foam layer, reducing foot fatigue. The underlying second foam layer 34A compresses more readily to provide impact protection. The plate 32A ensures responsiveness, decreasing the work required of the foot and ankle for forward propulsion when walking.

FIGS. 21-22, 24, and 28-31 also show that the distal side 46A of the plate 32A has a protrusion 70A that extends in the midfoot region 18 and is disposed entirely transversely inward of the medial edge 60A of the plate 32A and entirely transversely inward of the lateral edge 62A of the plate 32A. The proximal side 44A of the second foam layer 34A has a recess 72A, and the protrusion 70A interfits with the recess 72A. The relatively centrally-located protrusion 70A thus helps fit the plate 32A to the underlying second foam layer 34A. In an implementation, the recess 72A is a through hole that extends from the proximal side 44A of the second foam layer 34A to the distal side 74A of the second foam layer 34A. Accordingly, the recess 72A may also be referred to herein as through hole 72A. In such an implementation, the distal side 46A of the plate 32A at the protrusion 70A may be exposed at the through hole 72A as shown in FIG. 21 (e.g., when viewed from the distal side 74A of the second foam layer 34A).

Although the protrusion 70A and the through hole 72A are shown as relatively oval, they may have other shapes such as circular, square, rectangular, or other polygonal shapes. In an embodiment, a protrusion and a through hole that interfits with the protrusion may have rounded front and rear ends like the protrusion 70A and the through hole 72A and may be narrowed in a midportion between the front and rear ends. For example, the protrusion and the through hole may each resemble an elongated oval that is narrowed in a transverse direction of the sole structure 14A at its midsection. In such an embodiment, a periphery of the protrusion and a perimeter of the through hole may resemble an elongated eight-shape.

Figure 25:
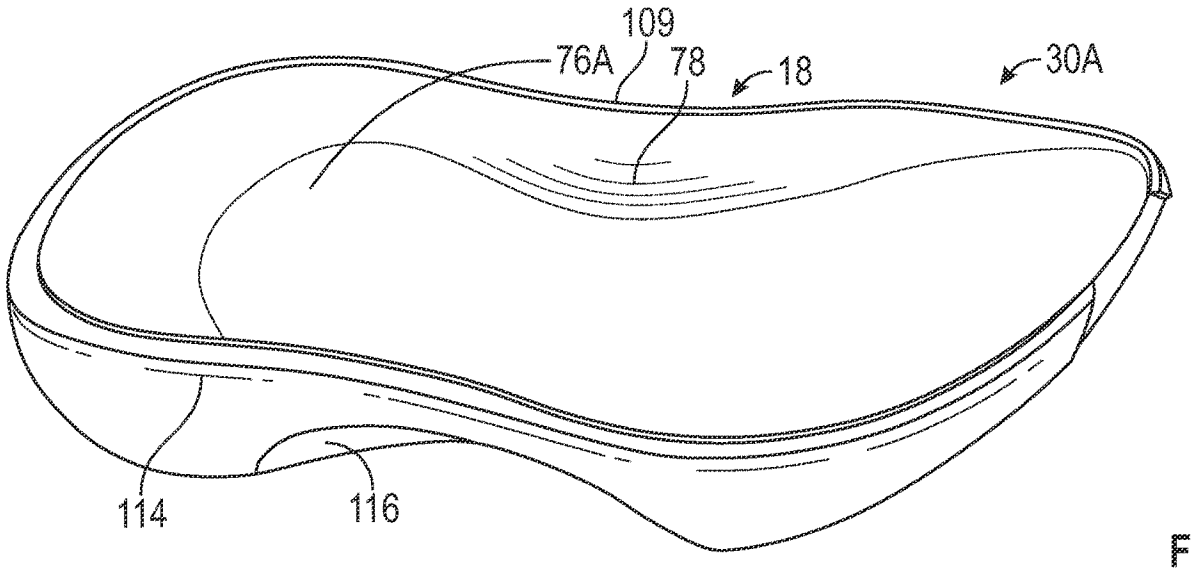
FIG. 25 is a perspective view of a first foam layer of the article of footwear of FIG. 19.

FIG. 25 shows that the first foam layer 30A has a proximal side 76A that is generally concave at and configured to cup the lower side of the foot, providing support to the arch at an inner medial side wall 78A in the midfoot region 18. The first foam layer 30A may also enhance stability as a medial side wall 109 of the first foam layer 30A extends partially upward along the medial side 24 of the footwear upper 12 that is secured to the first foam layer 30A, as shown in FIG. 22, for example. A lateral side wall 114 of the first foam layer 30A extends partially upward along the lateral side 22 of the footwear upper 12. The first foam layer 30A thus extends partway upward along the footwear upper 12 to cup the wearer's foot between the medial and lateral side walls 109, 114.

Figure 24:
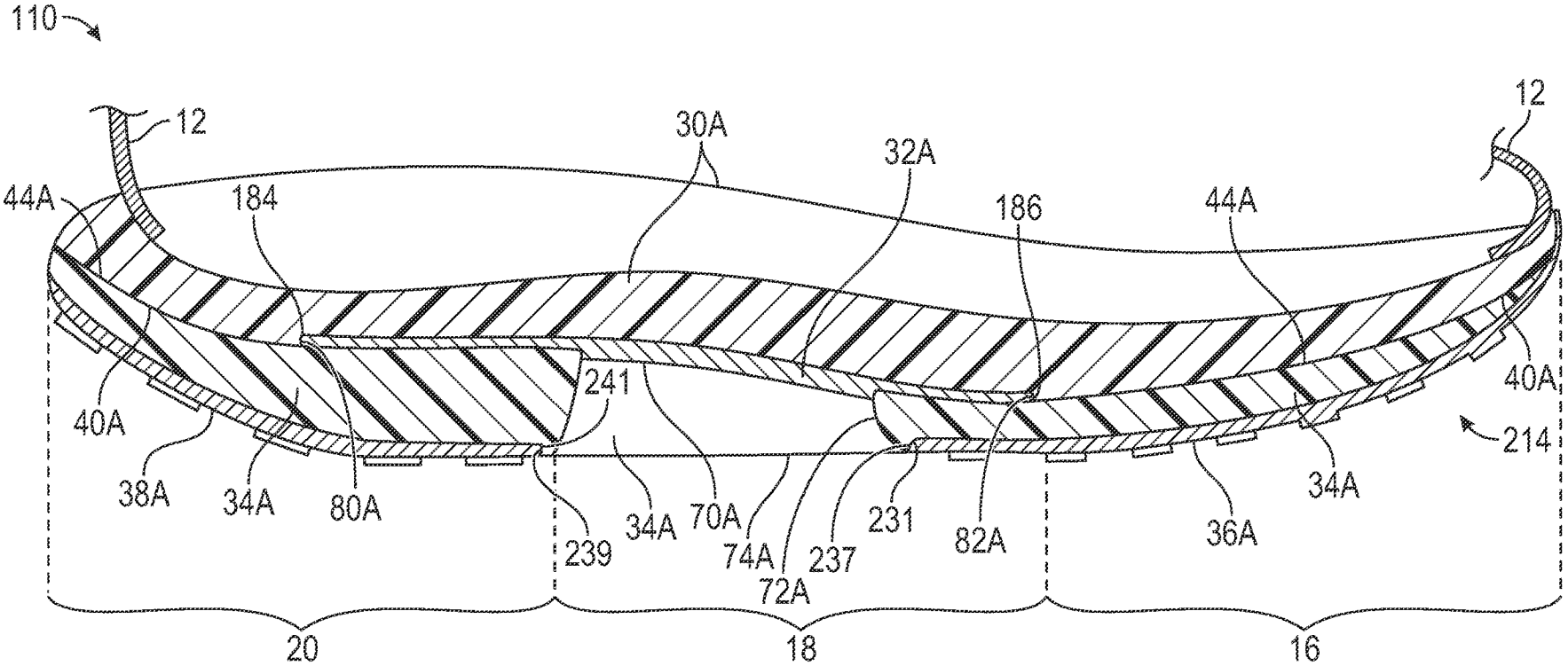
FIG. 24 is a cross-sectional view of the article of footwear of FIG. 19 taken at lines 24-24 in FIG. 19.
Figure 26:
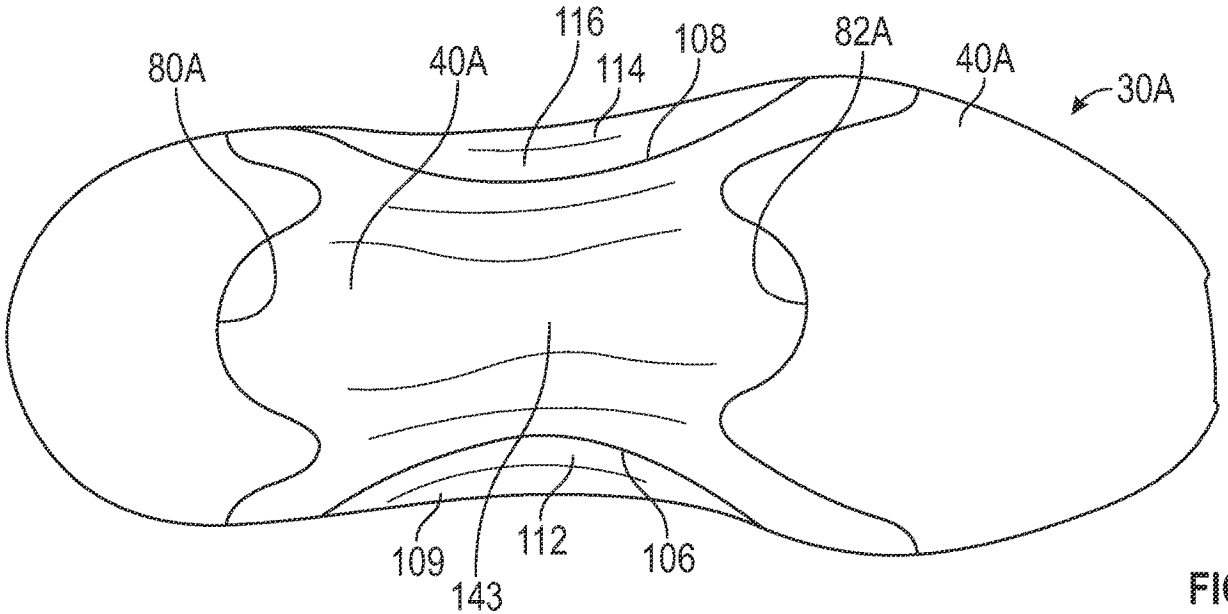
FIG. 26 is a bottom view of the first foam layer of FIG. 25.

The first foam layer 30A and the plate 32A also have interfitting features in the fore-aft direction. With reference to FIG. 26, the distal side 40A of the first foam layer 30A is shown as having a downwardly-extending rear ledge 80A and a downwardly-extending front ledge 82A. As shown in FIG. 24, the rear edge 184 of the plate 32A fits against the downwardly-extending rear ledge 80A, and the front edge 186 of the plate 32A fits against the downwardly-extending front ledge 82A.

As best shown in FIGS. 27 and 29, the front edge 186 of the plate 32A is contoured to match the contour of the front ledge 82A shown in FIG. 26, and the rear edge 184 of the plate 32A is contoured to match the contour of the rear ledge 80A in FIG. 26. The interfitting front ledge 82A and front edge 186 and the interfitting rear ledge 80A and rear edge 184 serve as locating features to ensure efficient and accurate assembly of the first foam layer 30A and the plate 32A.

The front edge 186 has a medial segment 86A that includes a medial extremity 87 of the front edge 186, a lateral segment 86B that includes a lateral extremity 89 of the front edge 186, and a middle segment 86C extending from the medial segment 86A to the lateral segment 86B. The front edge 186 intersects the medial edge 60A at the medial extremity 87, which may be referred to as a medial pointed corner. The front edge 186 intersects the lateral edge 62A at the lateral extremity 89, which may be referred to as a lateral pointed corner. The medial segment 86A is entirely between a longitudinal midline 91 of the plate 32A and the medial edge 60A of the plate 32A. The lateral segment 86B is entirely between the longitudinal midline 91 and the lateral edge 62A of the plate 32A. The front edge 186 has a medial rear extremity 93 that serves as the boundary between the medial segment 86A and the middle segment 86C. Similarly, the front edge 186 has a lateral rear extremity 95 that serves as the boundary between the lateral segment 86B and the middle segment 86C.

The medial segment 86A and the lateral segment 86B extend further forward than the middle segment 86C. As shown, a forwardmost extent of the medial segment 86A is the medial extremity 87 of the front edge 186. Similarly, a forwardmost extent of the lateral segment 86B is the lateral extremity 89 of the front edge 86.

The nonlinear front edge 186 of the plate 32A helps define a front medial arm 97 and a front lateral arm 99 of the plate 32A. As best shown in FIG. 29, the front medial arm 97 extends from the midfoot region 18 into the forefoot region 16 and partially defines the medial edge 60A of the plate 32A. The front lateral arm 99 extends from the midfoot region 18 into the forefoot region 16 and partially defines the lateral edge 62A of the plate 32A. The nonlinear front edge 186 extends along and between the front medial arm 97 and the front lateral arm 99 and extends further rearward than both the forwardmost extremity (e.g., the medial extremity 87) of the front medial arm 97 and the forwardmost extremity (e.g., the lateral extremity 89) of the front lateral arm 99. More specifically, the medial segment 86A defines an inner extent 101 of the front medial arm 97 and the lateral segment 86B defines an inner extent 103 of the front lateral arm 99.

The front edge 186 juts forward at the middle segment 86C to a forwardmost extent 105 of the middle segment 86C that is rearward of the forwardmost extent of the front medial arm 97 (which is the medial extremity 87) and is rearward of the forwardmost extent of the front lateral arm 99 (which is the lateral extremity 89). Stated differently, the front edge 186 recedes rearward between the medial extremity 87 of the front edge 186 and the forwardmost extent 105 of the middle segment 86C and recedes rearward between the lateral extremity 89 of the front edge 86 and the forwardmost extent 105 of the middle segment 86C. With this configuration, the front edge 186 defines a first indentation 107A between the medial extremity 87 of the front edge 186 and the forwardmost extent 105 of the middle segment 86C and a second indentation 107B between the lateral extremity 89 of the front edge 186 and the forwardmost extent 105 of the middle segment 86C. The front edge 186 juts forward to the forwardmost extent 105 of the middle segment 86C between the first indentation 107A and the second indentation 107B.

By providing the plate 32A with the front edge 186 having the medial and lateral segments 86A, 86B that extend further forward than the middle segment 86C, at least the middle segment 86C of the plate 32A may be absent from most or all of the forefoot region 16 of the sole structure 14A to attain flexibility in the forefoot region 16, for example, while still allowing the medial and lateral segments 86A, 86B to extend far enough forward from the midfoot region 18 of the sole structure 14A to attain stability goals.

In FIG. 29, a portion of an outer perimeter 115 of the sole structure 14A is indicated in phantom in the forefoot region 16 and the heel region 20 to illustrate the relative positions of the plate 32A in the forefoot region 16 and heel region 20. The outer perimeter 115 is also indicated in FIG. 21. As is evident in FIG. 29, the forwardmost extent 105 of the middle segment 86C is disposed in the midfoot region 18 of the sole structure 14A such that the portion of the forefoot region 16 transversely inward of the medial and lateral segments 86A, 86B of the front edge 186 is free from the plate 32A. Stated differently, only the front medial arm 97 and the front lateral arm 99 of the plate 32A extend into the forefoot region 16.

Figure 23:
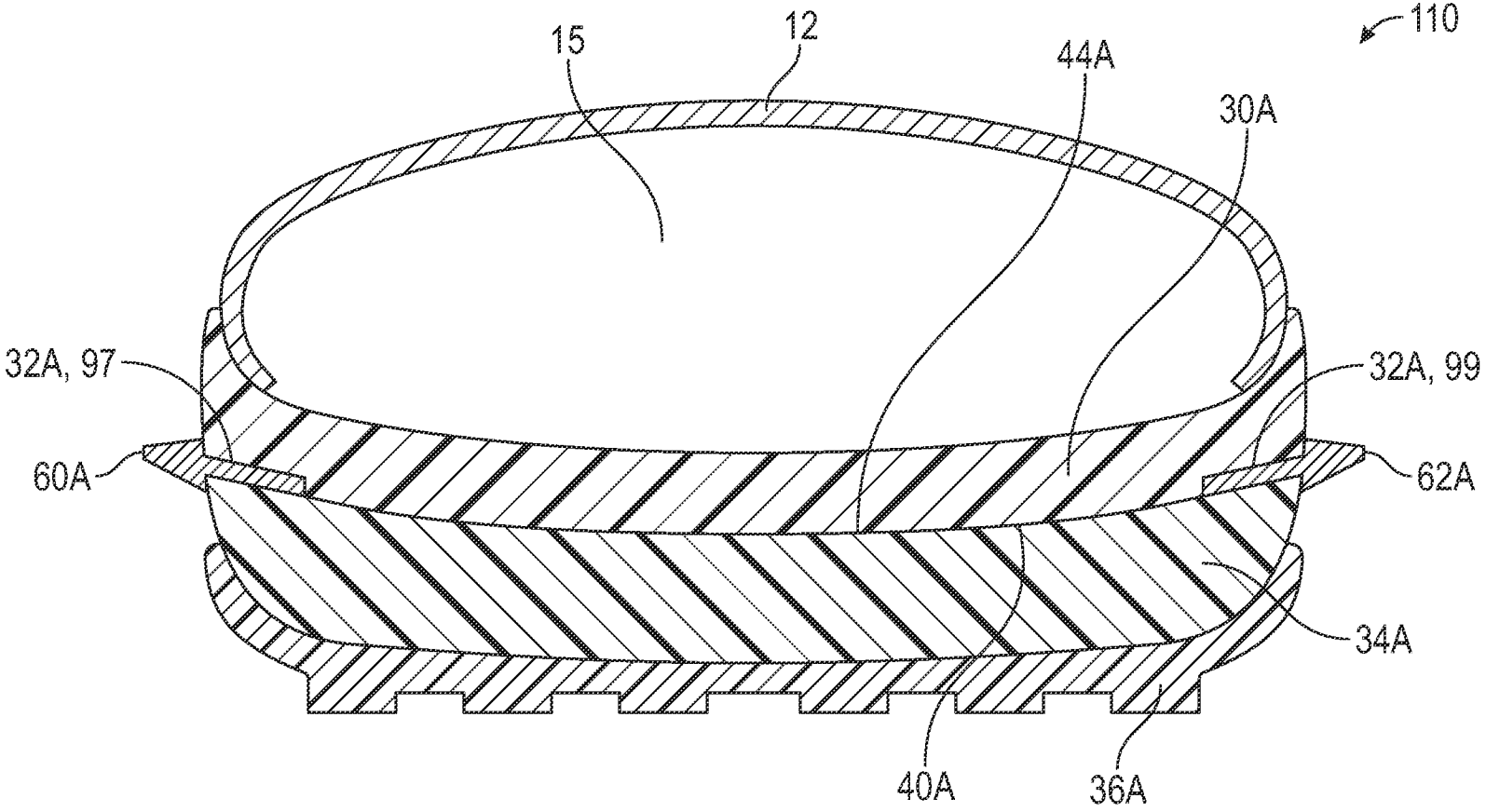
FIG. 23 is a cross-sectional view of the article of footwear of FIG. 19 taken at lines 23-23 in FIG. 19.

In another implementation, the forwardmost extent 105 of the middle segment 86C may be disposed in the forefoot region 16 but due to the indentations 107A and 107B extending into the midfoot region 18, no part of the plate 32A extends continuously along a cross-section of the sole structure 14A taken in a transverse direction of the sole structure 14A in the forefoot region 16. FIG. 23 illustrates such a transverse cross-section of the sole structure 14A in the forefoot region 16. Only the front medial arm 97 and the front lateral arm 99 are present at the transverse cross-section of FIG. 23. The portion of the forefoot region 16 transversely inward of the medial and lateral segments 86A, 86B of the front edge 186 is free from the plate 32A as shown in FIG. 23 (e.g., the plate 32A is not present in this portion of the forefoot region 16). The distal side 40A of the first foam layer 30A interfaces with the proximal side 44A of the second foam layer 34A inward of the medial and lateral segments 86A, 86B where the plate 32A is absent at this transverse cross-section.

Flexibility of the forefoot region 16, such as during dorsiflexion, is therefore not lessened as it would be by the presence of the plate 32A, and stability at the lateral side 22 and the medial side 24 of the sole structure 14A is enhanced by the further forward medial and lateral segments 86A, 86B of the front edge 186.

Such a nonlinear front edge 186 partially defining the front medial arm 97 and the front lateral arm 99 provides support under loading along the medial and lateral edges 60A, 62A, helping to distribute such loads over a greater expanse of the plate 32A and the second foam layer 34A thereunder while not unduly limiting flexibility of the forefoot region 16 of the sole structure 14A during dorsiflexion and side-to-side movement.

Referring to FIGS. 27 and 29, the rear edge 184 of the plate 32A is also nonlinear. For example, the rear edge 184 has a medial segment 84A that includes a medial extremity 117 of the rear edge 184, a lateral segment 84B that includes a lateral extremity 119 of the rear edge 184, and a middle segment 84C extending from the medial segment 84A to the lateral segment 84B. The rear edge 184 intersects the medial edge 60A at the medial extremity 117, which may be referred to as another medial pointed corner. The rear edge 184 intersects the lateral edge 62A at the lateral extremity 119, which may be referred to as another lateral pointed corner. The medial extremity 117 is also the rearmost extremity of the medial segment 84A and the lateral extremity is the rearmost extremity of the lateral segment 84B. The medial segment 84A is entirely between a longitudinal midline 91 of the plate 32A and the medial edge 60A of the plate 32A. The lateral segment 84B is entirely between the longitudinal midline 91 and the lateral edge 62A of the plate 32A. The rear edge 184 has a medial front extremity 121 that serves as the boundary between the medial segment 84A and the middle segment 84C. Similarly, the rear edge 184 has a lateral front extremity 123 that serves as the boundary between the lateral segment 84B and the middle segment 84C.

The rear edge 184 extends forward between the medial extremity 117 of the rear edge 184 and a rearmost extent 125 of the middle segment 84C of the rear edge 184 and between the lateral extremity 119 of the rear edge 184 and the rearmost extent 125 of the middle segment 84C of the rear edge 184 such that the rear edge 184 defines a first indentation 129A between the medial extremity 117 of the rear edge 184 and the rearmost extent 125 of the middle segment 84C of the rear edge 184 and a second indentation 129B between the lateral extremity 119 of the rear edge 184 and the rearmost extent 125 of the middle segment 84C of the rear edge 184. The rear edge 184 juts rearward to the rearmost extent 125 of the middle segment 84C of the rear edge 184 between the first indentation 129A of the rear edge 184 and the second indentation 129B of the rear edge 184.

The nonlinear rear edge 184 of the plate 32A helps define a rear medial arm 131 extending rearward in the heel region 20 and further defining the medial edge 60A of the plate 32A, and a rear lateral arm 133 extending rearward in the heel region 20 and further defining the lateral edge 62A of the plate 32A. The rear edge 184 thus extends nonlinearly from the rear medial arm 131 to the rear lateral arm 133, extending further forward than the rearmost extremity (e.g., the medial extremity 117) of the rear medial arm 131 and the rearmost extremity (e.g., the lateral extremity 119) of the rear lateral arm 133. More specifically, the medial segment 84A defines an inner extent 135 of the rear medial arm 131, the lateral segment 84B defines an inner extent 137 of the rear lateral arm 133, and the middle segment 84C extends from the medial segment 84A of the rear edge 184 to the lateral segment 84B of the rear edge 184. The rear edge 184 juts rearward at the middle segment 84C to the rearmost extent 125 of the middle segment 84C of the rear edge 184 that is not rearward of the rearmost extremity (e.g., the medial extremity 117) of the rear medial arm 131 and/or is not rearward of the rearmost extremity (e.g., the lateral extremity 119) of the rear lateral arm 133. In other words, the rearmost extent 125 of the middle segment 84C forward of or at the same transverse cross-section as at least one of the rearmost extremity (e.g., the medial extremity 117) or the rearmost extremity (e.g., the lateral extremity 119).

Figure 28:
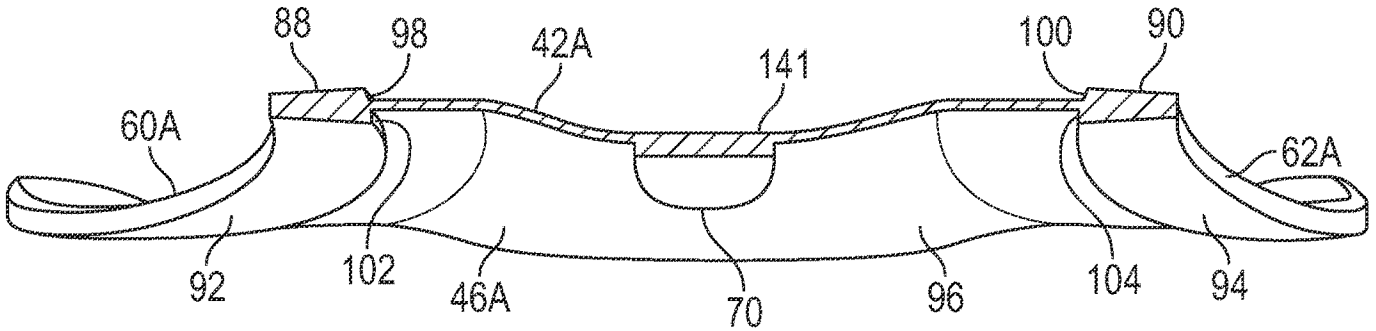
FIG. 28 is a cross-sectional view of the plate of FIG. 27 taken at lines 28-28 in FIG. 27.

As best indicated in FIGS. 22, 27, and 28, the proximal side 42A of the plate 32A is nonplanar and includes a trough 141 extending longitudinally along the longitudinal midline 91 of the plate 32A. The nonplanar proximal side 42A with the longitudinally-extending trough 141 may affect the bending stiffness of the plate 32A. For example, the trough 141 may function as a slight corrugation of the plate 32A, such as a longitudinal rib, further increasing the bending stiffness of the plate 32A in the longitudinal direction relative to a flat plate. The distal side 40A of the first foam layer 30A has a longitudinally-extending protrusion 143 that interfits with the trough 141.

The distal side 40A of the first foam layer 30A interfaces with the proximal side 42A of the plate 32A from the nonlinear front edge 186 to the rear edge 184. The proximal side 44A of the second foam layer 34A interfaces with the distal side 46A of the plate 32A from the nonlinear front edge 186 to the rear edge 184.

With reference to FIG. 27, the proximal side 42A of the plate 32A has a medial rail 88 extending along the medial edge 60A of the plate 32A and a lateral rail 90 extending along the lateral edge 62A of the plate 32A. The medial rail 88 and the lateral rail 90 are configured as discussed with respect to the plate 32. The medial rail 88 may be referred to as a proximal medial rail 88 and the lateral rail 90 may be referred to as a proximal lateral rail 90. Similarly, as shown in FIGS. 28 and 29, the distal side 46A of the plate 32A has a medial rail 92 extending along the medial edge 60A of the plate 32A and a lateral rail 94 extending along the lateral edge 62A of the plate 32A. The medial rail 92 and the lateral rail 94 are as discussed with respect to the plate 32. The medial rail 92 may be referred to as a distal medial rail 92 and the lateral rail 94 may be referred to as a distal lateral rail 94. A central portion 96 of the plate 32A is disposed between and is integral with the medial rail 88 and the lateral rail 90 as well as between the medial rail 92 and the lateral rail 94. The central portion 96 includes the protrusion 70A and the longitudinal midline 91 extends along the central portion 96.

Similar to the plate 32, the thickness of the central portion 96 of the plate 32 is less than the thickness of the plate 32A anywhere along the medial rails 88, 92 or the lateral rails 90, 94 except that thickness of the plate 32A at the protrusion 70A may be less than, greater than, or equal to the thickness of the plate 32A at the medial rails 88, 92 or at the lateral rails 90, 94.

Figure 30:
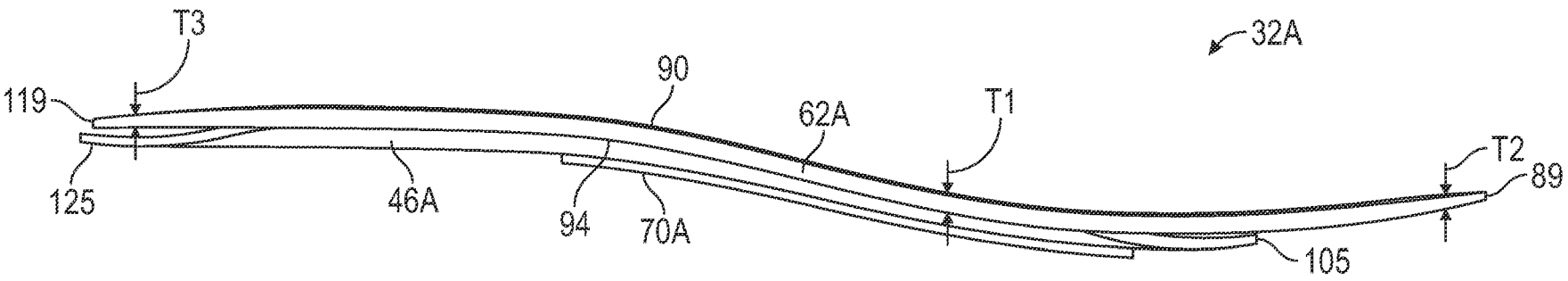
FIG. 30 is a lateral side view of the plate of FIG. 27.
Figure 31:
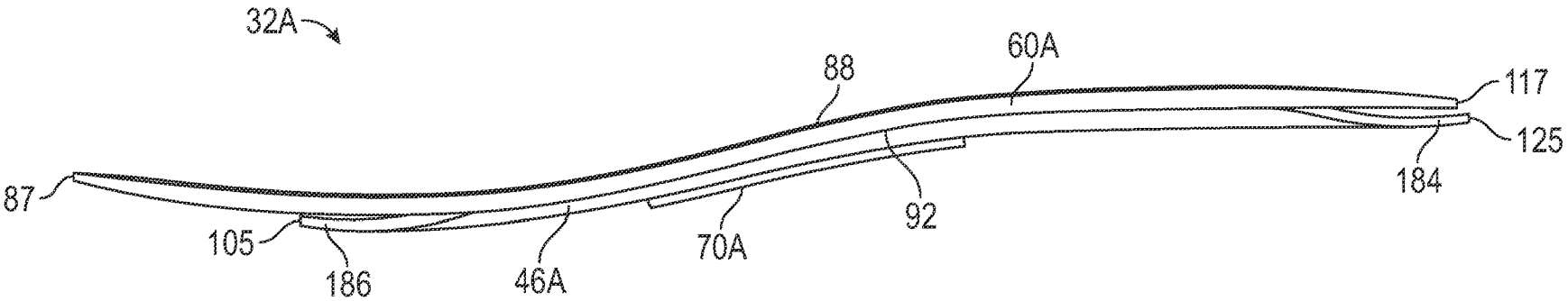
FIG. 31 is a medial side view of the plate of FIG. 27.
Figure 32:
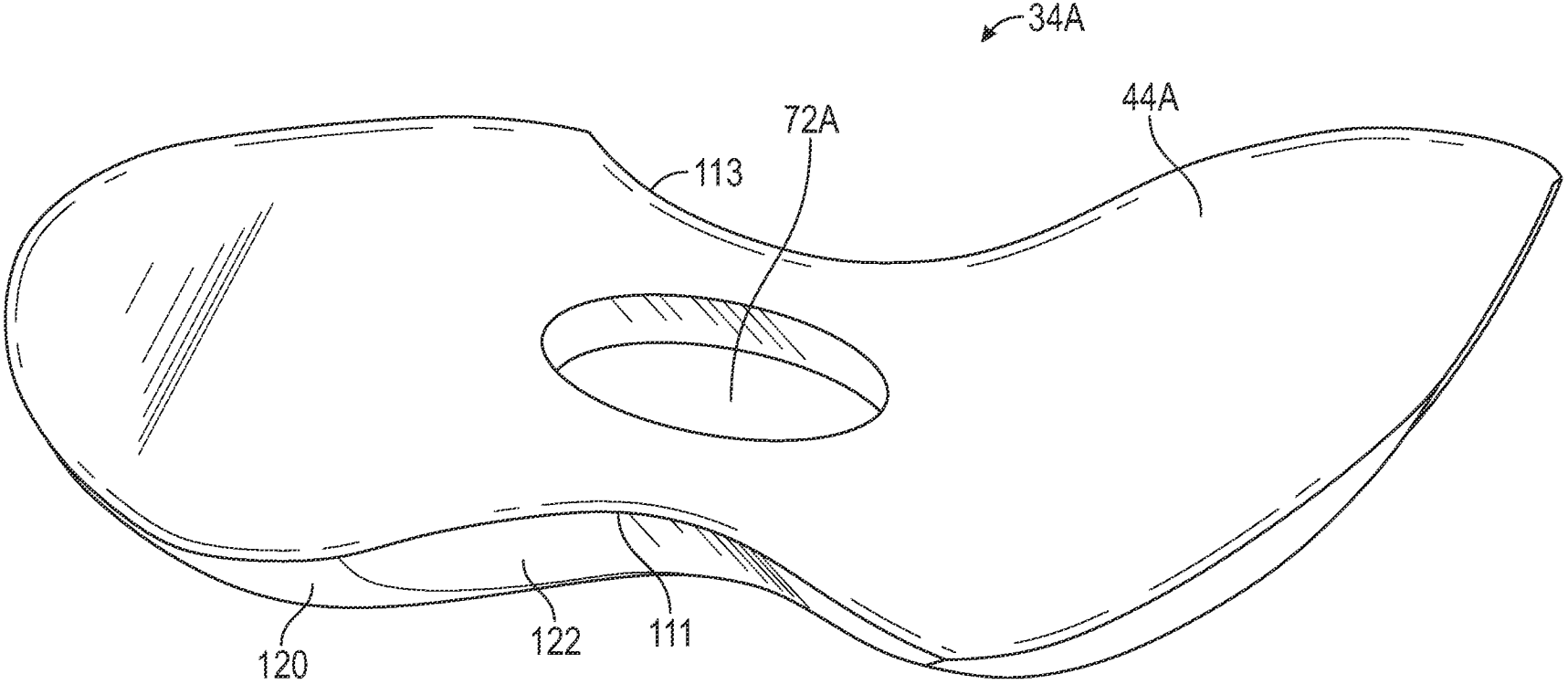
FIG. 32 is a perspective view of a second foam layer of the article of footwear of FIG. 19.

FIGS. 30 and 31 show that the rails 88, 90, 92, and 94 taper in thickness in a forward direction and in a rearward direction from the midfoot region 18 so that they are thickest in the midfoot region 18. FIG. 31 shows the plate 32A has a thickness T1 at a location in the midfoot region 18, tapers to a lesser thickness T2 toward the front edge 186 a portion of which will be in the forefoot region 16 of the assembled sole structure 14A, and tapers to a lesser thickness T3 toward the rear edge 184 which will be in the heel region 20 of the assembled sole structure 14A. The plate 32A is also shown in FIGS. 30 and 31 to have a concavity on the proximal side in the forefoot region creating a spoon shape.

Because the rails 88, 92, 90, and 94 are thicker than the central portion 96 at least where the central portion 96 borders the rails, the plate 32A has a medial lip 98 running along an inner edge of the medial rail 88 and a lateral lip 100 running along an inner edge of the lateral rail 90 on the proximal side 42A, and a medial lip 102 running along an inner edge of the medial rail 92 and a lateral lip 104 running along an inner edge of the lateral rail 94 on the distal side 46A as best shown in FIGS. 27 and 28.

Referring again to FIG. 26, the distal side 40A of the first foam layer 30A has a medial edge 106 and a lateral edge 108. The medial side wall 109 of the first foam layer 30A has a medial side recess 112 extending downward and inward in the midfoot region 18 so that the medial edge 106 curves inward in the midfoot region 18. The lateral side wall 114 of the first foam layer 30A has a lateral side recess 116 extending downward and inward in the midfoot region 18 so that the lateral edge 108 curves inward in the midfoot region 18. The recesses 112, 116 are shown in FIG. 26 and as well as FIGS. 19, 20, and 22. Similarly, the medial side wall 118 of the second foam layer 34A has a medial side recess 139 extending inward in the midfoot region 18. The lateral side wall 120 of the second foam layer 34A has a lateral side recess 122 extending inward in the midfoot region 18.

The first foam layer 30A nests between the lips 98, 100 of the medial rail 88 and the lateral rail 90. The second foam layer 34A nests between the lips 102, 104 of the medial rail 92 and the lateral rail 94. More specifically, the lip 98 of the rail 88 follows the contour of the medial edge 106 of the first foam layer 30A at the distal side 40A and the lip 100 of the rail 90 follows the contour of the lateral edge 108 of the first foam layer 30A at the distal side 40A. Similarly, the lip 102 of the rail 92 follows the contour of the medial edge 113 of the second foam layer 34A at the proximal side 44A and the lip 104 of the rail 94 follows the contour of the lateral edge 111 of the second foam layer 34A at the proximal side 44A.

The rails 88, 92, and 90, 94 thus serve as locating features for proper assembly of the sole structure 14A and ensure that the plate 32A extends outward of the first and the second foam layers 30A, 34A to optimize dispersion of loading forces. Because the plate 32A extends further outward in the transverse direction than the distal side 40A of the first foam layer 30A and further outward in the transverse direction than the proximal side 44A of the second foam layer 34A along the entire length of the plate 32A where it interfaces with the distal side 40 and the proximal side 44A, the first and second foam layers 30A, 34A do not interface with one another along the length of the plate 32A, although they interface with one another forward and/or rearward of the plate 32A as discussed herein. The full surface area of the distal side 40A of the first foam layer 30A and the proximal side 44A of the second foam layer 34A between the front edge 186 of the plate 32A and the rear edge 184 of the plate 32A interfaces with the plate 32A so that loading and impact forces transmitted through the sole structure 14A to either of these surfaces areas are dispersed by the plate 32A.

Figure 33:
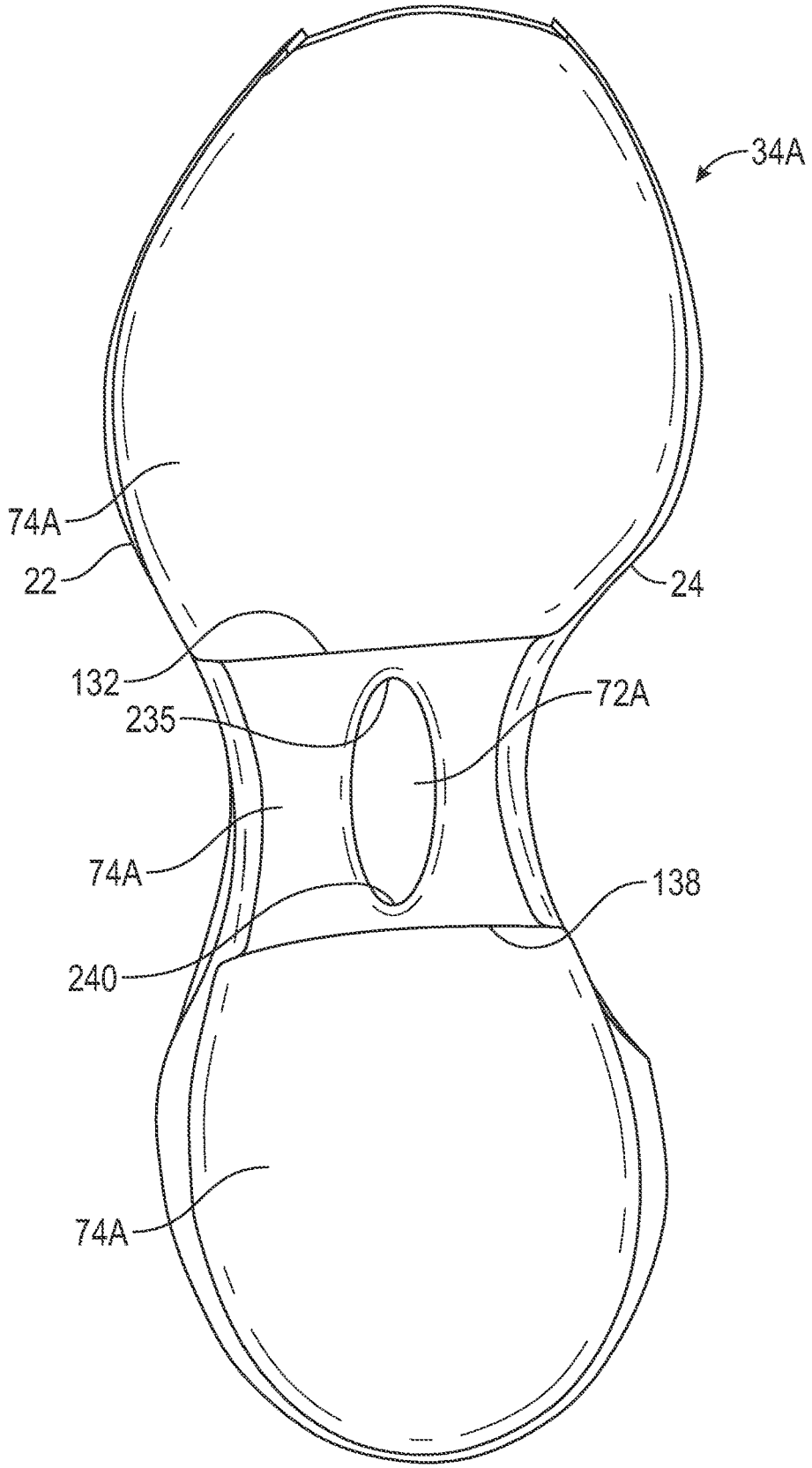
FIG. 33 is a bottom view of the second foam layer of FIG. 32.

Furthermore, in addition to the recess 72A that helps to locate the plate 32A, the second foam layer 34A has features that assist with proper location of front and rear outsole components 36, 38 during assembly. For example, the distal side 74A of the second foam layer 34A has a forward-facing lip 132 extending from the medial side 24 of the second foam layer 34A to the lateral side 22 of the second foam layer 34A and forward of the recess 72A, as shown in FIG. 33, similar to as described with respect to the second foam layer 34 of the sole structure 14. A rear edge 136 of the front outsole component 36 interfaces with the forward-facing lip 132. The rear edge 136 has a contour that follows the contour of the forward-facing lip 132 so that the rear edge 136 may abut the forward-facing lip 132 when the front outsole component 36A is secured to the distal side 74A by adhesive or otherwise.

Similarly, the distal side 74A of the second foam layer 34A has a rearward-facing lip 138 extending from the medial side 24 of the second foam layer 34A to the lateral side 22 of the second foam layer 34A and rearward of the recess 72A. A front edge 142 of the rear outsole component 38A interfaces with the rearward-facing lip 138. For example, the front edge 142 has a contour that follows the contour of the rearward-facing lip 138 so that the front edge 142 may abut the rearward-facing lip 138 when the rear outsole component 38A is secured to the distal side 74A by adhesive or otherwise. The lips 132 and 138 are generally straight in the transverse direction adjacent to the recess 72A in the embodiment shown. In an alternative embodiment, the lips could track the shape of the front and the rear of the recess 72A. The forward-facing lip 132 and the rearward-facing lip 138 thus provide locating features at which the front and rear outsole components 36A, 38A can be accurately placed at the distal side 74A of the second foam layer 34A.

Figure 35:
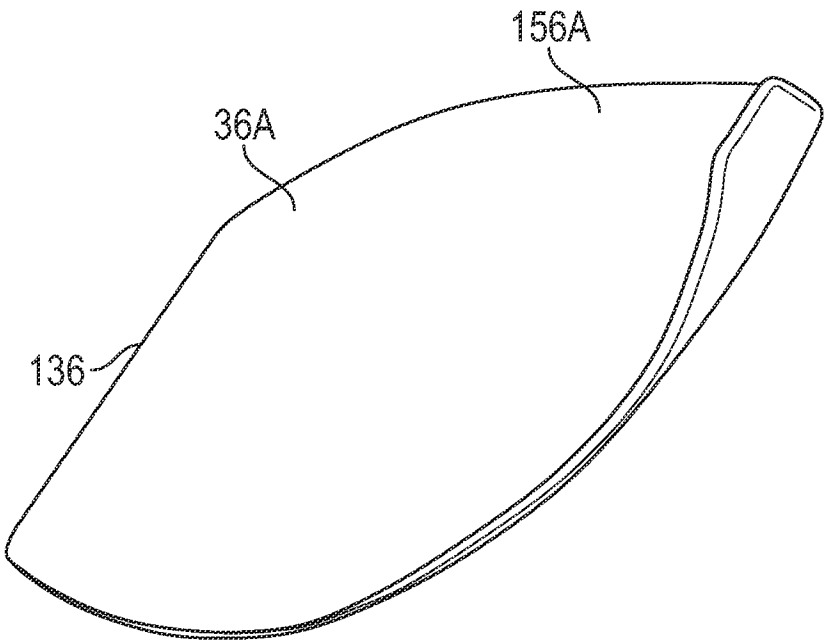
FIG. 35 is a perspective view of a front outsole component of the article of footwear of FIG. 19.
Figure 34:
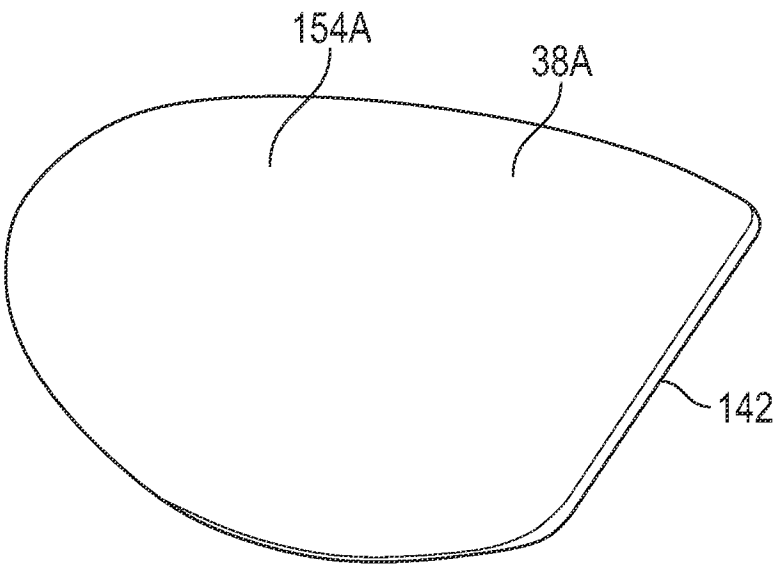
FIG. 34 is a perspective view of a rear outsole component of the article of footwear of FIG. 19.

As shown in FIG. 19, the front outsole component 36A is secured to the distal side 74A of the second foam layer 34A in the forefoot region 16 to establish a portion of a ground-engaging surface 127 of the sole structure 14A. More specifically, the proximal side 156A of the front outsole component 36A shown in FIG. 35 is secured to the distal side 74A of the second foam layer 34A. The rear outsole component 38A is secured to the distal side 74A of the second foam layer 34A in the heel region 20 to establish another portion of a ground-engaging surface 127 of the sole structure 14A. More specifically, the proximal side 154A of the rear outsole component 38A shown in FIG. 34 is secured to the distal side 74A of the second foam layer 34A. The front and rear outsole components 36A, 38A are separate components in that they are discreet and non-integral with one another. The front and rear outsole components 36A, 38A may be formed from any of the materials described with respect to the front and rear outsole component 36, 38 of the sole structure 14. Additionally, the front and rear outsole components 36A, 38A may have apertures extending therethrough.

It is apparent in FIG. 21 that the front and rear outsole components 36A, 38A may each have a plurality of lugs 150 or other tread elements to increase traction. Only some of the lugs 150 are labelled in FIG. 21. Although the lugs 150 are shown as generally rectangular or square, lugs of other shapes may be used.

Figure 36:
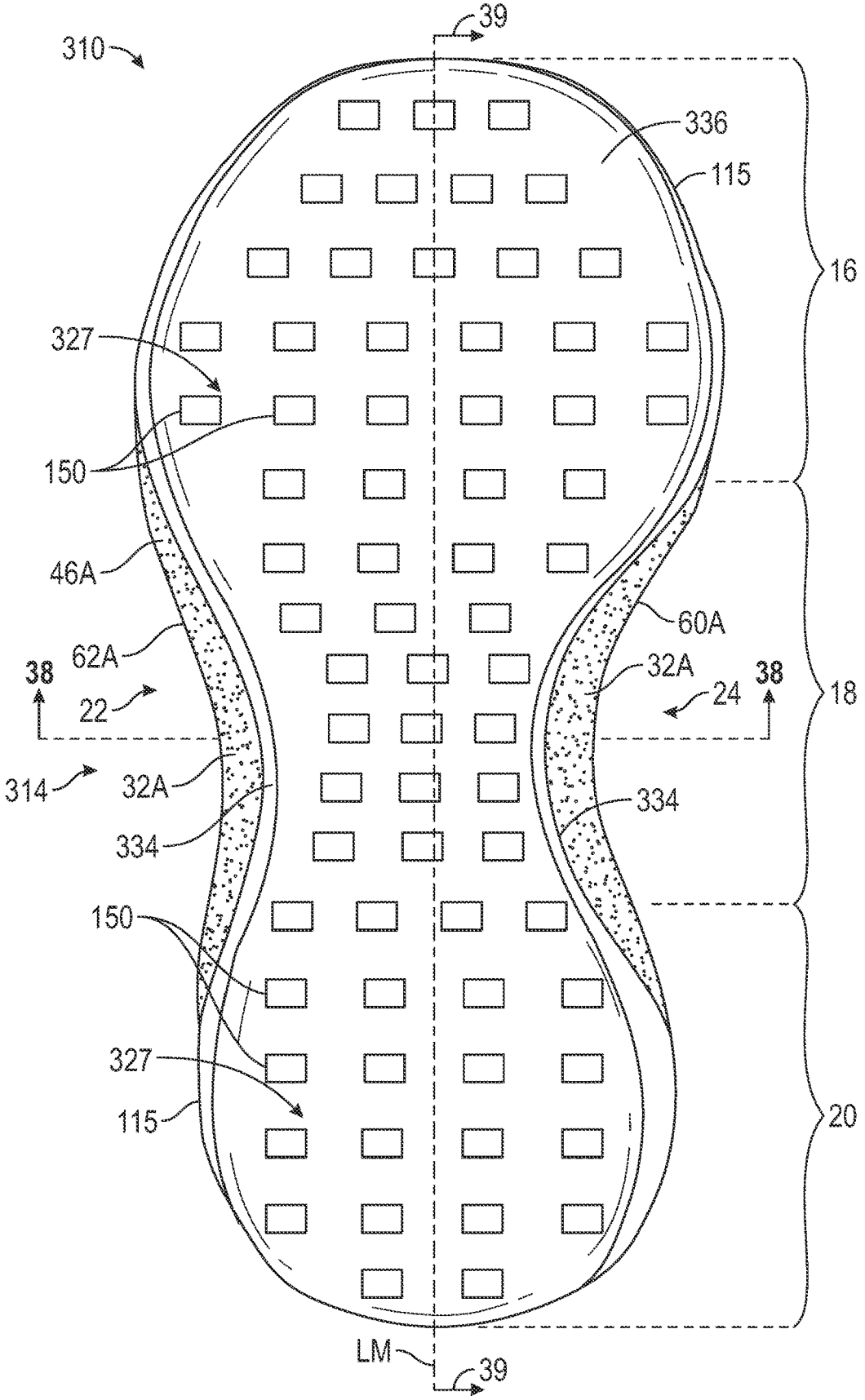
FIG. 36 is a bottom view of an alternative example of an article of footwear.

FIG. 36 is a bottom view of an alternative example of an article of footwear 310 having a sole structure 314. The article of footwear 310 includes many of the same features as described with respect to the articles of footwear 10 and 110, and these are indicated with like reference numbers in the drawings. For example, the first foam layer 30A and the upper 12 are identical to those of the article of footwear 110.

Figure 37:
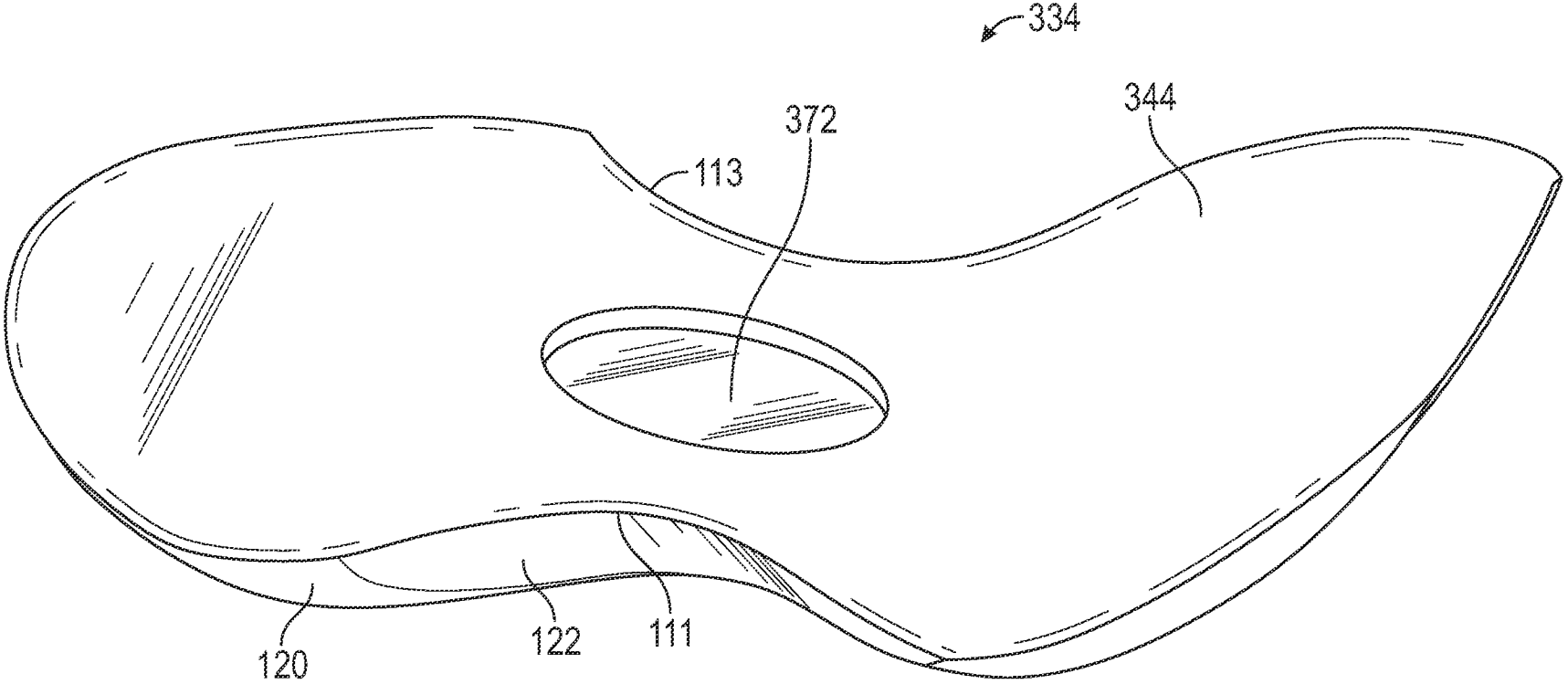
FIG. 37 is a perspective view of a second foam layer of the article of footwear of FIG. 36.

In place of the second foam layer 34A, the article of footwear 310 includes a second foam layer 334. Instead of recess 72A, the proximal side 344 of the second midsole layer 334 has either no recess or a slight recess that is not a through hole, such as recess 372. The slight depth of the recess 372 is evident in FIGS. 37 and 38, for example. Although the recess 372 is shown with an outer shape like recess 72A, a different shape may be used such as an oval shape. Although the protrusion 70A and the recess 372 are shown as relatively oval, they may have other shapes such as circular, square, rectangular, or other polygonal shapes. In an embodiment, a protrusion and a recess that interfits with the protrusion may have rounded front and rear ends like the protrusion 70A and the through hole 72A and may be narrowed in a midportion between the front and rear ends. For example, the protrusion and the recess may each resemble an elongated oval that is narrowed in a transverse direction of the sole structure 314 at its midsection. In such an embodiment, a periphery of the protrusion and a perimeter of the recess may resemble an elongated eight-shape.

Figure 38:
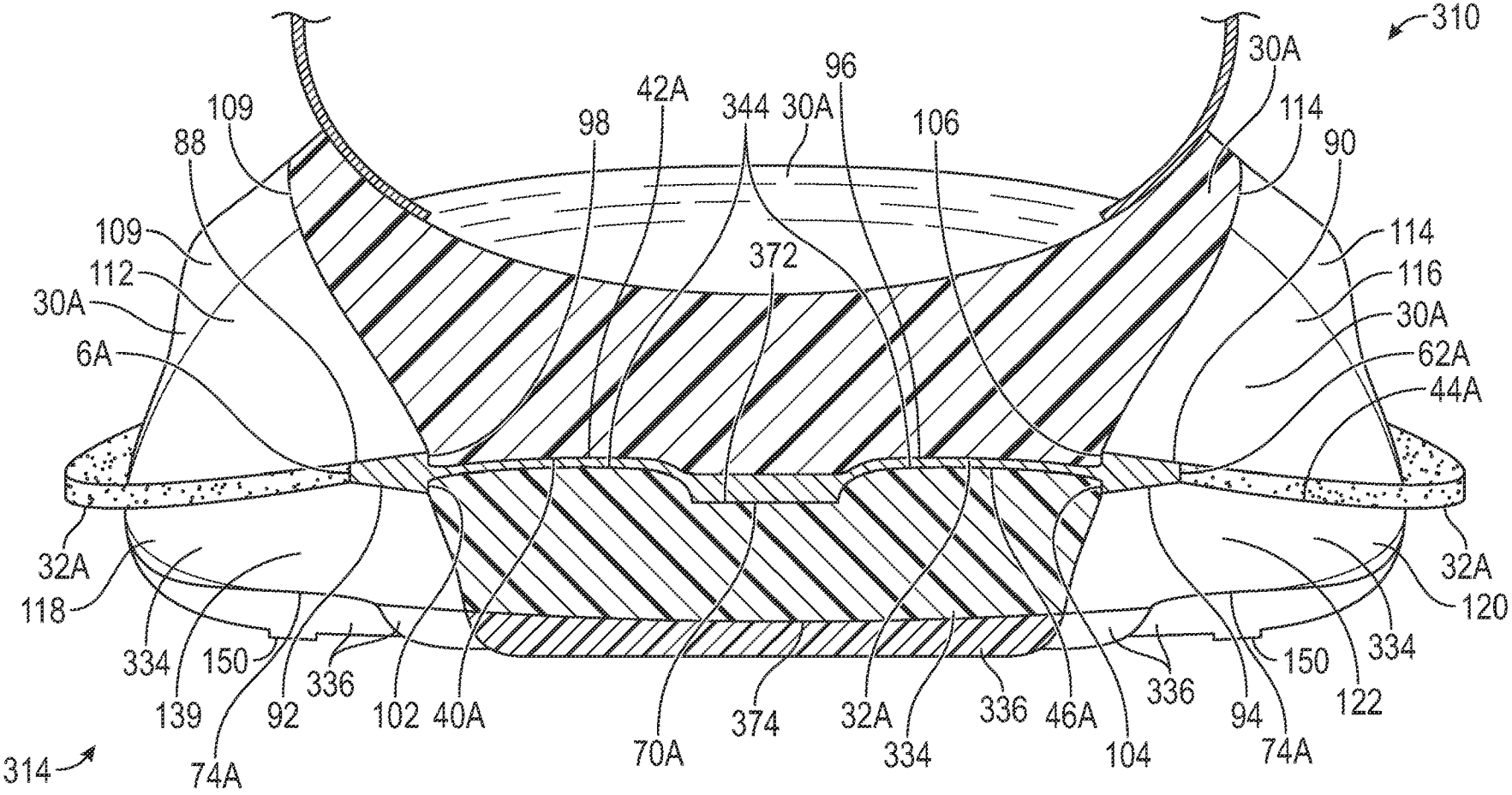
FIG. 38 is a cross-sectional view of the article of footwear of FIG. 36 taken at lines 38-38 in FIG. 36.
Figure 39:
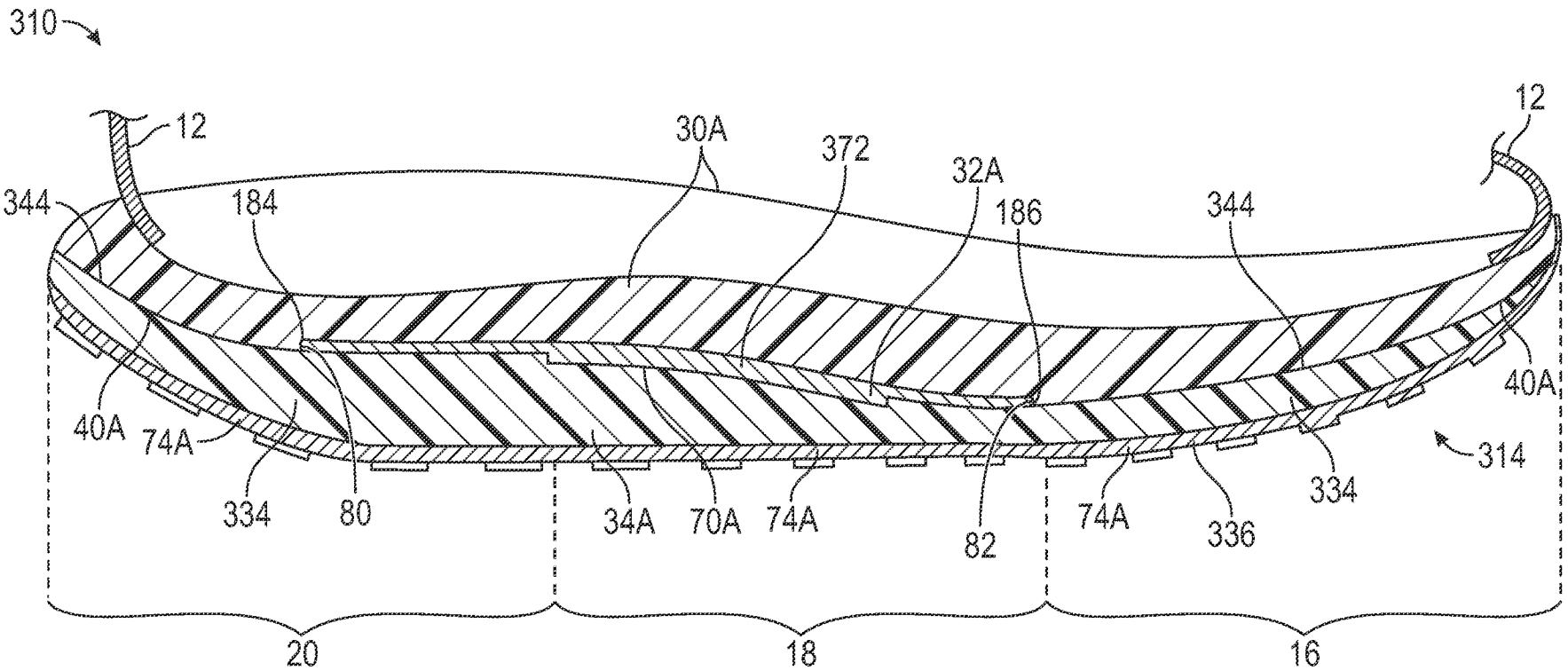
FIG. 39 is a cross-sectional view of the article of footwear of FIG. 36 taken at lines 39-39 in FIG. 36.

If a slight recess is provided, then the plate 32A as described may be used, with the protrusion 70A interfitting with recess 372, as shown in FIGS. 38 and 39. If no recess is provided in the proximal side 344 of the second foam layer 334 for interfitting with the plate, then a plate like plate 32A except for without the protrusion 70A may be used. It is advantageous to provide an interfitting protrusion and recess for purposes of locating the plate to the proximal side 344 of the second foam layer 334.

Because the recess 372 is not a through hole, in such an implementation, the distal side 46A of the plate 32A at the protrusion 70A is not exposed when viewed from the distal side 374 of the second foam layer 334, (e.g., when viewed from the bottom of the article of footwear 310 as in FIG. 36).

Because there is no through hole, the distal side 374 of the second foam layer 334 does not include lips corresponding to lips 132 and 138. Additionally, the article of footwear 310 includes a single outsole component 336 secured to the distal side 374 of the second foam layer 334 in the forefoot region 16, in the midfoot region 18, and in the heel region 20 to a ground-engaging surface 327 of the sole structure 314. The outsole component 336 may be any of the materials as described with respect to the outsole components 36, 38, and may include lugs 150 as described with respect to the outsole components 36, 38.

Figure 40:
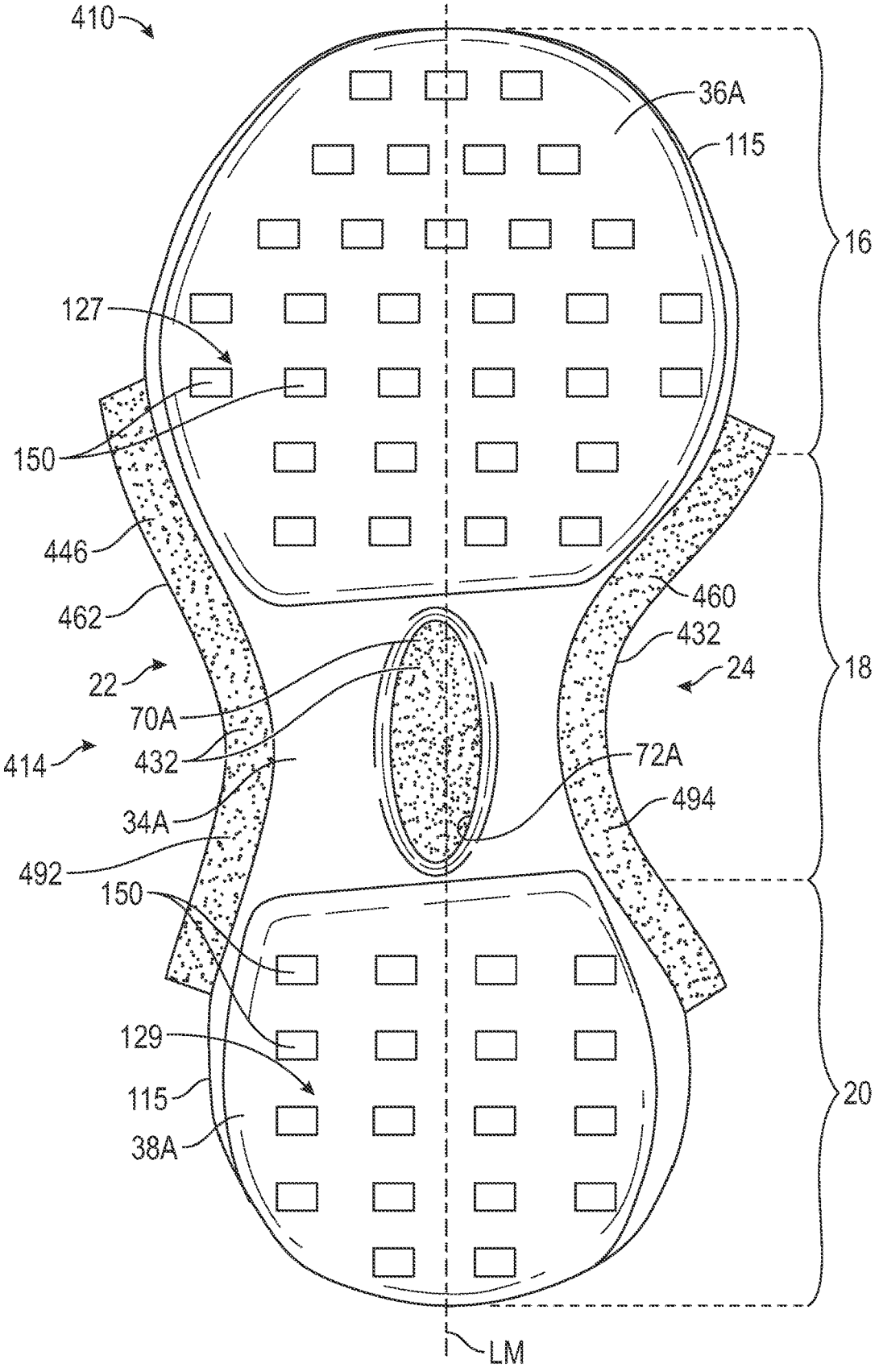
FIG. 40 is a bottom view of an alternative example of an article of footwear.

FIG. 40 is a bottom view of an alternative example of an article of footwear 410 including a sole structure 414. The article of footwear 410 is identical to the article of footwear 110 described herein except that plate 432 is used in place of plate 32A. Plate 432 is alike in all aspects to the plate 32A and includes many of the same features as described with respect to the plate 32A, and these are indicated with like reference numbers in the drawings. A difference between plate 432 and plate 32A is that the plate 432 has rails 488, 490, 492, and 494 in place of rails 88, 90, 92, and 94, respectively. The width of each of the rails 488, 490, 492, and 494 is constant. Stated differently, an exposed portion of the plate 432 at each of the medial side 24 and the lateral side 22 (e.g., at the rails 488, 490, 492, and 494) has a constant width in each of the midfoot region 18, the forefoot region 16, and the heel region 20. As such, the rails 488, 490, 492, and 494 do not taper in width from the midfoot region 18 in a forward direction or from the midfoot region 18 in a rearward direction as do the rails 88, 90, 92, and 94.

Figure 41:
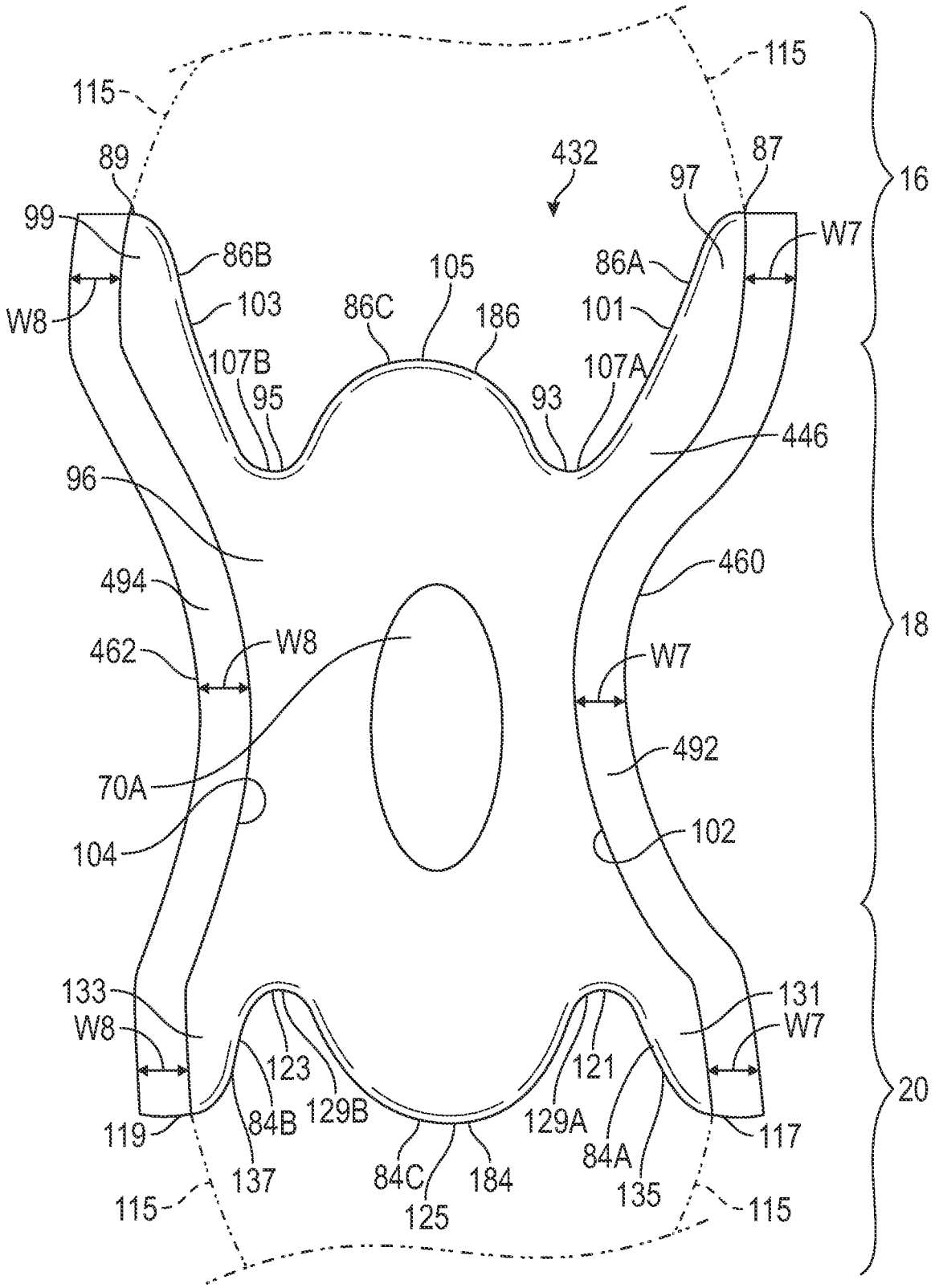
FIG. 41 is a bottom view of a plate included in the article of footwear of FIG. 40.
Figure 42:
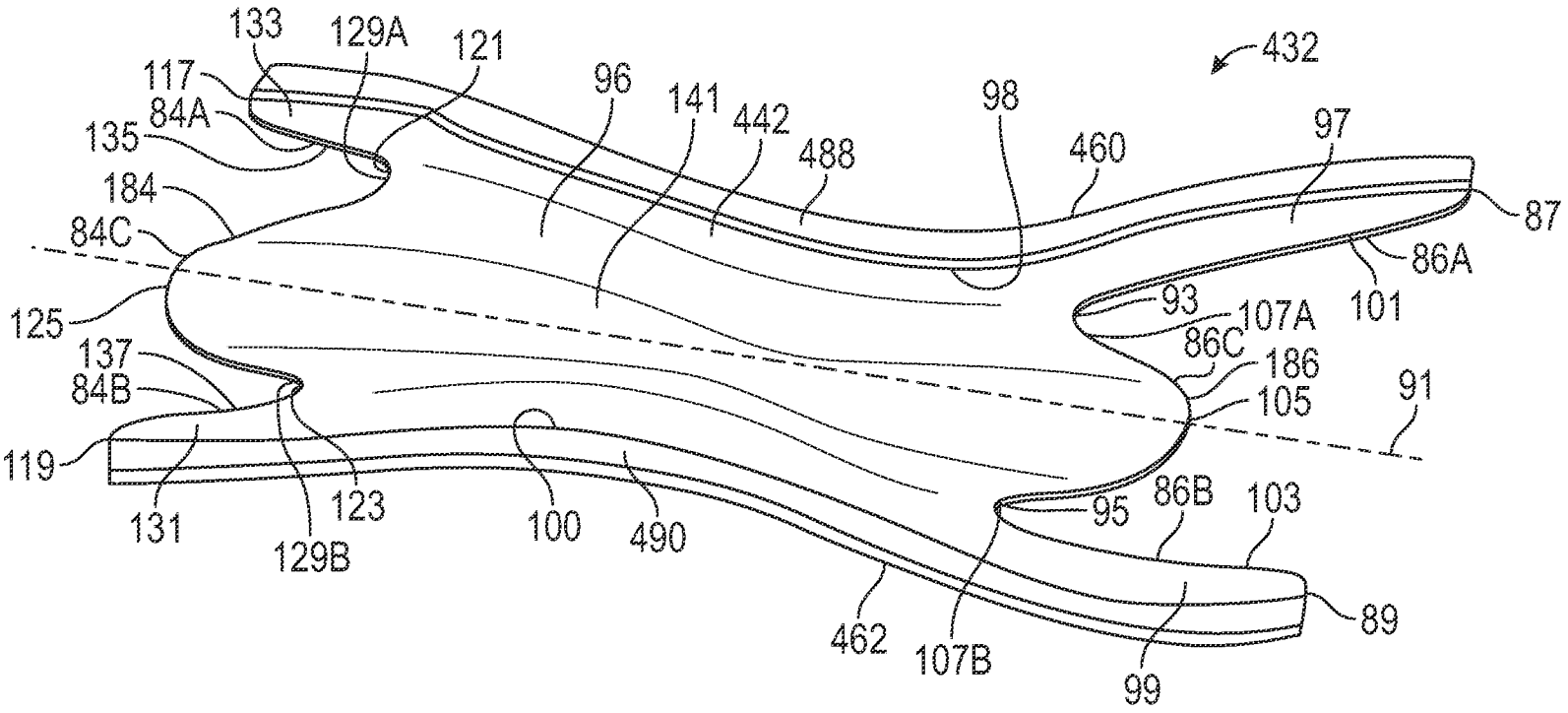
FIG. 42 is a perspective view of the plate of FIG. 41.

More specifically, with reference to FIG. 42, the proximal side 442 of the plate 432 has a medial rail 488 extending along the medial edge 460 of the plate 432 and a lateral rail 490 extending along the lateral edge 462 of the plate 432. The medial rail 488 may be referred to as a proximal medial rail 488 and the lateral rail 490 may be referred to as a proximal lateral rail 490. Similarly, as shown in FIG. 41, the distal side 446 of the plate 432 has a medial rail 492 extending along the medial edge 460 of the plate 432 and a lateral rail 494 extending along the lateral edge 462 of the plate 432. The medial rail 492 may be referred to as a distal medial rail 492 and the lateral rail 494 may be referred to as a distal lateral rail 494. The central portion 96 of the plate 432 is disposed between and is integral with the medial rail 488 and the lateral rail 490 as well as between the medial rail 492 and the lateral rail 494.

The width of the rails 488, 490, 492, and 494 is the same in the midfoot region 18, the forefoot region 16, and the heel region 20. FIG. 41 shows the medial rail 492 has a width W7 at a location in the midfoot region 18, at a location in the forefoot region 16, and at a location in the heel region 20. Similarly, the lateral rail 94 has a width W8 at a location in the midfoot region 18, at a location in the forefoot region 16, and at a location in the heel region 20. The width W7 may be the same or different than the width W8.

The proximal medial rail 488 directly overlies and is integral with the distal medial rail 492. The proximal lateral rail 490 directly overlies and is integral with the distal lateral rail 494. The thickness of the central portion 96 of the plate 432 is less than the thickness of the plate 432 anywhere along the medial rails 488, 492 or the lateral rails 490, 494 except that thickness of the plate 432 at the protrusion 70A may be less than, greater than, or equal to the thickness of the plate 432 at the medial rails 488, 492 or at the lateral rails 490, 494. The thicker rails 488, 492 and 490, 494 may increase the bending stiffness of the plate 432 and limit twisting of the plate 432, further increasing stability.

In addition to maintaining a constant width, the rails 488, 492, 490, and 494 may maintain a constant thickness (e.g., as measured from the proximal side 442 to the distal side 446) in each of the forefoot region 16, the midfoot region 18, and the heel region 20, as shown in FIG. 41. Alternatively, the rails 488, 492, 490, and 494 could be thicker at the midfoot region 18 than at the forefoot and heel regions 16, 20, similar to the plate 32A as shown in FIGS. 30 and 31.

The following Clauses provide example configurations of an article of footwear disclosed herein.

Clause 1. An article of footwear comprising: a sole structure including: a plate; a first foam layer overlying the plate and having a distal side interfacing with a proximal side of the plate; and a second foam layer underlying the plate and having a proximal side interfacing with a distal side of the plate; wherein a compressive stiffness of the first foam layer is greater than a compressive stiffness of the second foam layer, and a compressive stiffness of the plate is greater than the compressive stiffness of the first foam layer.

Clause 2. The article of footwear of clause 1, wherein: the sole structure has a forefoot region, a midfoot region, and a heel region; the plate extends in the forefoot region, the midfoot region, and the heel region; and the distal side of the first foam layer and the proximal side of the second foam layer interface with one another in the forefoot region forward of a front edge of the plate.

Clause 3. The article of footwear of clause 2, wherein the distal side of the first foam layer has a downwardly-extending front ledge and a front edge of the plate fits against the downwardly-extending front ledge.

Clause 4. The article of footwear of any of clauses 1-3, wherein: the sole structure has a forefoot region, a midfoot region, and a heel region; the plate extends in the forefoot region, the midfoot region, and the heel region; and the distal side of the first foam layer and the proximal side of the second foam layer interface with one another in the heel region rearward of a rear edge of the plate.

Clause 5. The article of footwear of clause 4, wherein the distal side of the first foam layer has a downwardly-extending rear ledge and the rear edge of the plate fits against the downwardly-extending rear ledge.

Clause 6. The article of footwear of any of clauses 1-3, wherein: the sole structure has a forefoot region, a midfoot region, and a heel region; each of the plate, the first foam layer, and the second foam layer extend in the forefoot region, the midfoot region, and the heel region; a medial edge of the plate and a lateral edge of the plate extend transversely outward of the distal side of the first foam layer in each of the forefoot region, the midfoot region, and the heel region; and the medial edge of the plate and the lateral edge of the plate extend transversely outward of the proximal side of the second foam layer in each of the forefoot region, the midfoot region, and the heel region.

Clause 7. The article of footwear of clause 6, wherein: the proximal side of the plate has a medial rail extending along the medial edge of the plate and a lateral rail extending along the lateral edge of the plate; and the first foam layer is nested between the medial rail and the lateral rail.

Clause 8. The article of footwear of clause 6, wherein: the distal side of the plate has a medial rail extending along the medial edge of the plate and a lateral rail extending along the lateral edge of the plate; and the second foam layer is nested between the medial rail and the lateral rail.

Clause 9. The article of footwear of any of clauses 1-3, wherein: the sole structure has a forefoot region, a midfoot region, and a heel region; the plate extends in the forefoot region, the midfoot region, and the heel region; the distal side of the plate has a protrusion extending in the midfoot region transversely inward of a medial edge of the plate and transversely inward of a lateral edge of the plate; the proximal side of the second foam layer has a recess; and the protrusion interfits with the recess.

Clause 10. The article of footwear of clause 9, wherein the recess is a through hole that extends from the proximal side of the second foam layer to the distal side of the second foam layer.

Clause 11. The article of footwear of clause 10, wherein the distal side of the plate at the protrusion is exposed at the through hole.

Clause 12. The article of footwear of clause 10, further comprising: a front outsole component secured to the distal side of the second foam layer in the forefoot region; wherein the distal side of the second foam layer has a forward-facing lip extending from a medial side of the second foam layer to a lateral side of the second foam layer and around a front of the through hole; and wherein a rear edge of the front outsole component interfaces with the forward-facing lip.

Clause 13. The article of footwear of clause 10, further comprising: a rear outsole component secured to the distal side of the second foam layer in the heel region; wherein the distal side of the second foam layer has a rearward-facing lip extending from a medial side of the second foam layer to a lateral side of the second foam layer and around a rear of the through hole; and wherein a front edge of the rear outsole component interfaces with the rearward-facing lip.

Clause 14. The article of footwear of any of clauses 1-3, further comprising: a footwear upper secured to the first foam layer and overlying the first foam layer; wherein a medial side wall of the first foam layer extends partially upward along a medial side of the footwear upper; and wherein a lateral side wall of the first foam layer extends partially upward along a lateral side of the footwear upper.

Clause 15. An article of footwear comprising: a sole structure having a forefoot region, a midfoot region, and a heel region, the sole structure including: a plate extending in the forefoot region, the midfoot region, and the heel region; a first foam layer overlying the plate and having a distal side interfacing with a proximal side of the plate in the forefoot region, the midfoot region, and the heel region; and a second foam layer underlying the plate and having a proximal side interfacing with a distal side of the plate in the forefoot region, the midfoot region, and the heel region; wherein: a medial edge of the plate and a lateral edge of the plate extend transversely outward of the distal side of the first foam layer in each of the forefoot region, the midfoot region, and the heel region; and the medial edge of the plate and the lateral edge of the plate extend transversely outward of the proximal side of the second foam layer in each of the forefoot region, the midfoot region, and the heel region.

Clause 16. The article of footwear of clause 15, wherein the plate has a greater compressive stiffness than each of the first foam layer and the second foam layer and is thinner than each of the first foam layer and the second foam layer where the first foam layer and the second foam layer interface with the plate.

Clause 17. The article of footwear of any of clauses 15-16, wherein: the proximal side of the plate has a proximal-side medial rail extending along the medial edge of the plate and a proximal-side lateral rail extending along the lateral edge of the plate; the first foam layer is nested between the proximal-side medial rail and the proximal-side lateral rail; the distal side of the plate has a distal-side medial rail extending along the medial edge of the plate and a distal-side lateral rail extending along the lateral edge of the plate; and the second foam layer is nested between the distal-side medial rail and the distal-side lateral rail.

Clause 18. The article of footwear of any of clauses 15-16, wherein: the distal side of the plate has a protrusion extending in the midfoot region transversely inward of the medial edge of the plate and transversely inward of the lateral edge of the plate; the proximal side of the second foam layer has a recess; and the protrusion interfits with the recess.

Clause 19. The article of footwear of clause 18, wherein the recess is a through hole that extends from the proximal side of the second foam layer to the distal side of the second foam layer.

Clause 20. The article of footwear of clause 19, wherein the distal side of the plate at the protrusion is exposed at the through hole.

Clause 21. An article of footwear comprising: a sole structure having a forefoot region, a midfoot region, and a heel region, the sole structure including: a plate disposed in the midfoot region and having a front edge and a rear edge; wherein the front edge has a medial segment that includes a medial extremity of the front edge, a lateral segment that includes a lateral extremity of the front edge, and a middle segment extending from the medial segment to the lateral segment; wherein the medial segment and the lateral segment extend further forward than the middle segment; a first foam layer overlying the plate and having a distal side interfacing with a proximal side of the plate; and a second foam layer underlying the plate and having a proximal side interfacing with a distal side of the plate; wherein the first foam layer and the second foam layer extend forward of the front edge of the plate and extend rearward of the rear edge of the plate.

Clause 22. The article of footwear of clause 21, wherein a forwardmost extent of the middle segment is disposed in the midfoot region of the sole structure.

Clause 23. The article of footwear of any of the clauses 21-22, wherein a forwardmost extent of the medial segment is the medial extremity of the front edge.

Clause 24. The article of footwear of any of the clauses 21-22, wherein a forwardmost extent of the lateral segment is the lateral extremity of the front edge.

Clause 25. The article of footwear of any of the clauses 21-22, wherein the front edge recedes rearward between the medial extremity of the front edge and a forwardmost extent of the middle segment.

Clause 26. The article of footwear of any of the clauses 21-22, wherein the front edge recedes rearward between the lateral extremity of the front edge and a forwardmost extent of the middle segment.

Clause 27. The article of footwear of any of the clauses 21-22, wherein the front edge recedes rearward between the medial extremity of the front edge and a forwardmost extent of the middle segment and the front edge recedes rearward between the lateral extremity of the front edge and the forwardmost extent of the middle segment such that the front edge defines a first indentation between the medial extremity of the front edge and the forwardmost extent of the middle segment and a second indentation between the lateral extremity of the front edge and the forwardmost extent of the middle segment, and the front edge juts forward to the forwardmost extent of the middle segment between the first indentation and the second indentation.

Clause 28. The article of footwear of any of the clauses 21-22, wherein the rear edge has a medial segment that includes a medial extremity of the rear edge, a lateral segment that includes a lateral extremity of the rear edge, and a middle segment extending from the medial segment of the rear edge to the lateral segment of the rear edge; and wherein the rear edge extends forward between the medial extremity of the rear edge and a rearmost extent of the middle segment of the rear edge.

Clause 29. The article of footwear of any of the clauses 21-22, wherein the rear edge extends forward between the lateral extremity of the rear edge and a rearmost extent of the middle segment of the rear edge.

Clause 30. The article of footwear of any of the clauses 21-22, wherein the rear edge has a medial segment that includes a medial extremity of the rear edge, a lateral segment that includes a lateral extremity of the rear edge, and a middle segment extending from the medial segment of the rear edge to the lateral segment of the rear edge; and wherein the rear edge extends forward between the medial extremity of the rear edge and a rearmost extent of the middle segment of the rear edge and between the lateral extremity of the rear edge and the rearmost extent of the middle segment of the rear edge such that the rear edge defines a first indentation between the medial extremity of the rear edge and the rearmost extent of the middle segment of the rear edge and a second indentation between the lateral extremity of the rear edge and the rearmost extent of the middle segment of the rear edge, and the rear edge juts rearward to the rearmost extent of the middle segment of the rear edge between the first indentation of the rear edge and the second indentation of the rear edge.

Clause 31. The article of footwear of any of the clauses 21-22, wherein the plate is wider in a transverse direction of the sole structure than the first foam layer and the second foam layer where the first foam layer and the second foam layer interface with the plate, and the plate extends continuously from the front edge to the rear edge and from a medial edge of the plate to a lateral edge of the plate such that the distal side of the first foam layer interfaces with the proximal side of the second foam layer only forward of the front edge of the plate and only rearward of the rear edge of the plate.

Clause 32. The article of footwear of any of the clauses 21-22, wherein the plate does not extend continuously along a cross-section of the sole structure taken in a transverse direction of the sole structure in the forefoot region.

Clause 33. The article of footwear of any of the clauses 21-22, wherein the proximal side of the plate is nonplanar and includes a trough extending longitudinally along a longitudinal midline of the plate.

Clause 34. The article of footwear of any of the clauses 21-22, wherein a compressive stiffness of the first foam layer is greater than a compressive stiffness of the second foam layer, and a compressive stiffness of the plate is greater than the compressive stiffness of the first foam layer.

Clause 35. The article of footwear of any of the clauses 21-22, wherein a medial edge of the plate and a lateral edge of the plate extend transversely outward of the distal side of the first foam layer in at least the midfoot region; and the medial edge of the plate and the lateral edge of the plate extend transversely outward of the proximal side of the second foam layer in at least the midfoot region.

Clause 36. The article of footwear of clause 25, wherein: the proximal side of the plate has a proximal-side medial rail extending along the medial edge of the plate and a proximal-side lateral rail extending along the lateral edge of the plate; the first foam layer is nested between the proximal-side medial rail and the proximal-side lateral rail; the distal side of the plate has a distal-side medial rail extending along the medial edge of the plate and a distal-side lateral rail extending along the lateral edge of the plate; and the second foam layer is nested between the distal-side medial rail and the distal-side lateral rail.

Clause 37. An article of footwear of any of the preceding clauses comprising: a sole structure having a forefoot region, a midfoot region, and a heel region, the sole structure including: a plate extending in the midfoot region and having: a front medial arm extending from the midfoot region into the forefoot region and defining a medial edge of the plate; a front lateral arm extending from the midfoot region into the forefoot region and defining a lateral edge of the plate; a nonlinear front edge extending between the front medial arm and the front lateral arm and extending further rearward than both a foremost extremity of the front medial arm and a foremost extremity of the front lateral arm; and a rear edge; a first foam layer overlying the plate and having a distal side interfacing with a proximal side of the plate from the nonlinear front edge to the rear edge; and a second foam layer underlying the plate and having a proximal side interfacing with a distal side of the plate from the nonlinear front edge to the rear edge; wherein the first foam layer and the second foam layer extend further forward than the front edge of the plate and extend further rearward than the rear edge of the plate.

Clause 38. The article of footwear of clause 37, wherein the front edge has a medial segment that defines an inner extent of the front medial arm, a lateral segment that defines an inner extent of the front lateral arm, and a middle segment extending from the medial segment to the lateral segment; wherein the front edge juts forward at the middle segment to a forwardmost extent of the middle segment that is rearward of the foremost extremity of the front medial arm and is rearward of the foremost extremity of the front lateral arm.

Clause 39. The article of footwear of any of clauses 37-38, wherein the plate has: a rear medial arm extending rearward in the heel region and further defining the medial edge of the plate; a rear lateral arm extending rearward in the heel region and further defining the lateral edge of the plate; wherein the rear edge extends nonlinearly from the rear medial arm to the rear lateral arm.

Clause 40. The article of footwear of clause 39, wherein the rear edge has a medial segment that defines an inner extent of the rear medial arm, a lateral segment that defines an inner extent of the rear lateral arm, and a middle segment extending from the medial segment of the rear edge to the lateral segment of the rear edge; and wherein the rear edge juts rearward at the middle segment of the rear edge to a rearmost extent of the middle segment of the rear edge that is not rearward of a rearmost extremity of the rear medial arm and/or is not rearward of a rearmost extremity of the rear lateral arm.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready-to-wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of' is understood to include any possible combination of referenced items, including "any one of" the referenced items. The term "any of' is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure including:

a plate;

a first foam layer overlying the plate and having a distal side interfacing with a proximal side of the plate; and a second foam layer underlying the plate and having a proximal side interfacing with a distal side of the plate;

wherein a compressive stiffness of the first foam layer is greater than a compressive stiffness of the second foam layer, and a compressive stiffness of the plate is greater than the compressive stiffness of the first foam layer;

wherein a front edge of the plate intersects a medial edge of the plate at a medial pointed corner;

wherein the front edge of the plate intersects a lateral edge of the plate at a lateral pointed corner;

wherein the front edge of the plate extends between the medial pointed corner and the lateral pointed corner;

wherein the front edge has a medial segment extending to the medial pointed corner, a lateral segment extending to the lateral pointed corner, and a middle segment extending from the medial segment to the lateral segment;

wherein the medial segment and the lateral segment extend further forward than the middle segment; and wherein the front edge recedes rearward between the medial pointed corner and a forwardmost extent of the middle segment and the front edge recedes rearward between the lateral pointed corner and the forwardmost extent of the middle segment such that the front edge defines a first indentation between the medial pointed corner of the front edge and the forwardmost extent of the middle segment and a second indentation between the lateral pointed corner of the front edge and the forwardmost extent of the middle segment, the front edge juts forward to the forwardmost extent of the middle segment between the first indentation and the second indentation, and the forwardmost extent of the middle segment is rearward of the medial pointed corner and rearward of the lateral pointed corner.

2. The article of footwear of claim 1, wherein:

the sole structure has a forefoot region, a midfoot region, and a heel region;

the plate extends in the forefoot region, the midfoot region, and the heel region; and the distal side of the first foam layer and the proximal side of the second foam layer interface with one another in the forefoot region forward of the front edge of the plate.

3. The article of footwear of claim 1, wherein:

the sole structure has a forefoot region, a midfoot region, and a heel region;

the plate extends in the forefoot region, the midfoot region, and the heel region; and the distal side of the first foam layer and the proximal side of the second foam layer interface with one another in the heel region rearward of a rear edge of the plate.

4. The article of footwear of claim 1, wherein:

the sole structure has a forefoot region, a midfoot region, and a heel region;

each of the plate, the first foam layer, and the second foam layer extend in the forefoot region, the midfoot region, and the heel region;

the medial edge of the plate and the lateral edge of the plate extend transversely outward of the distal side of the first foam layer in each of the forefoot region, the midfoot region, and the heel region; and the medial edge of the plate and the lateral edge of the plate extend transversely outward of the proximal side of the second foam layer in each of the forefoot region, the midfoot region, and the heel region.

5. The article of footwear of claim 4, wherein:

the proximal side of the plate has a medial rail extending along the medial edge of the plate and a lateral rail extending along the lateral edge of the plate; and the first foam layer is nested between the medial rail and the lateral rail.

6. The article of footwear of claim 4, wherein:

the distal side of the plate has a medial rail extending along the medial edge of the plate and a lateral rail extending along the lateral edge of the plate; and the second foam layer is nested between the medial rail and the lateral rail.

7. The article of footwear of claim 1, wherein:

the sole structure has a forefoot region, a midfoot region, and a heel region;

the plate extends in the forefoot region, the midfoot region, and the heel region;

the distal side of the plate has a protrusion extending in the midfoot region transversely inward of the medial edge of the plate and transversely inward of the lateral edge of the plate;

the proximal side of the second foam layer has a recess; and the protrusion interfits with the recess.

8. The article of footwear of claim 7, wherein the recess is a through hole that extends from the proximal side of the second foam layer to the distal side of the second foam layer.

9. An article of footwear comprising:

a sole structure having a forefoot region, a midfoot region, and a heel region, the sole structure including:

a plate extending in the forefoot region, the midfoot region, and the heel region;

a first foam layer overlying the plate and having a distal side interfacing with a proximal side of the plate in the forefoot region, the midfoot region, and the heel region; and a second foam layer underlying the plate and having a proximal side interfacing with a distal side of the plate in the forefoot region, the midfoot region, and the heel region;

wherein:

a medial edge of the plate and a lateral edge of the plate extend transversely outward of the distal side of the first foam layer in each of the forefoot region, the midfoot region, and the heel region;

the medial edge of the plate and the lateral edge of the plate extend transversely outward of the proximal side of the second foam layer in each of the forefoot region, the midfoot region, and the heel region;

the proximal side of the plate has a proximal-side medial rail extending along the medial edge of the plate and a proximal-side lateral rail extending along the lateral edge of the plate;

the plate is thicker at the proximal-side medial rail and the proximal-side lateral rail than between the proximal-side medial rail and the proximal-side lateral rail such that the first foam layer is nested between the proximal-side medial rail and the proximal-side lateral rail;

the distal side of the plate has a distal-side medial rail extending along the medial edge of the plate and a distal-side lateral rail extending along the lateral edge of the plate; and the plate is thicker at the distal-side medial rail and the distal-side lateral rail than between the distal-side medial rail and the distal-side lateral rail such that the second foam layer is nested between the distal-side medial rail and the distal-side lateral rail.

10. The article of footwear of claim 9, wherein the plate has a greater compressive stiffness than each of the first foam layer and the second foam layer and is thinner than each of the first foam layer and the second foam layer where the first foam layer and the second foam layer interface with the plate.

11. The article of footwear of claim 9, wherein:

the distal side of the plate has a protrusion extending in the midfoot region transversely inward of the medial edge of the plate and transversely inward of the lateral edge of the plate;

the proximal side of the second foam layer has a recess; and the protrusion interfits with the recess.

12. The article of footwear of claim 9, wherein:

the plate has a front edge and a rear edge;

the front edge has a medial segment that includes a medial extremity of the front edge, a lateral segment that includes a lateral extremity of the front edge, and a middle segment extending from the medial segment to the lateral segment;

the medial segment and the lateral segment extend further forward than the middle segment; and the front edge recedes rearward between the medial extremity of the front edge and a forwardmost extent of the middle segment and the front edge recedes rearward between the lateral extremity of the front edge and the forwardmost extent of the middle segment such that the front edge defines a first indentation between the medial extremity of the front edge and the forwardmost extent of the middle segment and a second indentation between the lateral extremity of the front edge and the forwardmost extent of the middle segment, and the front edge juts forward to the forwardmost extent of the middle segment between the first indentation and the second indentation.

13. The article of footwear of claim 12, wherein the forwardmost extent of the middle segment is disposed in the midfoot region of the sole structure.

14. The article of footwear of claim 12, wherein:

the rear edge has a medial segment that includes a medial extremity of the rear edge, a lateral segment that includes a lateral extremity of the rear edge, and a middle segment extending from the medial segment of the rear edge to the lateral segment of the rear edge; and the rear edge extends forward between the medial extremity of the rear edge and a rearmost extent of the middle segment of the rear edge and between the lateral extremity of the rear edge and the rearmost extent of the middle segment of the rear edge such that the rear edge defines a first indentation between the medial extremity of the rear edge and the rearmost extent of the middle segment of the rear edge and a second indentation between the lateral extremity of the rear edge and the rearmost extent of the middle segment of the rear edge, and the rear edge juts rearward to the rearmost extent of the middle segment of the rear edge between the first indentation of the rear edge and the second indentation of the rear edge.

15. The article of footwear of claim 12, wherein the plate is wider in a transverse direction of the sole structure than the first foam layer and the second foam layer where the first foam layer and the second foam layer interface with the plate, and the plate extends continuously from the front edge to the rear edge and from the medial edge of the plate to the lateral edge of the plate such that the distal side of the first foam layer interfaces with the proximal side of the second foam layer only forward of the front edge of the plate and only rearward of the rear edge of the plate.

16. The article of footwear of claim 9, wherein the proximal side of the plate is nonplanar and includes a trough extending longitudinally along a longitudinal midline of the plate.

17. The article of footwear of claim 9, wherein a width of the distal-side medial rail at a location in the midfoot region is the same as a width of the distal-side medial rail at a location in the forefoot region, and is the same as a width of the distal-side medial rail at a location in the heel region.

18. An article of footwear comprising:

a sole structure having a forefoot region, a midfoot region, and a heel region, the sole structure including:

a plate extending in the forefoot region, the midfoot region, and the heel region;

a first foam layer overlying the plate and having a distal side interfacing with a proximal side of the plate in the forefoot region, the midfoot region, and the heel region; and a second foam layer underlying the plate and having a proximal side interfacing with a distal side of the plate in the forefoot region, the midfoot region, and the heel region;

wherein:

a medial edge of the plate and a lateral edge of the plate extend transversely outward of the distal side of the first foam layer in each of the forefoot region, the midfoot region, and the heel region; and the medial edge of the plate and the lateral edge of the plate extend transversely outward of the proximal side of the second foam layer in each of the forefoot region, the midfoot region, and the heel region;

the plate has a medial rail extending along the medial edge of the plate, the medial rail entirely transversely outward of the second foam layer in each of the forefoot region, the midfoot region, and the heel region, and a lateral rail extending along the lateral edge of the plate, the lateral rail entirely transversely outward of the second foam layer in each of the forefoot region, the midfoot region, and the heel region, wherein the plate is thicker at the medial rail and at the lateral rail than between the medial rail and the lateral rail;

a width of the medial rail in the midfoot region is the same as a width of the medial rail in the forefoot region, and is the same as a width of the medial rail in the heel region; and a width of the lateral rail in the midfoot region is the same as a width of the lateral rail in the forefoot region, and is the same as a width of the lateral rail in the heel region.

* * * * *